US011106155B2

(12) United States Patent
Sakaguchi et al.

(10) Patent No.: US 11,106,155 B2
(45) Date of Patent: Aug. 31, 2021

(54) IMAGE-FORMING APPARATUS WITH REDUCED NUMBER OF MOTORS FOR MOVING DEVELOPING ROLLERS AND ALTERING ROTATION SPEED RATIO OF DEVELOPING ROLLERS TO PHOTOSENSITIVE DRUMS

(71) Applicant: BROTHER KOGYO KABUSHIKI KAISHA, Nagoya (JP)

(72) Inventors: Shintaro Sakaguchi, Nagoya (JP); Toshiyuki Sano, Aichi-ken (JP); Masahito Saeki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/890,554

(22) Filed: Jun. 2, 2020

(65) Prior Publication Data

US 2020/0387081 A1 Dec. 10, 2020

(30) Foreign Application Priority Data

Jun. 5, 2019 (JP) ..... JP2019-105636

(51) Int. Cl.
*G03G 15/08* (2006.01)

(52) U.S. Cl.
CPC ..... *G03G 15/0822* (2013.01)

(58) Field of Classification Search
CPC ..... G03G 15/0822; G03G 15/0806; G03G 15/0896
See application file for complete search history.

(56) References Cited

U.S. PATENT DOCUMENTS

2005/0191073 A1* 9/2005 Kawamura ..... G03G 15/0806 399/55
2006/0245785 A1* 11/2006 Kawamura ..... G03G 21/181 399/111
2008/0285985 A1* 11/2008 Park ..... G03G 15/0822 399/27
2012/0014717 A1* 1/2012 Sugiyama ..... G03G 15/0121 399/228
2014/0169833 A1* 6/2014 Kawamura ..... G03G 21/1825 399/222

FOREIGN PATENT DOCUMENTS

JP 2012-128017 A 7/2012

* cited by examiner

*Primary Examiner* — Sandra Brase
(74) *Attorney, Agent, or Firm* — Scully, Scott, Murphy & Presser, P.C.

(57) ABSTRACT

An image-forming apparatus includes: a process motor; a developing motor; a sheet conveying device; first and second photosensitive drums rotatable by a driving force from the process motor; first and second developing rollers and first and second cams each rotatable by a driving force from the developing motor; a switching mechanism, and a controller. Rotation of each cam causes each developing roller to move between a contact position in contact with the corresponding photosensitive drum and a separated position away from the corresponding photosensitive drum. The controller allows the switching mechanism to transmit the driving force from the developing motor to each cam such that a timing of contact between the second developing roller and the second photosensitive drum in a low speed mode is coincident with or earlier than a timing of contact between the second developing roller and the second photosensitive drum in a normal mode.

20 Claims, 24 Drawing Sheets

IMAGE-FORMING APPARATUS WITH REDUCED NUMBER OF MOTORS FOR MOVING DEVELOPING ROLLERS AND ALTERING ROTATION SPEED RATIO OF DEVELOPING ROLLERS TO PHOTOSENSITIVE DRUMS

CROSS REFERENCE TO RELATED APPLICATION

This application claims priority from Japanese Patent Application No. 2019-105636 filed Jun. 5, 2019. The entire content of the priority application is incorporated herein by reference.

TECHNICAL FIELD

The present disclosure relates to an electrophotographic image-forming apparatus including a photosensitive drum and a developing roller.

BACKGROUND

Japanese Patent Application Publication No. 2012-128017 discloses an electro-photographic image-forming apparatus configured to form a toner image on a photosensitive drum by a contact development system. This image-forming apparatus includes a mechanism for moving a developing roller between a contact position in contact with the photosensitive drum and a separated position separated therefrom in accordance with a rotation of a cam. The image-forming apparatus further includes a stepping motor for rotating the cam, and a main motor for driving an image-forming unit including the developing roller and the photosensitive drum.

SUMMARY

In an image-forming apparatus adopting the contact development system for forming a toner image on a photosensitive drum, alteration in rotation speed ratio of the photosensitive drum to the developing roller is desirable depending on installation environment ambient to the image-forming apparatus and working conditions of the apparatus. Such alteration would be achievable by providing a motor for driving the developing roller and another motor for driving the photosensitive drum.

However, according to the above-described conventional image-forming apparatus in which the developing roller is brought into contact with and separated from the photosensitive drum by the rotation of the cam, an additional motor for rotating the cam is already provided. Therefore, the number of motors may be increased if separate motors would be provided for varying the rotation speed ratio of the photosensitive drum to the developing roller.

In view of the foregoing, it is an object of the present disclosure to provide an image-forming apparatus capable of altering a rotation speed ratio between a photosensitive drum and a developing roller without an increase in number of motors, while realizing contact/separation of the developing roller relative to the photosensitive drum.

In order to attain the above and other objects, according to one aspect, the disclosure provides an image-forming apparatus including: a process motor; a sheet conveying device; a first photosensitive drum; a second photosensitive drum; a developing motor; a first developing roller; a second developing roller; a first cam; a second cam; a switching mechanism; and a controller. The sheet conveying device is configured to convey a sheet in a sheet conveying direction upon receipt of a driving force from the process motor. The first photosensitive drum is rotatable upon receipt of the driving force from the process motor. The second photosensitive drum is rotatable upon receipt of the driving force from the process motor and is positioned downstream of the first photosensitive drum in the sheet conveying direction. The first developing roller is rotatable upon receipt of a driving force from the developing motor. The first developing roller is movable between a contact position in contact with the first photosensitive drum and a separated position away from the first photosensitive drum. The second developing roller is rotatable upon receipt of the driving force from the developing motor. The second developing roller is movable between a contact position in contact with the second photosensitive drum and a separated position away from the second photosensitive drum. The first cam is rotatable in a prescribed rotational direction upon receipt of the driving force from the developing motor. Rotations of the first cam cause the first developing roller to move between the contact position and the separated position relative to the first photosensitive drum. The second cam is rotatable in the prescribed rotational direction upon receipt of the driving force from the developing motor. Rotations of the second cam cause the second developing roller to move: from the contact position to the separated position after movement of the first developing roller from the contact position to the separated position; and from the separated position to the contact position after movement of the first developing roller from the separated position to the contact position. The switching mechanism is switchable between a transmission state and a cut-off state to control transmission of the driving force from the developing motor to the first cam and the second cam. The transmission state allows the transmission of the driving force from the developing motor to the first cam and the second cam. The cut-off state interrupts the transmission of the driving force from the developing motor to the first cam and the second cam. The controller is configured to provide control to the developing motor, the process motor and the switching mechanism to execute a normal mode and a low speed mode. The controller is configured to rotate the developing motor at a first rotation speed and rotate the process motor at a second rotation speed in the normal mode. The controller is configured to rotate the developing motor at a rotation speed slower than the first rotation speed and rotate the process motor at the second rotation speed in the low speed mode. The controller is configured to control the switching mechanism to be at the transmission state, for moving each of the first developing roller and the second developing roller from the separated position to the contact position, such that a timing at which the second developing roller comes in contact with the second photosensitive drum in the low speed mode is coincident with or earlier than a timing at which the second developing roller comes in contact with the second photosensitive drum in the normal mode.

According to another aspect, the disclosure provides an image-forming apparatus including: a process motor; a sheet conveying device; a first photosensitive drum; a second photosensitive drum; a developing motor; a first developing roller; a second developing roller; a first cam; a second cam; a switching mechanism; and a controller. The sheet conveying device is configured to convey a sheet in a sheet conveying direction. The first photosensitive drum is rotatable upon receipt of a driving force from the process motor. The second photosensitive drum is rotatable upon receipt of the driving force from the process motor and is positioned downstream of the first photosensitive drum in the sheet conveying direction. The first developing roller is rotatable upon receipt of a driving force from the developing motor. The first developing roller is movable between a contact position in contact with the first photosensitive drum and a separated position away from the first photosensitive drum. The second developing roller is rotatable upon receipt of the driving force from the developing motor. The second developing roller is movable between a contact position in contact with the second photosensitive drum and a separated position away from the second photosensitive drum. The first cam is rotatable in a prescribed rotational direction upon receipt of the driving force from the developing motor. Rotations of the first cam cause the first developing roller to move between the contact position and the separated position. The second cam is rotatable in the prescribed rotational direction upon receipt of the driving force from the developing motor. Rotations of the second cam cause the second developing roller to move: from the separated position to the contact position after movement of the first developing roller from the separated position to the contact position; and from the contact position to the separated position after movement of the first developing roller from the contact position to the separated position. The switching mechanism is switchable between a transmission state and a cut-off state to control transmission of the driving force from the developing motor to the first cam and the second cam. The transmission state allows the transmission of the driving force from the developing motor to the first cam and the second cam. The cut-off state prevents the transmission of the driving force from the developing motor to the first cam and the second cam. The controller is configured to control rotations of the developing motor and the process motor to execute a first mode and a second mode. The controller is configured to rotate the developing motor at a first rotation speed and rotate the process motor at a second rotation speed in the first mode. The controller is configured to rotate the developing motor at a third rotation speed different from the first rotation speed and rotate the process motor at the second rotation speed in the second mode.

According to still another aspect, the disclosure provides an image-forming apparatus including: a first photosensitive drum; a first developing roller; a first cam; a second photosensitive drum; a second developing roller; a second cam; a process motor; a developing motor; and a controller. The first developing roller is movable between: a first contact position where the first developing roller is in contact with the first photosensitive drum; and a first separated position where the first developing roller is separated from the first photosensitive drum. The first cam is configured to move the first developing roller between the first contact position and the first separated position. The second developing roller is movable between: a second contact position where the second developing roller is in contact with the second photosensitive drum; and a second separated position where the second developing roller is separated from the second photosensitive drum. The second cam is configured to move the second developing roller between the second contact position and the second separated position. The process motor is configured to drive the first photosensitive drum and the second photosensitive drum. The developing motor is configured to drive the first developing roller, the first cam, the second developing roller, and the second cam. The controller is configured to control the developing motor and the process motor in: a first mode in which the process motor rotates at a first process speed and the developing motor rotates at a first developing speed; and a second mode in which the process motor rotates at a second process speed and the developing motor rotates at a second developing speed slower than the first developing speed, a ratio of the first process speed to the first developing speed in the first mode being different from a ratio of the second process speed to the second developing speed in the second mode.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

An image-forming apparatus 1 according to one embodiment of the disclosure will be described with reference to the accompanying drawings. The image-forming apparatus 1 of the present embodiment is a color printer.

In the following description, directions with respect to the image-forming apparatus 1 will be referred to assuming that the image-forming apparatus 1 is disposed in an orientation in which it is intended to be used. Specifically, a left side, a right side, an upper side, and a lower side in FIG. 1 will be referred to as a front side, a rear side, an upper side, and a lower side of the image-forming apparatus 1, respectively. Further, a near side and a far side in FIG. 1 will be referred to as a right side and a left side of the image-forming apparatus 1, respectively.

<Overall Structure of Image-Forming Apparatus 1>

Figure 1:
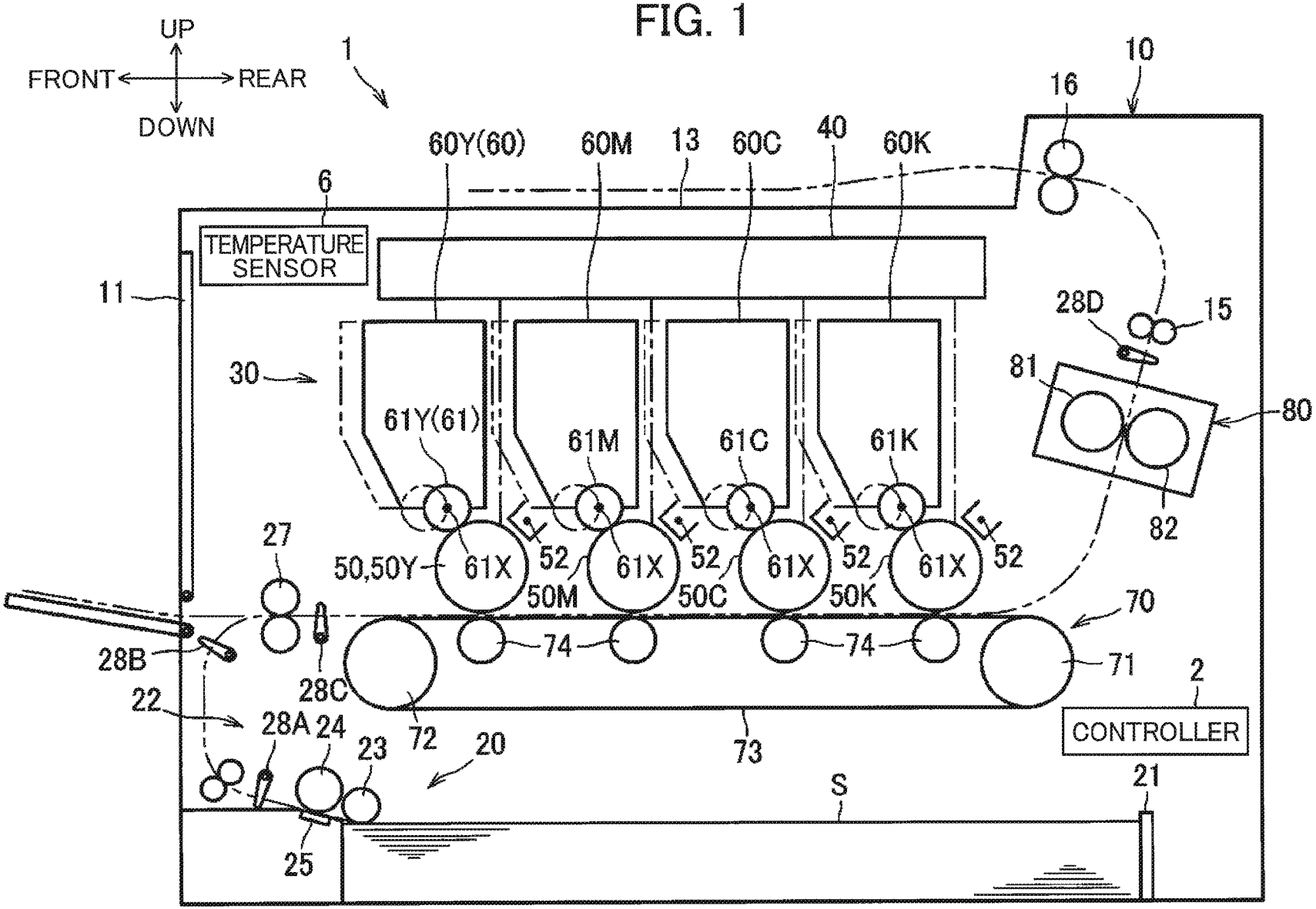
FIG. 1 is a schematic view illustrating an overall configuration of an image-forming apparatus according to an embodiment.

Referring to FIG. 1, the image-forming apparatus 1 includes a housing 10 within which a sheet feed unit 20, an image-forming unit 30, and a controller 2 are mainly provided.

The housing 10 is formed with a front opening, and includes a front cover 11 for opening and closing the front opening. Further, the housing 10 has an upper surface functioning as a discharge tray 13.

The sheet feed unit 20 is positioned at a lower internal portion of the housing 10. The sheet feed unit 20 includes: a sheet tray 21 for accommodating a stack of sheets S; and a sheet feed mechanism 22 configured to supply each sheet S from the sheet tray 21 toward the image-forming unit 30. The sheet feed mechanism 22 includes a sheet feed roller 23, a separation roller 24, a separation pad 25, and a pair of registration rollers 27.

Incidentally, in the present disclosure, the sheet S is an example of an image-forming medium on which an image can be formed by the image-forming apparatus 1. For example, plain paper, an envelope, a post card, thin paper, thick paper, calendered paper, a resin sheet, and a seal are available as the sheet S.

In the sheet feed unit 20, the sheets S accommodated in the sheet tray 21 are configured to be fed by the sheet feed roller 23, and then separated one by one by the separation roller 24 and the separation pad 25. Subsequently, a position of a leading edge of each sheet S is configured to be regulated by the registration rollers 27 whose rotation is halted, and the sheet S is then configured to be supplied to the image-forming unit 30 by the rotation of the registration rollers 27. Hereinafter, a direction in which the sheet S is configured to be conveyed inside the housing 10 (depicted in a phantom line in FIG. 1) will be defined as a sheet conveying direction.

Further, a plurality of sheet sensors is provided upstream of photosensitive drums 50 (described later) in the sheet conveying direction each for detecting passage of the sheet S therethrough. Specifically, these sheet sensors include a sheet feed sensor 28A, a front sensor 28B, and a back sensor 28C.

The sheet feed sensor 28A is positioned downstream of the separation roller 24 in the sheet conveying direction. The sheet feed sensor 28A is configured to detect passage of the sheet S delivered from the sheet tray 21. The front sensor 28B is positioned downstream of the sheet feed sensor 28A and upstream of the registration rollers 27 in the sheet conveying direction. The front sensor 28B is configured to contact the sheet S conveyed from the sheet feed sensor 28A to detect passage of the sheet S. The back sensor 28C is positioned downstream of the registration rollers 27 and upstream of the photosensitive drums 50.

The image-forming unit 30 includes an exposure device 40, a plurality of photosensitive drums 50, a plurality of developing cartridges 60, a conveying device 70, and a fixing device 80.

The exposure device 40 includes a laser diode, a deflector, lenses, and mirrors those not illustrated. The exposure device 40 is configured to emit laser beams to expose surfaces of the respective photosensitive drums 50 to scan the surfaces.

The photosensitive drums 50 include: a Y photosensitive drum 50Y for a first color of yellow; a M photosensitive drum 50M for a second color of magenta; a C photosensitive drum 50C for a third color of cyan; and a K photosensitive drum 50K for a fourth color of black. Throughout the specification and drawings, in a case where colors must be specified, members or components corresponding to the colors of yellow, magenta, cyan and black are designated by adding "Y", "M", "C" and "K", respectively. On the other hand, in a case where distinction of colors is unnecessary, "Y", "M", "C" and "K" will not be added.

The photosensitive drums 50 are arrayed in the sheet conveying direction, i.e., in a rearward direction. Specifically, the Y photosensitive drum 50Y is positioned most upstream in the sheet conveying direction among the array of the photosensitive drums 50. The K photosensitive drum 50K is positioned most downstream in the sheet conveying direction among the array of the photosensitive drums 50. Further, the C photosensitive drum 50C is positioned downstream of the Y photosensitive drum 50Y in the sheet conveying direction, and specifically, positioned between the Y photosensitive drum 50Y and the K photosensitive drum 50K in the sheet conveying direction. Further, the M photosensitive drum 50M is positioned between the Y photosensitive drum 50Y and the C photosensitive drum 50C in the sheet conveying direction. That is, the photosensitive drums 50Y, 50M, 50C and 50K are arranged in this order toward downstream in the sheet conveying direction.

Four of the developing cartridges 60 are provided in one-to-one correspondence with the four photosensitive drums 50. Specifically, the developing cartridges 60 include: a Y developing cartridge 60Y including a Y developing roller 61Y for supplying toner of the first color (yellow) to the Y photosensitive drum 50Y; a M developing cartridge 60M including a M developing roller 61M for supplying toner of the second color (magenta) to the M photosensitive drum 50M; a C developing cartridge 60C including a C developing roller 61C for supplying toner of the third color (cyan) to the C photosensitive drum 50C; and a K developing cartridge 60K including a K developing roller 61K for supplying toner of the fourth color (black) to the K photosensitive drum 50K. The developing rollers 61Y, 61M, 61C and 61K are arranged in this order toward downstream in the sheet conveying direction.

Each developing cartridge 60 is movable between a contact position where the developing roller 61 is in contact with the corresponding photosensitive drum 50 (indicated by a solid line in FIG. 1) and a separated position where the developing roller 61 is separated from the corresponding photosensitive drum 50 (indicated by a dashed line in FIG. 1).

Further, in a state where the M developing roller 61M, the C developing roller 61C and the K developing roller 61K are respectively at their separated positions, each of the M developing cartridge 60M, the C developing cartridge 60C and the K developing cartridge 60K is overlapped with a path of the laser beam for irradiating the photosensitive drum 50 positioned immediately upstream thereof in the sheet conveying direction. Specifically, the M developing cartridge 60M is overlapped with the path of the laser beam directing to the Y photosensitive drum 50Y when the M developing roller 61M is at the separated position. Likewise, the C developing cartridge 60C is overlapped with the path of the laser beam directing to the M photosensitive drum 50M when the C developing roller 61C is at the separated position; and the K developing cartridge 60K is overlapped with the path of the laser beam directing to the C photosensitive drum 50C when the K developing roller 61K is at the separated position.

Figure 2:
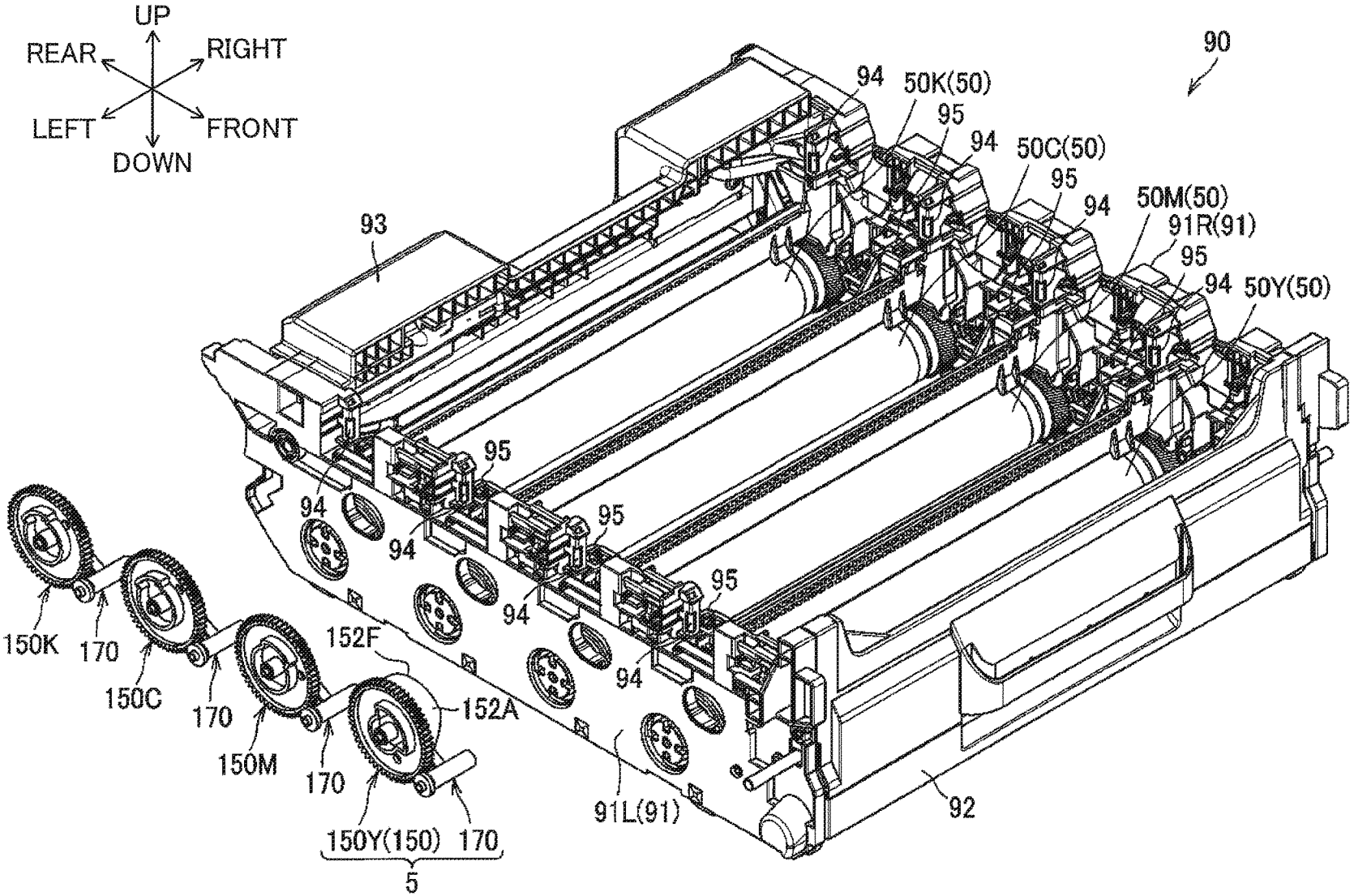
FIG. 2 is a perspective view of a support member, cams, and cam followers in the image-forming apparatus according to the embodiment.

As illustrated in FIG. 2, the photosensitive drums 50 are rotatably supported by a support member 90. Further, the support member 90 detachably supports the four developing cartridges 60. The support member 90 is attachable to and detachable from the housing 10 through the front opening when the front cover 11 is opened. Detailed structures of the support member 90 and the developing cartridges 60 will be described later.

Turning back to FIG. 1, the conveying device 70 is positioned between the sheet tray 21 and the photosensitive drums 50 in an upward/downward direction. The conveying device 70 includes a drive roller 71, a driven roller 72, an endless belt as a conveyer belt 73, and four transfer rollers 74. The conveyer belt 73 is mounted over the drive roller 71 and the driven roller 72 under tension, and has an outer peripheral surface facing each of the photosensitive drums 50. Each transfer roller 74 is positioned within a loop of the conveyer belt 73 to nip the conveyer belt 73 in cooperation with corresponding one of the photosensitive drums 50. The sheet S is configured to be conveyed as the conveyer belt 73 circulates while the sheet S is mounted on an upper portion of the outer peripheral surface of the conveyer belt 73, and at the same time, a toner image formed on each photosensitive drum 50 is transferred onto the sheet S, sequentially.

The fixing device 80 is positioned rearward of the photosensitive drum 50K and the conveying device 70. The fixing device 80 includes a heat roller 81 and a pressure roller 82 positioned in confrontation with the heat roller 81. A sheet discharge sensor 28D is positioned downstream of the fixing device 80 in the sheet conveying direction to detect that the sheet S moves past the sensor 28D. A pair of conveyer rollers 15 is also positioned above the fixing device 80, and a pair of discharge rollers 16 is positioned above the conveyer rollers 15.

In the image-forming unit 30, a peripheral surface of each photosensitive drum 50 is uniformly charged by a corresponding charger 52 provided at the support member 90, and is then exposed to light by the laser beam irradiated from the exposure device 40. Thus, an electrostatic latent image on a basis of image data is formed on the peripheral surface of each photosensitive drum 50.

Further, toner accommodated in each developing cartridge 60 is carried on a peripheral surface of each developing roller 61, and is then supplied from each developing roller 61 to the electrostatic latent image on the peripheral surface of each photosensitive drum 50 when the developing roller 61 comes into contact with the corresponding photosensitive drum 50. Hence, a toner image is formed on the peripheral surface of each photosensitive drum 50.

Subsequently, the toner image formed on each photosensitive drum 50 is transferred onto the sheet S while the sheet S fed onto the conveyer belt 73 moves past positions between each photosensitive drum 50 and the corresponding transfer roller 74. Then, the toner image transferred onto the sheet S is thermally fixed to the sheet S while the sheet S passes between the heat roller 81 and the pressure roller 82. The sheet S discharged from the fixing device 80 is then discharged onto the discharge tray 13 by the conveyer rollers 15 and the discharge rollers 16.

<Support Member 90, Developing Cartridges 60 and Separation Mechanisms 5>

Referring to FIG. 2, the support member 90 includes: a pair of side frames 91 positioned away from each other in an axial direction of each photosensitive drum 50; a front connection frame 92 connecting front end portions of the respective side frames 91; and a rear connection frame 93 connecting rear end portions of the respective side frames 91. The pair of side frames 91 includes a right side frame 91R and a left side frame 91L. The chargers 52 (FIG. 1) are also provided in the support member 90. Each charger 52 is positioned to face corresponding one of the photosensitive drums 50 for charging the same.

The image-forming apparatus 1 further includes four separation mechanisms 5 (FIG. 2) each configured to move the developing roller 61 between the contact position in contact with the corresponding photosensitive drum 50 and the separated position away from the corresponding photosensitive drum 50.

Specifically, each separation mechanism 5 includes: a cam 150 (Y cam 150Y, M cam 150M, C cam 150C, or K cam 150K); and a cam follower 170. The cam 150 is rotatable about a rotation axis parallel to an axis 61X (FIG. 1) of the corresponding developing roller 61.

Figure 6:
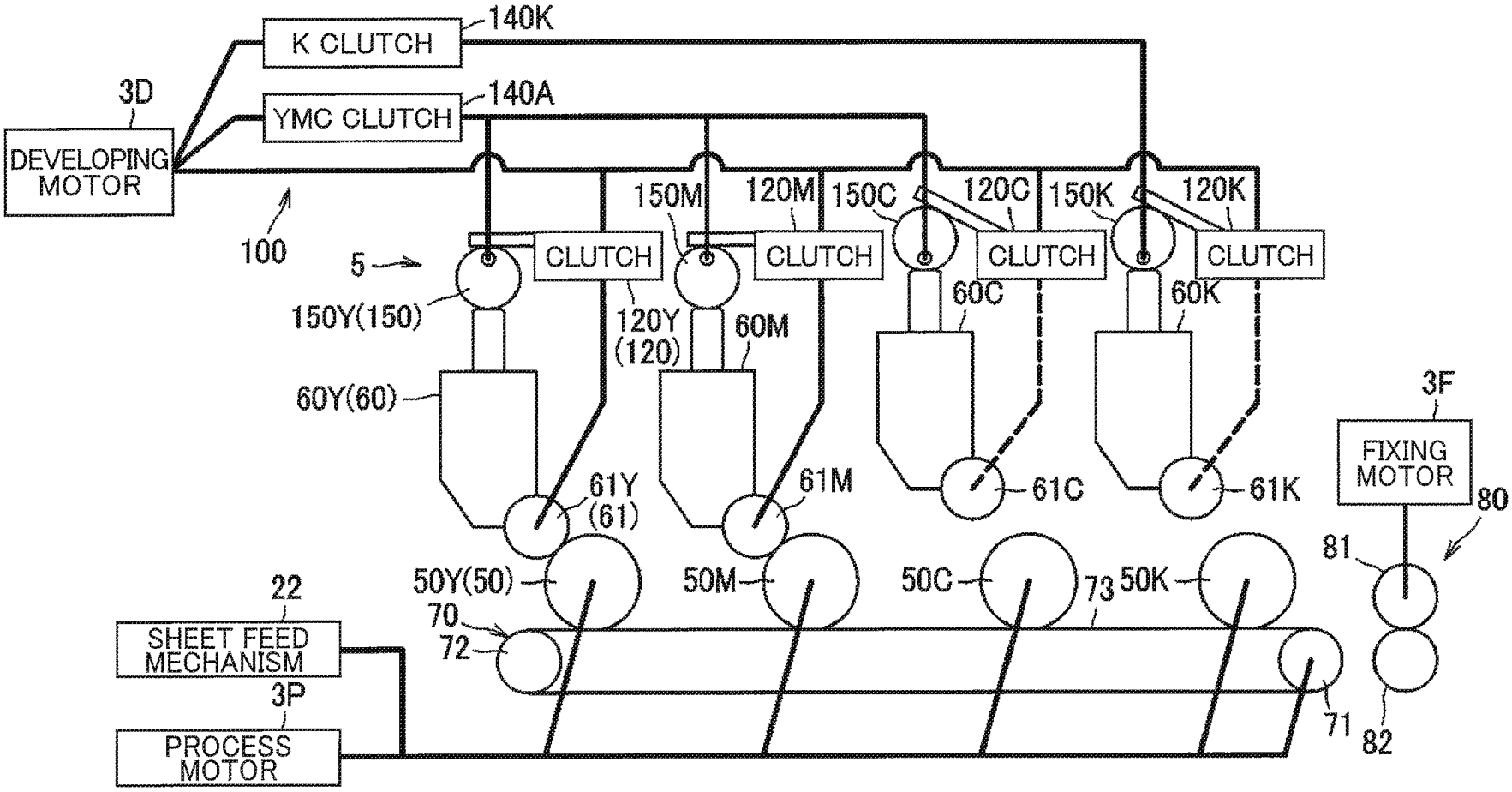
FIG. 6 is a block diagram schematically illustrating a system for transmitting a driving force from each motor in the image-forming apparatus according to the embodiment.

The cam 150 is configured to rotate in a predetermined rotational direction rotatable in a predetermined rotational direction upon receipt of a driving force transmitted from a developing motor 3D (FIG. 6). The cam 150 includes a first cam portion 152A protruding rightward, i.e., inward in a direction of the rotation axis 61X of the developing roller 61 (hereinafter simply referred to as "axial direction"). The first cam portion 152A has an end face (right end face) serving as a cam surface 152F.

The cam follower 170 is movable between: an operating position (illustrated in FIG. 4B) in contact with the cam surface 152F for positioning the developing roller 61 at the separated position; and a standby position (illustrated in FIG. 4A) for positioning the developing roller 61 at the contact position. The cam follower 170 is configured to be slidingly moved in the axial direction (rightward) to the operating position while being in contact with the cam surface 152F to apply a pressing force to the corresponding developing cartridge 60, thereby separating the developing roller 61 from the corresponding photosensitive drum 50. While the cam follower 170 is at the standby position, the developing roller 61 is in contact with the corresponding photosensitive drum 50 and the cam follower 170 is separated from the developing cartridge 60 in the axial direction.

Turning back to FIG. 2, each cam 150 and the cam follower 170 corresponding thereto are provided for each of the developing cartridges 60. Each pair of the cam 150 and the cam follower 170 is positioned leftward of the left side frame 91L, i.e., outward of the left side frame 91L in a leftward/rightward direction. The cam 150 and the cam follower 170 will be described in detail later.

Counterpart abutment portions 94 are provided four each on respective upper portions of the side frames 91R and 91L of the support member 90. The counterpart abutment portions 94 are configured to abut slide members 64 (FIG. 3A) of the corresponding developing cartridges 60, as will be described later. Each counterpart abutment portion 94 is in a form of a roller rotatable about an axis extending in the upward/downward direction.

The support member 90 also includes a plurality of pressure members 95 two each for each of the developing cartridges 60. For each developing cartridge 60, two of the pressure members 95 are positioned one each outward of the corresponding photosensitive drum 50 in the axial direction of the same. Each of the pressure members 95 is urged rearward by a spring 95A (FIGS. 4A and 4B). In accordance with the attachment of the developing cartridge 60 to the support portion 90, each of the pressure members 95 presses the corresponding developing cartridge 60 (specifically, a protrusion 63D of the developing cartridge 60 (FIGS. 3A through 4B) as will be described later) by an urging force of the spring 95A, to permit the corresponding developing roller 61 to be in pressure contact with the corresponding photosensitive drum 50.

Figure 3A:
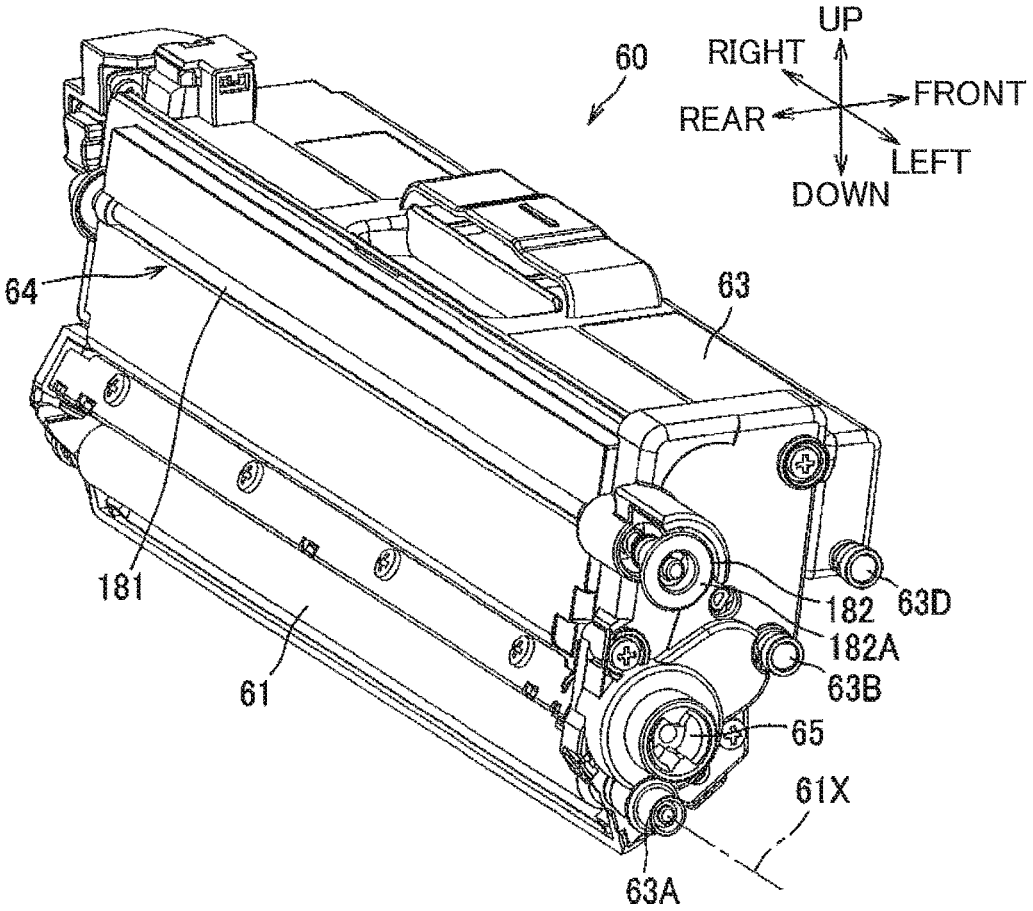
FIG. 3A is a perspective view of a developing cartridge to be accommodated in the image-forming apparatus according to the embodiment.
Figure 3B:
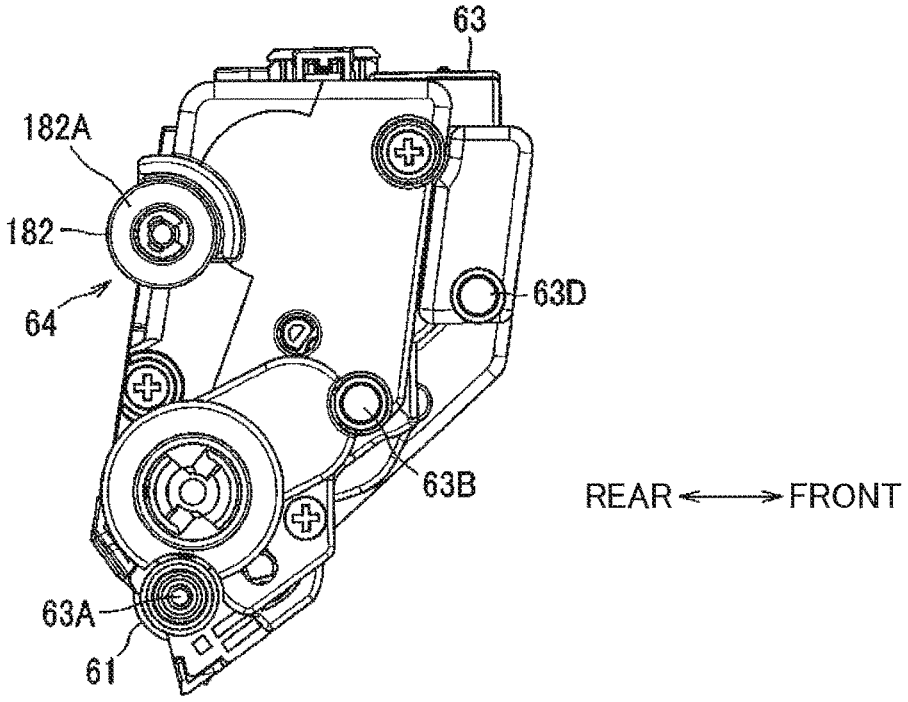
FIG. 3B is a side view of the developing cartridge of FIG. 3A.
Figure 4A:
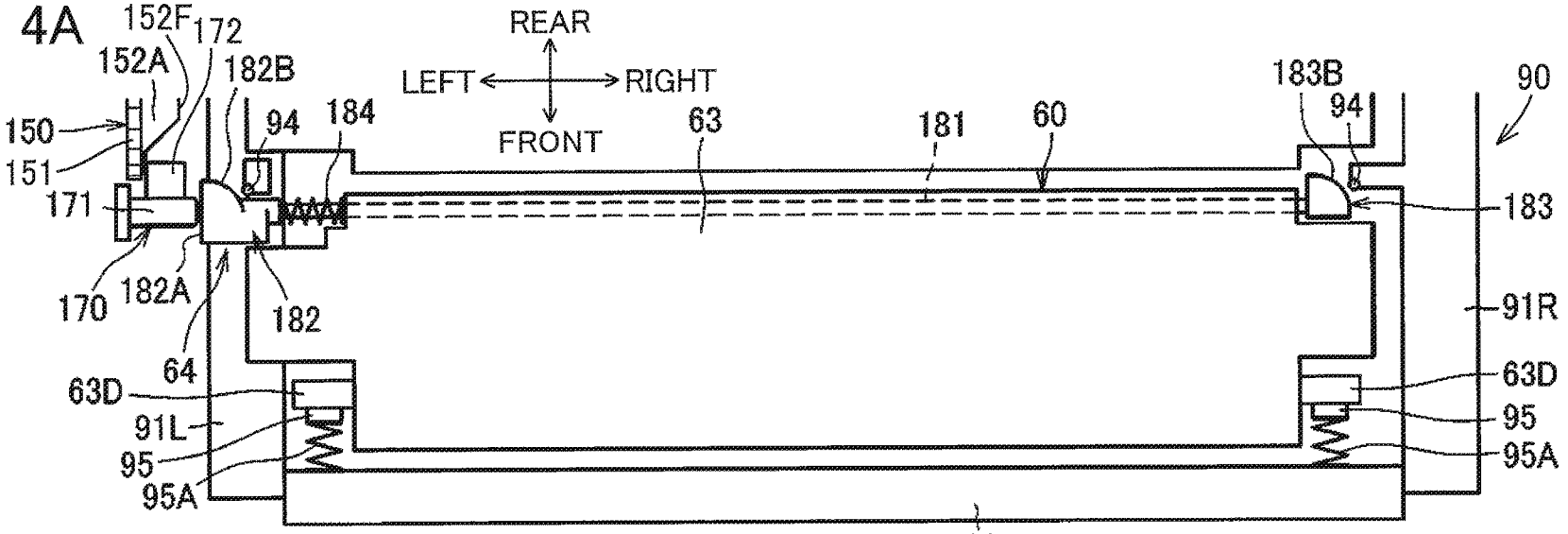
FIG. 4A is a schematic top view illustrating the developing cartridge and components in the vicinity thereof for description of a slide member of the developing cartridge, and particularly illustrating a state where the cam follower is at a standby position in the image-forming apparatus according to the embodiment.
Figure 4B:
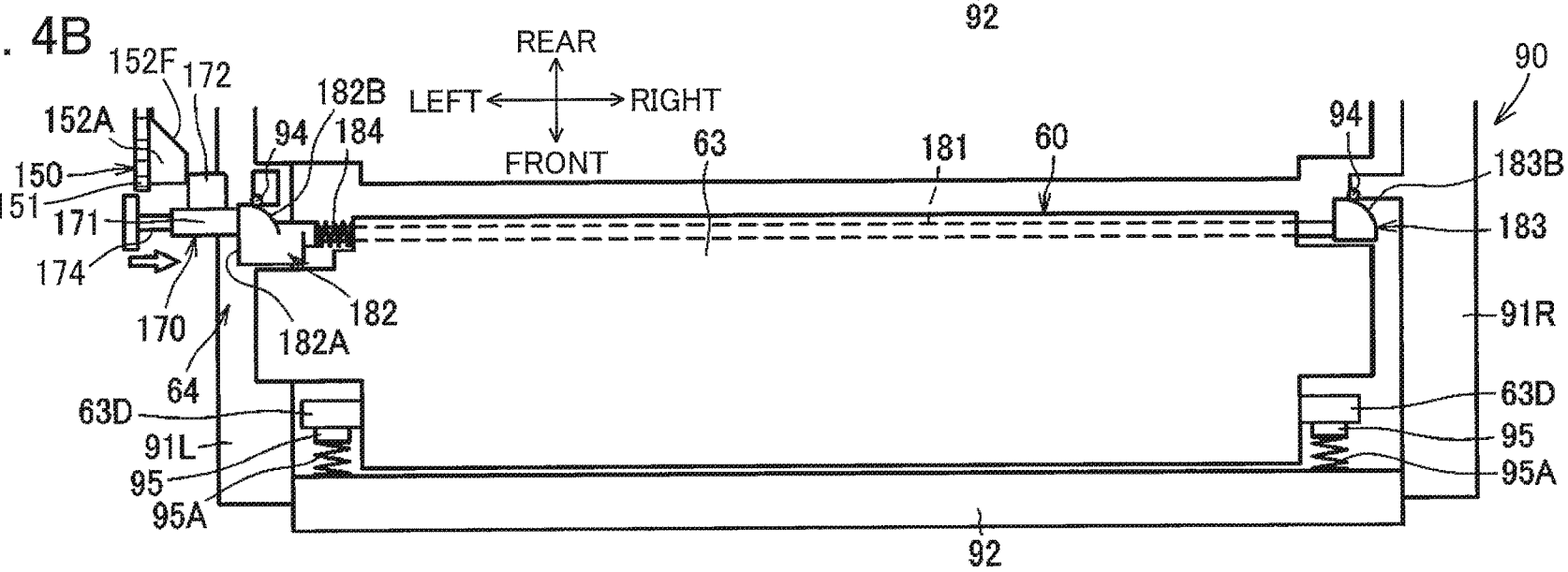
FIG. 4B is a schematic top view illustrating the developing cartridge and the components in the vicinity thereof for description of the slide member, and particularly illustrating a state where the cam follower is at an operating position in the image-forming apparatus according to the embodiment.

As illustrated in FIGS. 3A and 3B, the developing cartridge 60 includes a casing 63, the slide member 64, and a coupling 65.

The casing 63 is configured to store toner of the corresponding color therein. The casing 63 has one side surface in the axial direction (left end surface) provided with a first protruding portion 63A and a second protruding portion 63B.

The first and second protruding portions 63A and 63B protrude outward in the axial direction, or in the direction of the rotation axis 61X from the left end surface of the casing 63. The first protruding portion 63A is coaxial with the rotation axis 61X of the developing roller 61. The second protruding portion 63B is positioned away from the first protruding portion 63A by a predetermined distance. In the present embodiment, the second protruding portion 63B is positioned diagonally above the first protruding portion 63A. That is, the second protruding portion 63B is positioned higher than the first protruding portion 63A.

The first and second protruding portions 63A and 63B are provided as rollers rotatable about their axes extending in parallel to the axial direction of the rotation axis 61. Although not illustrated, the first and second protruding portions 63A and 63B are also provided at another side surface of the casing 63 in the axial direction (right end face) at positions symmetrical with the first and second protruding portions 63A and 63B provided at the one side surface (left end surface).

Further, the above-described protrusion 63D configured to be pressed by the pressure member 95 is also positioned frontward and upward of the first and second protruding portions 63A and 63B. The protrusion 63D protrudes outward in the axial direction from each side surface of the casing 63 in the axial direction.

The coupling 65 is configured to be engaged with a coupling shaft 119 of a power transmission mechanism 100 described later. Rotational driving force is configured to be inputted into the coupling 65 from the coupling shaft 119.

The slide member 64 is slidably movable in the axial direction relative to the casing 63 upon application of the pressing force from the corresponding cam follower 170. As illustrated in FIGS. 4A and 4B, the slide member 64 includes a shaft 181, a first abutment member 182 fixed to one end (left end) of the shaft 181, and a second abutment member 183 fixed to another end (right end) of the shaft 181. The casing 63 is formed with a hole extending in the axial direction. The shaft 181 extends through the hole and is slidably supported by the casing 63.

Referring to FIGS. 3A through 4B, the first abutment member 182 has a pressure receiving surface 182A and a sloped surface 182B. The pressure receiving surface 182A is a left end face of the first abutment member 182, that is, an end face thereof in the axial direction. The sloped surface 182B extends from the pressure receiving surface 182A to be sloped with respect to the axial direction. The pressure receiving surface 182A is configured to be pressed by the corresponding cam follower 170. When the slide member 64 is pressed in the axial direction by the cam follower 170, the sloped surface 182B is configured to abut against the corresponding counterpart abutment portion 94 of the support member 90 to urge the developing cartridge 60 in a direction parallel to the sheet conveying direction, thereby moving the developing cartridge 60 to the position as illustrated in FIG. 4B. The sloped surface 182B is sloped in a curved fashion to extend gradually frontward toward the right. That is, the sloped surface 182B is sloped in a direction from the photosensitive drum 50 toward the corresponding developing roller 61 (frontward) as extending in a direction from the one end (left end) to the other end (right end) of the shaft 181 in the axial direction.

The second abutment member 183 has a sloped surface 183B similar to the sloped surface 182B of the first abutment member 182. The second sloped surface 183B is configured to abut against the counterpart abutment portion 94 of the support member 90 when the slide member 64 is pressed in the axial direction by the corresponding cam follower 170, thereby urging the developing cartridge 60 in the direction parallel to the sheet conveying direction (frontward direction) to move the developing cartridge 60 to the position as illustrated in FIG. 4B.

A spring 184 is interposed between the first abutment member 182 and the casing 63 to urge the slide member 64 leftward, i.e., outward in the axial direction (in a direction from the other end (right end) to the one end (left end) of the shaft 181). The spring 184 is a compression spring disposed over the shaft 181.

Figure 5:
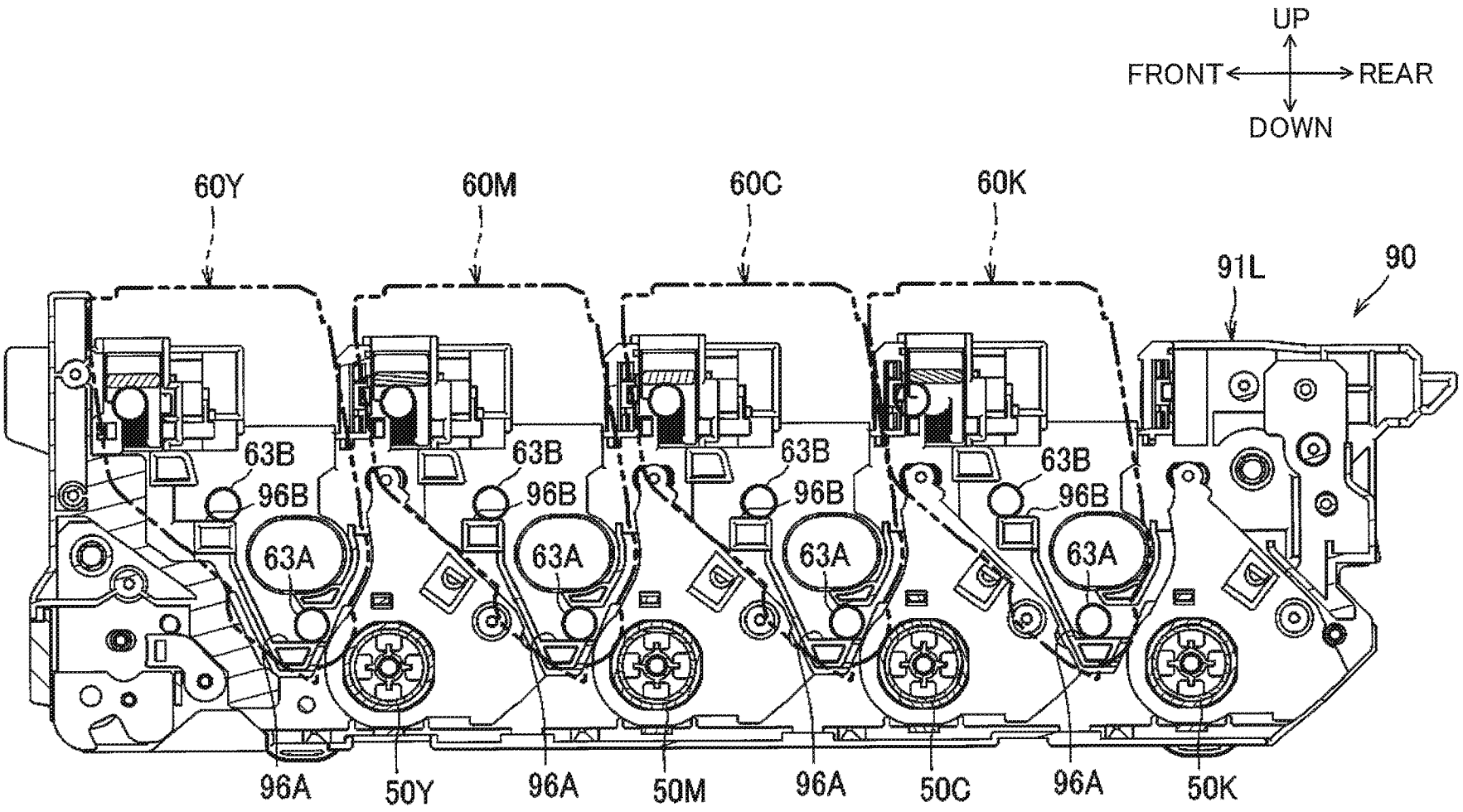
FIG. 5 is a side view of a side frame of the support member, and particularly illustrating an inner surface of the side frame to which the developing cartridge is attachable in the image-forming apparatus according to the embodiment.

As illustrated in FIG. 5, the side frame 91L of the support member 90 has an inner surface provided with four first support surfaces 96A and four second support surfaces 96B one each for each developing cartridge 60. One of the first support surfaces 96A and one of the second support surfaces 96B support the first protruding portion 63A and the second protruding portion 63B of the corresponding developing cartridge 60 from below when the developing roller 61 is moved from the contact position to the separated position. The first support surface 96A and the second support surface 96B respectively extend in the sheet conveying direction (i.e., from the front to the rear).

Each first support surface 96A is positioned to support the corresponding first protruding portion 63A. The first support surface 96A is configured to guide the developing roller 61 and to fix a position thereof in the upward/downward direction when the developing cartridge 60 is attached to the support member 90. Each second support surface 96B is positioned upward of the first support surface 96A to support the second protruding portion 63B when the developing cartridge 60 is attached to the support member 90. Although not illustrated, the first and second support surfaces 96A and 96B are also provided at an inner surface of the right side frame 91R at positions symmetrical with the first and second support surfaces 96A and 96B of the left side frame 91L.

Referring to FIG. 5, when the developing roller 61 is positioned at the contact position in contact with the corresponding photosensitive drum 50, the first protruding portion 63A is positioned at a rear region of the corresponding first support surface 96A (see the first protruding portions 63A of the developing cartridges 60Y, 60M and 60C). When the developing roller 61 is at the separated position away from the corresponding photosensitive drum 50, the first protruding portion 63A is positioned at a front region of the corresponding first support surface 96A (see the first protruding portion 63A of the developing cartridge 60K).

In this way, the developing roller 61 is moved in a direction opposite to the sheet conveying direction (toward upstream in the sheet conveying direction, or frontward) when the separation mechanism 5 moves the developing roller 61 from the contact position to the separated position.

Next, details of the cam 150 and cam follower 170 will be described.

Figure 12A:
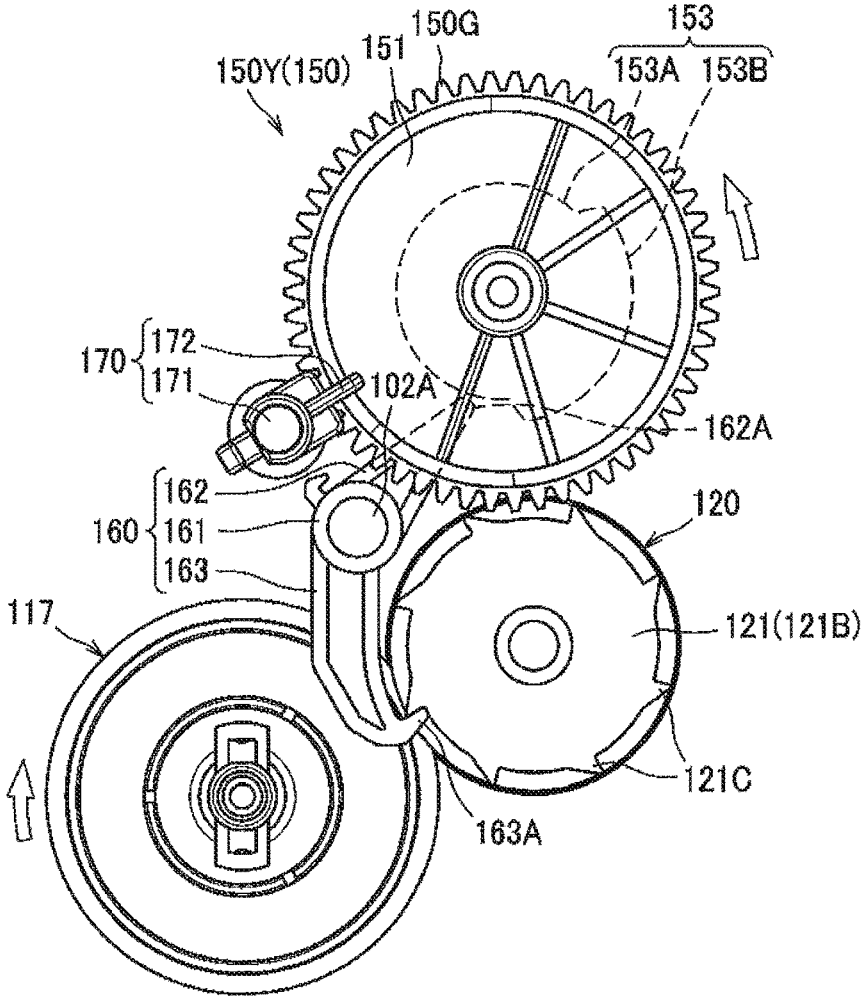
FIG. 12A is a view illustrating a separation mechanism, a lever, the clutch, and a coupling gear in a state where a developing roller is at a contact position and the clutch is at a transmission state as viewed in the axial direction in the image-forming apparatus according to the embodiment.
Figure 12B:
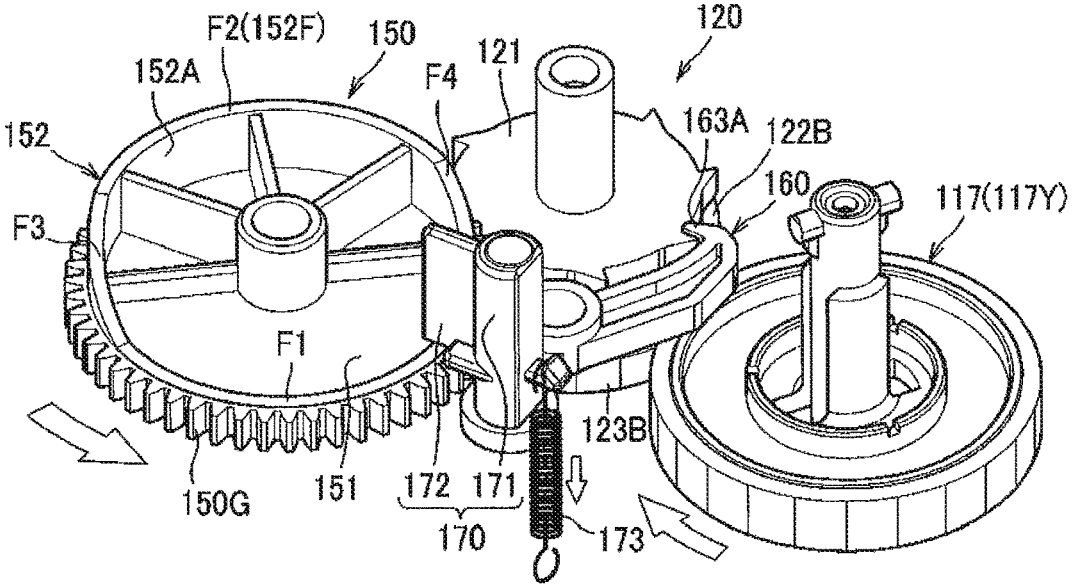
FIG. 12B is a perspective view illustrating the separation mechanism, the lever, the clutch, and the coupling gear in the state where the developing roller is at the contact position and the clutch is at the transmission state.

As illustrated in FIGS. 12A and 12B, each cam 150 includes a disc portion 151, a gear portion 150G, an end face cam 152, and a clutch control cam 153. The cam 150 is configured to rotate to move the corresponding developing roller 61 between the contact position and the separated position.

The disc portion 151 is generally circular plate shaped, and is rotatably supported by a support plate 102 (FIGS. 7-10) fixed to the housing 10 of the image-forming apparatus 1. The gear portion 150G is provided on an outer peripheral surface of the disc portion 151. The end face cam 152 constitutes one of components of the corresponding separation mechanism 5.

The end face cam 152 includes the above-described first cam portion 152A protruding rightward from the disc portion 151. The end face cam 152 has the cam surface 152F which is the protruding end face (right end face) of the first cam portion 152A.

The cam surface 152F includes a first holding surface F1, a second holding surface F2, a first guide surface F3, and a second guide surface F4. In other words, the first holding surface F1, the second holding surface F2, first guide surface F3 and second guide surface F4 altogether constitute the cam surface 152F.

The first holding surface F1 is a flat surface configured to hold the corresponding cam follower 170 at its standby position. The second holding surface F2 is a flat surface configured to hold the corresponding cam follower 170 at its operating position.

The first guide surface F3 connects the first holding surface F1 and the second holding surface F2 together and is inclined with respect to the first holding surface F1. The first guide surface F3 is configured to guide movement of the corresponding cam follower 170 from the first holding surface F1 to the second holding surface F2 in accordance with the rotation of the cam 150. The second guide surface F4 connects the second holding surface F2 and the first holding surface F1 together and is inclined with respect to the first holding surface F1. The second guide surface F4 is configured to guide movement of the corresponding cam follower 170 from the second holding surface F2 to the first holding surface F1 in accordance with the rotation of the cam 150.

The clutch control cam 153 includes a base portion 153A having a generally columnar shape, and a second cam portion 153B protruding radially outwardly from the base portion 153A. The clutch control cam 153 is integral with and coaxial with the disc portion 151, and hence, the second cam portion 153B rotates together with the cam 150. The clutch control cam 153 is configured to provide control to a clutch 120 (see FIG. 6) of the power transmission mechanism 100 to switch a power transmission status of the clutch 120 between a transmission state and a cut-off state, in cooperation with a lever 160 (FIG. 10) of the power transmission mechanism 100. Details of the power transmission mechanism 100 will be described later.

The cam follower 170 includes a slide shaft portion 171, and a contact portion 172. The slide shaft portion 171 is slidable relative to a shaft 174 (FIG. 4B) fixed to the housing 10 so as to be movable in the axial direction. The slide shaft portion 171 is urged by a spring 173 (an urging member) in such a direction that the contact portion 172 is in contact with the cam surface 152F of the cam 150. Hence, the cam follower 170 is urged toward the standby position.

Specifically, the spring 173 is a tension spring having one end portion engaged with the slide shaft portion 171 and another end portion engaged with a spring attaching portion (not illustrated) provided in the housing 10. The contact portion 172 protrudes radially outward from the slide shaft portion 171 and extends in the axial direction. The contact portion 172 has one axial end face (left end face) facing the cam surface 152F and contactable with the cam surface 152F.

Figure 9:
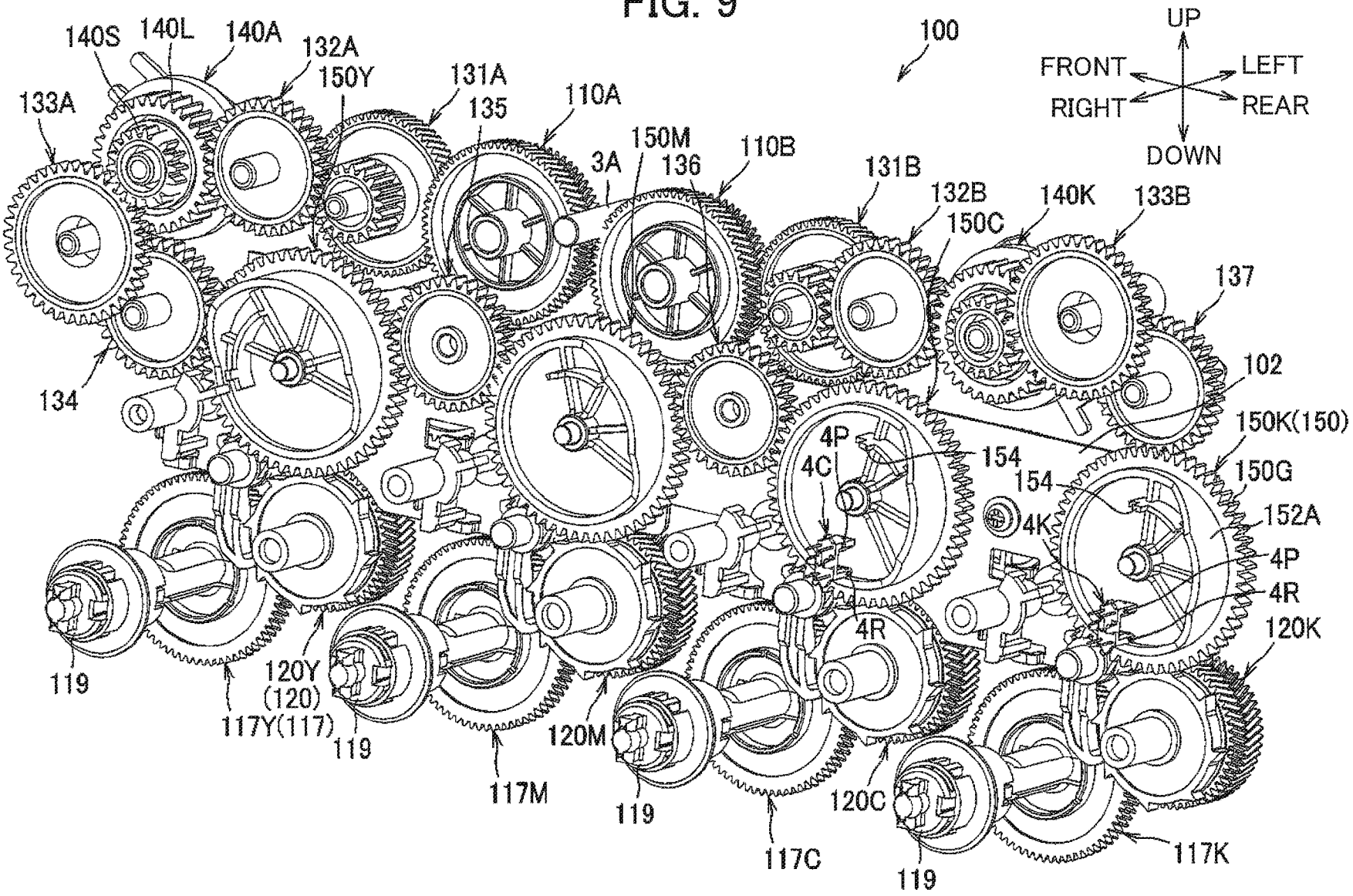
FIG. 9 is a perspective view illustrating the power transmission mechanism as viewed from an upper right side thereof.

As illustrated in FIG. 9, the cams 150Y, 150M, 150C and 150K have generally the same configuration as one another except that a length of the first cam portion 152A of the cam 150Y in a rotational direction thereof is greater than a length of the first cam portion 152A of each of the remaining cams 150M, 150C and 150K in a rotational direction thereof.

Each of the cams 150C and 150K is further provided with a counterpart detection portion 154 protruding from the disc portion 151 in the axial direction at a position radially inward of the corresponding first cam portion 152A.

Further, the housing 10 is provided with separation sensors 4C and 4K corresponding to the colors of black and cyan. The separation sensors 4C and 4K are phase sensors or displacement sensors for detecting phases or rotational positions of the cams 150C and 150K, respectively. The separation sensors 4C and 4K are configured to output separation signals in response to a timing where the cams 150C and 150K are positioned within a predetermined phase range indicative of the developing rollers 61C and 61K being at the separated positions, respectively. The separation sensors 4C and 4K are configured not to output the separation signals in response to a timing where the cams 150C and 150K are positioned outside of the predetermined phase range. In the present embodiment, for simplification, output of the separation signal will be referred to as an ON state, and non-output of the separation signal will be referred to as an OFF state. A voltage level of the ON state may be higher or lower than that of the OFF state.

Each of the separation sensors 4K and 4C includes a light emitting portion 4P configured to emit detection light, and a light receiving portion 4R configured to receive the detection light. In a state where the counterpart detection portion 154 is positioned between the light emitting portion 4P and the light receiving portion 4R to block the detection light so that the light receiving portion 4R cannot receive the detection light, each separation sensor 4C, 4K is configured to output a signal indicative of being at the ON state (ON signal) to the controller 2. On the other hand, in a state where the counterpart detection portion 154 is displaced from a path of the detection light so that the light receiving portion 4R can receive the detection light, each separation sensor 4C, 4K is configured to output a signal indicative of being at the OFF state (OFF signal) to the controller 2.

Incidentally, each of the cam 150Y and 150M has a part having the same shape as the counterpart detection portion 154 of the cam 150C and 150K. However, separation sensors corresponding to these parts is not provided at the housing 10, and therefore, these parts do not function as the counterpart detection portion 154 does.

As illustrated in FIG. 6, the image-forming apparatus 1 further includes the developing motor 3D, a process motor 3P, a fixing motor 3F, and the power transmission mechanism 100 configured to transmit driving force of the developing motor 3D to the developing rollers 61.

The developing rollers 61 (61Y, 61M, 61C, 61K) and the cams 150 (150Y, 150M, 150C, 150K) are configured to be rotated upon receipt of driving force transmitted from the developing motor 3D. The sheet supply mechanism 22 is configured to be driven upon receipt of driving force transmitted from the process motor 3P. The photosensitive drums 50 (50K, 50M, 50C, 50K) are configured to be rotated upon receipt of the driving force transmitted from the process motor 3P.

Regarding the conveying device 70, the conveyer belt 73 is configured to be circularly moved upon transmission of the driving force to the drive roller 71 from the process motor 3P, thereby conveying the sheet S to the positions between each of the photosensitive drums 50 and the conveyer belt 73. The heat roller 81 of the fixing device 80 is configured to be rotated upon transmission of the driving force from the fixing motor 3F.

<Mechanisms for Performing Driving/Stop and Contact/Separation of Developing Rollers 61>

Next, a structure for driving and stopping the developing rollers 61, and a structure for moving the developing rollers 61 to come into contact with and to be separated from the photosensitive drums 50 will be described in detail.

Figure 7:
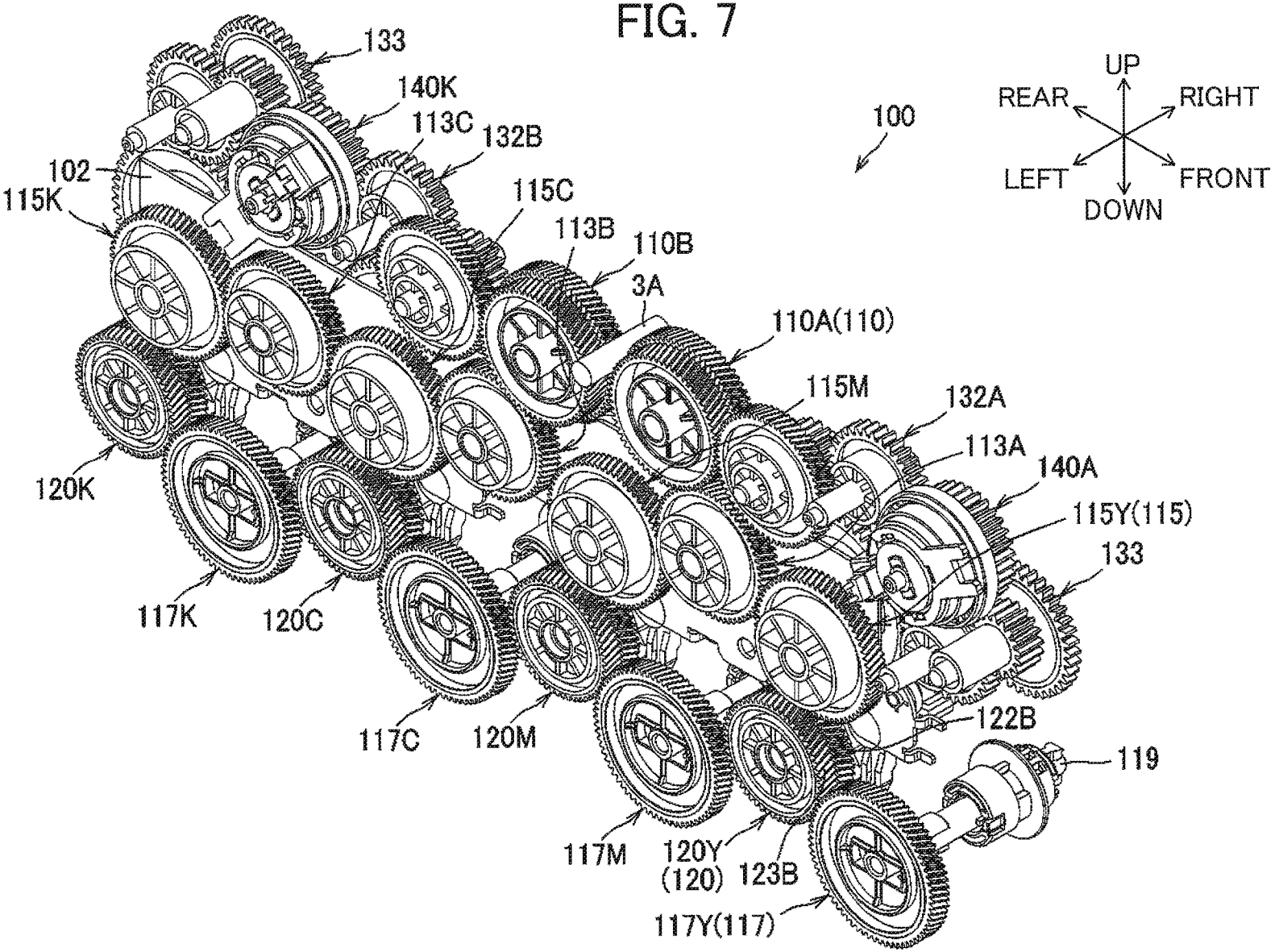
FIG. 7 is a perspective view illustrating a power transmission mechanism as viewed from an upper left side thereof.
Figure 8:
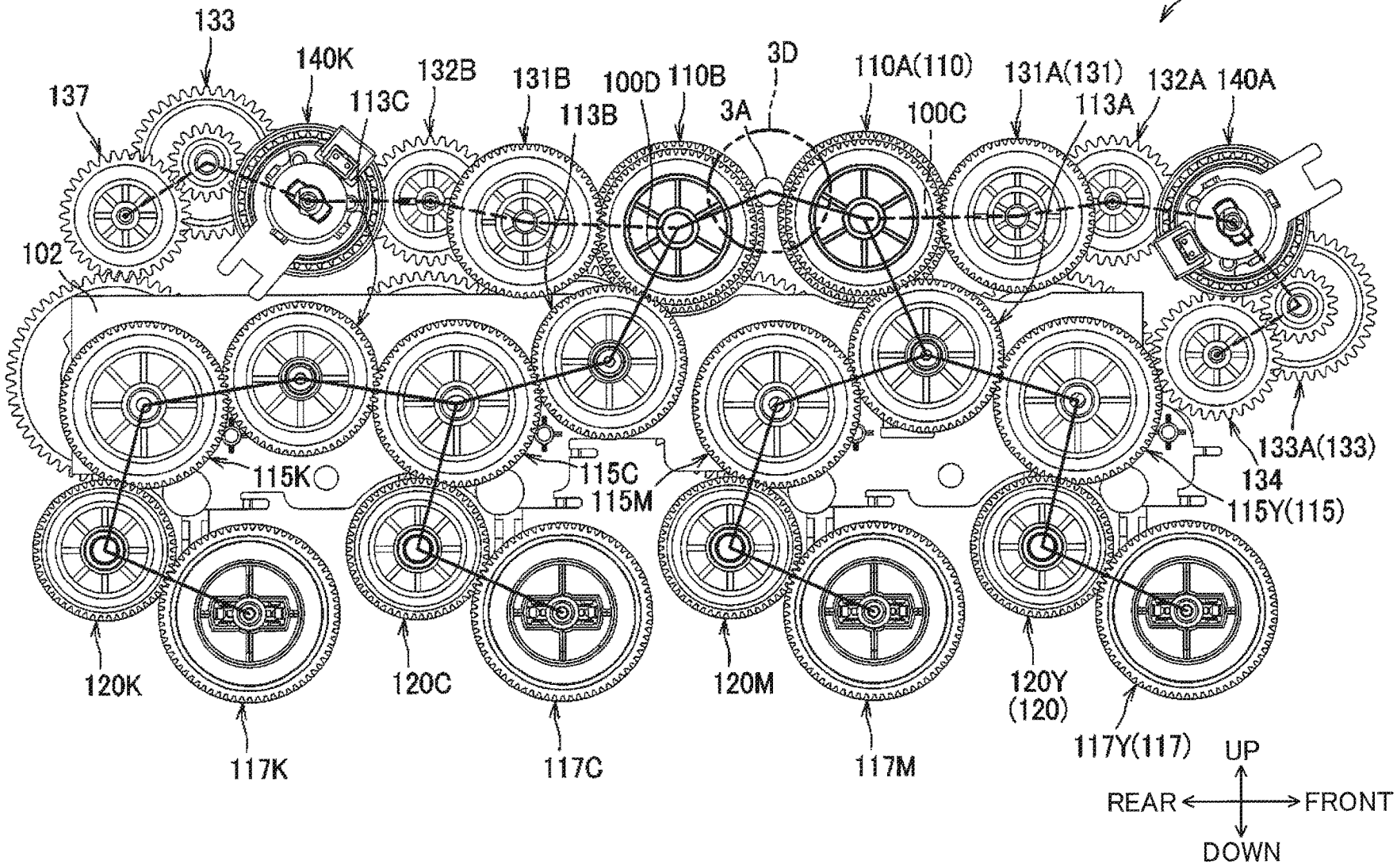
FIG. 8 is a side view of the power transmission mechanism as viewed in an axial direction thereof (from a left side)

As illustrated in FIGS. 7 and 8, the image-forming apparatus 1 further includes the power transmission mechanism 100 mechanically connected to the respective cams 150 each constituting part of each separation mechanism 5. The power transmission mechanism 100 is configured to transmit the driving force of the developing motor 3D to the developing rollers 61 while the developing rollers 61 are respectively at their contact positions, and is configured not to transmit the driving force of the developing motor 3D to the developing rollers 61 while these developing rollers 61 are respectively at their separated positions.

Figure 10:
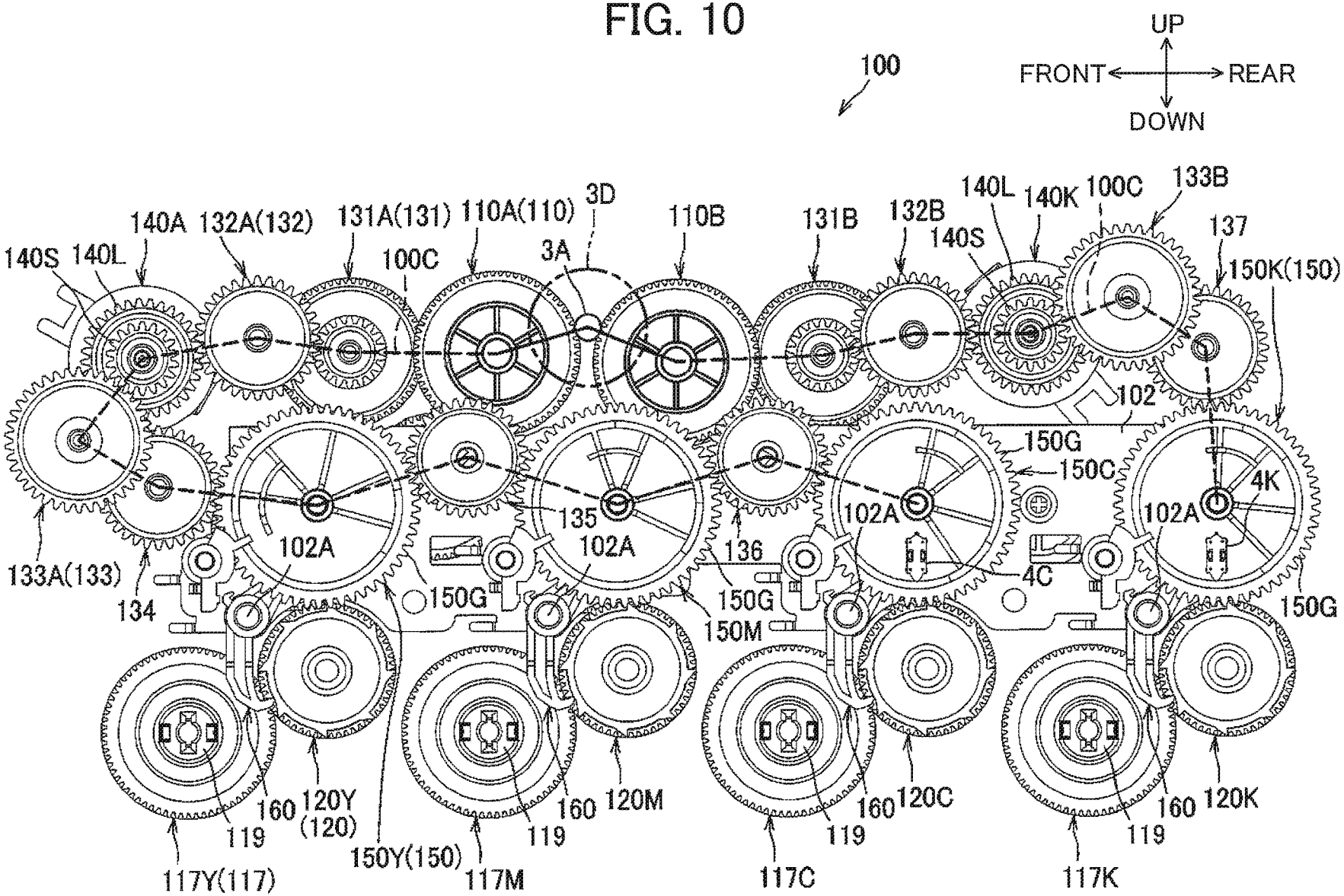
FIG. 10 is a side view of the power transmission mechanism as viewed in the axial direction (from a right side)

As best illustrated in FIG. 8, the power transmission mechanism 100 includes: a power transmission gear train 100D configured to transmit the driving force of the developing motor 3D to the respective developing rollers 61; and a transmission control gear train 100C configured to control transmission of the driving force in the power transmission gear train 100D. The power transmission gear train 100D is mechanically connected to the transmission control gear train 100C. In FIGS. 8 and 10, meshing engagement of the gears in the power transmission gear train 100D is indicated by a bold solid line, and meshing engagement of the gears in the transmission control gear train 100C is indicated by a bold broken line.

The power transmission gear train 100D includes: two first idle gears 110 (110A, 110B); three second idle gears 113A, 113B and 113C; four third idle gears 115 (115Y, 115M, 115C, 115K); four clutches 120 (120Y, 120M, 120C, 120K); and four coupling gears 117 (117Y, 117M, 117C, 117K). Each of these gears constituting the power transmission gear train 100D is supported by the support plate 102 or a frame (not illustrated) of the housing 10 so as to be rotatable about an axis extending in the axial direction.

Each coupling gear 117 includes the coupling shaft 119 rotatable integrally and coaxially therewith (FIG. 7). The coupling shaft 119 is movable in the axial direction of the corresponding photosensitive drum 50 in interlocking relation to the opening/closing movement of the front cover 11. The coupling shaft 119 is configured to be engaged with the coupling 65 (FIG. 3A) of the corresponding developing cartridge 60 in accordance with the closing motion of the front cover 11.

Detailed structures and functions of the clutches 120 will be described later.

In the power transmission gear train 100D, the coupling gear 117Y for the color of yellow is configured to receive the driving force from an output shaft 3A of the developing motor 3D through the first idle gear 110A, the second idle gear 113A, the third idle gear 115Y, and the clutch 120Y.

The coupling gear 117M for the color of magenta is configured to receive the driving force from the output shaft 3A of the developing motor 3D through the first idle gear 110A, the second idle gear 113A, the third idle gear 115M, and the clutch 120M.

The coupling gear 117C for the color of cyan is configured to receive the driving force from the output shaft 3A of the developing motor 3D through the first idle gear 110B, the second idle gear 113B, the third idle gear 115C, and the clutch 120C.

The coupling gear 117K for the color of black is configured to receive the driving force from the output shaft 3A of the developing motor 3D through the first idle gear 110B, the second idle gear 113B, the third idle gear 115C, the second idle gear 113C, the third idle gear 115K, and the clutch 120K.

As illustrated in FIGS. 9 and 10, the transmission control gear train 100C includes: two fourth idle gears 131 (131A, 131B); two fifth idle gears 132 (132A, 132B); a YMC clutch 140A; a K clutch 140K; two sixth idle gears 133 (133A, 133B); a seventh idle gear 134; an eighth idle gear 135; a ninth idle gear 136; a tenth idle gear 137; and the cams 150 (150Y, 150M, 150C, 150K). These gears constituting the transmission control gear train 100C are supported by the support plate 102 or the frame (not illustrated) of the housing 10 so as to be rotatable about their axes extending in the axial direction of the photosensitive drum 50.

The YMC clutch 140A is configured to perform change-over between transmission and cut-off of the driving force to the cams 150Y, 150M and 150C in the transmission control gear train 100C. Specifically, the YMC clutch 140A is configured to switch from the transmission state to the cut-off state and vice versa. In the transmission state, the driving force of the developing motor 3D is transmitted to the Y cam 150Y, the M cam 150M, and the C cam 150C. In the cut-off state, the driving force of the developing motor 3D is not transmitted to the Y cam 150Y, the M cam 150M, and the C cam 150C. That is, the YMC clutch 140A is configured to perform switching of the cams 150Y, 150M and 150C between their rotating state and non-rotating state.

The YMC clutch 140A includes a large diameter gear 140L and a small diameter gear 140S whose number of gear teeth is smaller than a number of gear teeth of the large diameter gear 140L. The large diameter gear 140L of the YMC clutch 140A is in meshing engagement with the fifth idle gear 132A, and the small diameter gear 140S of the YMC clutch 140A is in meshing engagement with the sixth idle gear 133A.

The K clutch 140K is configured to perform change-over, in the drive control gear train 100C, between transmission and cut-off of driving force to the K cam 150K. Specifically, the K clutch 140K is configured to switch from the transmission state to the cut-off state and vice versa. In the transmission state, the driving force of the developing motor 3D is transmitted to the K cam 150K, while, in the cut-off state, the driving force of the developing motor 3D is not transmitted to the K cam 150K. In other words, the K clutch 140K is configured to perform switching of the K cam 150K between its rotating state and non-rotating state.

The K clutch 140K includes a large diameter gear 140L and a small diameter gear 140S whose number of gear teeth is smaller than a number of gear teeth of the large diameter gear 140L. The large diameter gear 140L of the K clutch 140K is in meshing engagement with the fifth idle gear 132B, and the small diameter gear 140S of the K clutch 140K is in meshing engagement with the sixth idle gear 133B.

An electromagnetic clutch is available as the YMC clutch 140A and the K clutch 140K. Upon receipt of power supply (turning ON), the large diameter gear 140L and the small diameter gear 140S integrally rotate together, and upon halting of the power supply (turning OFF), the large diameter gear 140L idly rotates to prevent rotation of the small diameter gear 140S. Incidentally, in the following description, power transmission state and cut-off state in the K clutch 140K and the YMC clutch 140A will be occasionally referred to "ON" and "OFF", respectively.

In the transmission control gear train 100C, the Y cam 150Y for the color of yellow receives the driving force of the developing motor 3D through the first idle gear 110A, the fourth idle gear 131A, the fifth idle gear 132A, the YMC clutch 140A, the sixth idle gear 133A, and the seventh idle gear 134. Further, the M cam 150M for the color of magenta receives the driving force from the Y cam 150Y through the eighth idle gear 135. Further, the C cam 150C for the color of cyan receives the driving force from the M cam 150M through the ninth idle gear 136. Upon power supply to the YMC clutch 140A, the cams 150Y, 150M and 150C rotate concurrently, and the cams 150Y, 150M and 150C stop rotating concurrently upon halting of the power supply to the YMC clutch 140A.

On the other hand, the K cam 150K for the color of black receives the driving force of the developing motor 3D through the first idle gear 110B, the fourth idle gear 131B, the fifth idle gear 132B, the K clutch 140K, the sixth idle gear 133B, and the tenth idle gear 137. Upon power supply to the K clutch 140K, the cam 150K rotates, while the cam 150K stops rotating upon halt of the power supply to the K clutch 140K.

Next, the structures and functions of the clutches 120 will be described. Incidentally, all the four clutches 120Y, 120M, 120C and 120K have the same structure as one another.

Figure 11A:
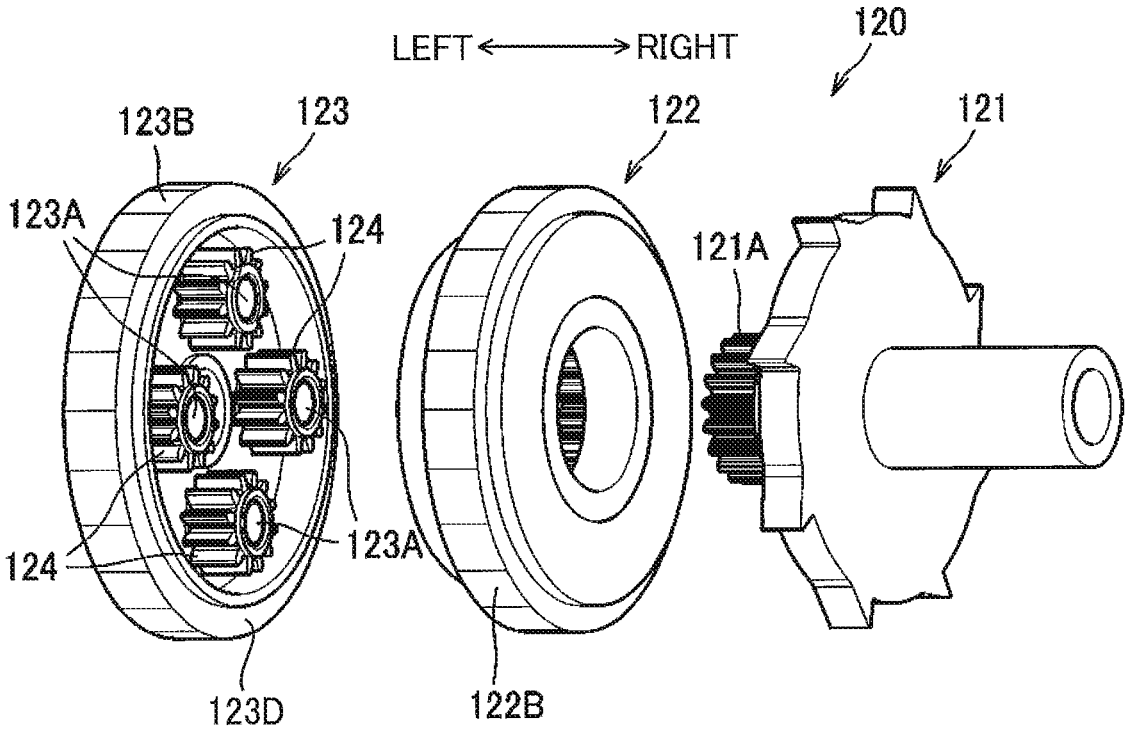
FIG. 11A is an exploded perspective view illustrating a clutch as viewed from a sun gear side thereof in the image-forming apparatus according to the embodiment.
Figure 11B:
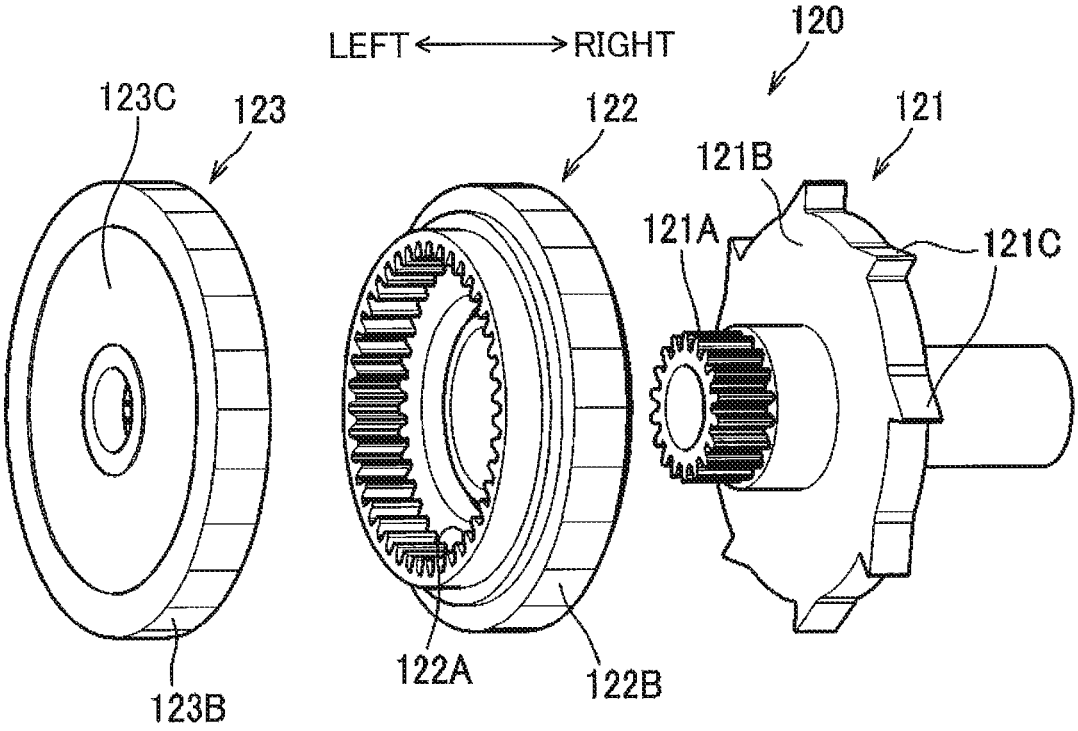
FIG. 11B is an exploded perspective view illustrating the clutch as viewed from a carrier side thereof in the image-forming apparatus according to the embodiment.

As illustrated in FIGS. 11A and 11B, each clutch 120 includes a planetary gear mechanism. The clutch 120 is configured to perform change-over between the transmission state where the driving force of the developing motor 3D is transmitted to the corresponding developing roller 61 and the cut-off state where the driving force of the developing motor 3D is not transmitted to the developing roller 61. Specifically, each clutch 120 includes: a sun gear 121 rotatable about an axis thereof; a ring gear 122; a carrier 123; and a plurality of (four) planetary gears 124 supported by the carrier 123. The ring gear 122 and carrier 123 are rotatable coaxially about the axis of the sun gear 121.

The sun gear 121 includes a gear portion 121A, a disc portion 121B rotatable integrally with the gear portion 121A, and a plurality of pawls 121C provided at an outer peripheral surface of the disc portion 121B. The pawls 121C have acute tip end portions each of which is inclined toward upstream in a rotational direction of the sun gear 121 along the outer peripheral surface. The ring gear 122 has an annular shape having an inner peripheral surface provided with an inner gear 122A and an outer peripheral surface provided with an input gear 122B.

The carrier 123 includes: a circular portion 123C; an annular portion 123D extending from an inner surface of the circular portion 123C; four shaft portions 123A each extending from the inner surface of the circular portion 123C; and an output gear 123B provided at an outer peripheral surface of the annular portion 123D.

Each of the four planetary gears 124 is rotatably supported by one of the four shaft portions 123A. Each planetary gear 124 is in meshing engagement with the gear portion 121A of the sun gear 121, and with the inner gear 122A of the ring gear 122.

As illustrated in FIG. 7, the input gear 122B of each clutch 120 is in meshing engagement with the corresponding third idle gear 115, and the output gear 123B is in meshing engagement with the corresponding coupling gear 117.

In a state where the rotation of the sun gear 121 is stopped, the driving force inputted into the input gear 122B can be transmitted to the output gear 123B (the transmission state). On the other hand, in a state where the sun gear 121 is allowed to rotate, the driving force inputted into the input gear 122B cannot be transmitted to the output gear 123B (the cut-off state). In a state where the clutch 120 is at the cut-off state and the driving force is inputted into the input gear 122 while load is imparted on the output gear 123B, the output gear 123B does not rotate and the sun gear 121 idly rotates.

As illustrated in FIG. 10, the power transmission mechanism 100 further includes a plurality of (four) the levers 160 corresponding to the respective four colors. Four support shafts 102A are fixed to and extends from the support plate 102. Each lever 160 is pivotally movably supported by the corresponding one of the support shafts 102A. Each lever 160 is configured, in cooperation with the corresponding cam 150, to engage the sun gear 121 of the planetary gear mechanism in the corresponding clutch 120 to prevent the rotation of the sun gear 121 to provide the transmission state, and to disengage from the sun gear 121 to provide the cut-off state.

Specifically, as illustrated in FIG. 12A, each lever 160 includes a rotation support portion 161, a first arm 162 extending from the rotation support portion 161, and a second arm 163 extending from the rotation support portion 161 in a direction different from an extending direction of the first arm 162.

The rotation support portion 161 is hollow cylindrical. The corresponding support shaft 102A of the support plate 102 is inserted in a hollow space of the rotation support portion 161. Hence, the rotation support portion 161 is supported by the support shaft 102A.

The second arm 163 has a tip end portion extending toward the outer peripheral surface of the disc portion 121B of the sun gear 121 of the corresponding clutch 120. The lever 160 is urged by a torsion spring (not illustrated) so that the tip end portion of the second arm 163 is urged toward the outer peripheral surface of the disc portion 121B. A hook 163A is provided at the tip end portion of the second arm 163. The hook 163A is configured to engage any one of the pawls 121C of the sun gear 121 to prevent the sun gear 121 from rotating.

The first arm 162 has a tip end portion 162A contactable with the second cam portion 153B of the corresponding cam 150. Specifically, the lever 160 is pivotally movable between an engagement position and a disengagement position. In the engagement position, the tip end portion 162A is positioned in confrontation with the circular base portion 153A, so that the hook 163A is engaged with one of the pawls 121C of the corresponding clutch 120 (see FIGS. 12A-14B). In the disengagement position, the tip end portion 162A of the first arm 162 comes into contact with the second cam portion 153B to be urgingly moved by the same, so that the hook 163A is disengaged from the pawl 121C (see FIGS. 15A-16B). The engagement position of the lever 160 separated from the second cam portion 153B brings the clutch 120 into the transmission state, and the disengagement position of the lever 160 in contact with the second cam portion 153B brings the clutch 120 into the cut-off state.

Operations of the lever 160, the clutch 120, the cam 150 and the cam follower 170 will be described with reference to FIGS. 12A through 16B. The components illustrated in these drawings are for the color of yellow. Components corresponding to the other colors have the same structure as the components illustrated in FIGS. 12A through 16B except for the difference in the phase of each cam 150.

As illustrated in FIGS. 12A and 12B, the tip end portion 162A of the first arm 162 is brought into confrontation with the circular base portion 153A after the tip end portion 162A is separated from the second cam portion 153B. Hence, the hook 163A of the second arm 163 is brought into engagement with one of the pawls 121C of the sun gear 121 of the corresponding clutch 120 to position the lever 160 at its engagement position. Since the rotation of the sun gear 121 is stopped by the lever 160, the clutch 120 is brought to the transmission state where the output gear 123B rotates in accordance with the rotation of the input gear 122B. Hence, the driving force of the developing motor 3D can be transmitted to the developing roller 61, and accordingly, the developing roller 61 is rotatable by the rotation of the developing motor 3D through the power transmission gear train 100D.

Further, the end face (left end face) of the contact portion 172 of the cam follower 170 is positioned on the first holding surface F1 of the cam surface 152F of the cam 150.

Therefore, the slide shaft portion 171 is positioned to be spaced away from the slide member 64 of the developing cartridge 60 in the axial direction (see FIG. 4A). Accordingly, the developing roller 61 is positioned at its contact position.

Figure 13A:
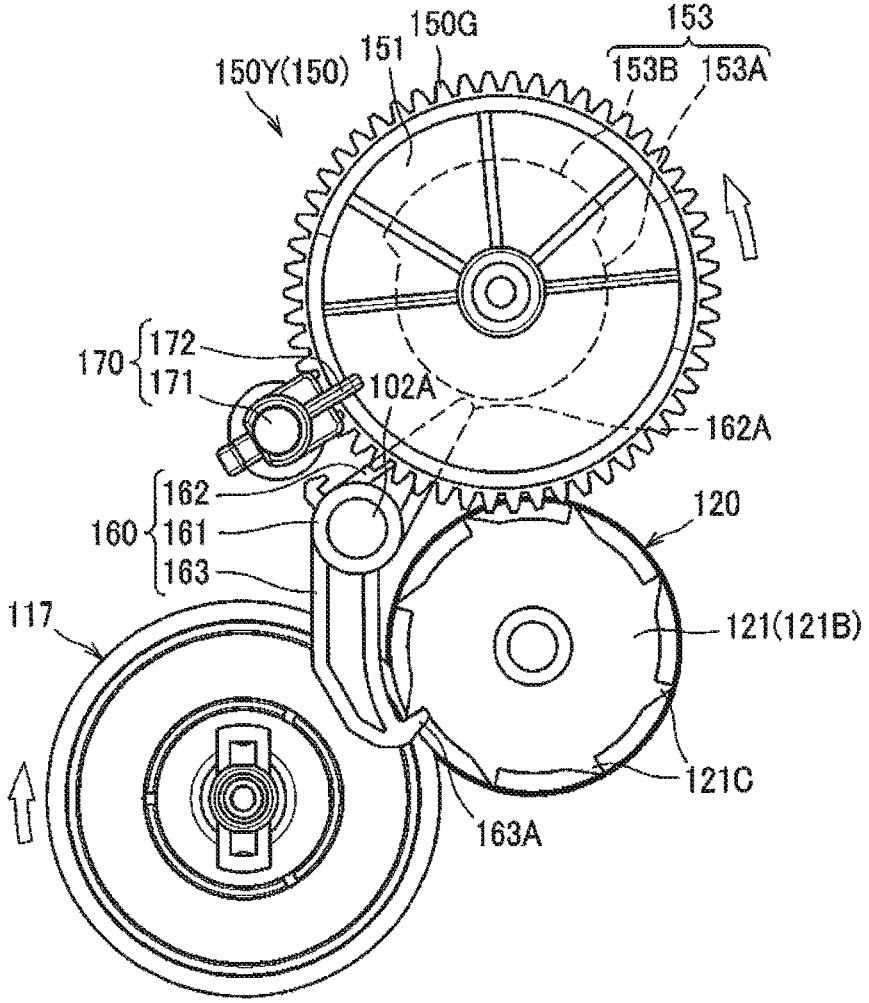
FIG. 13A is a view illustrating the separation mechanism, the lever, the clutch, and the coupling gear in a state where the cam rotates from the state of FIG. 12A and the developing roller corresponding to the color of yellow is at the contact position to perform image formation as viewed in the axial direction.
Figure 13B:
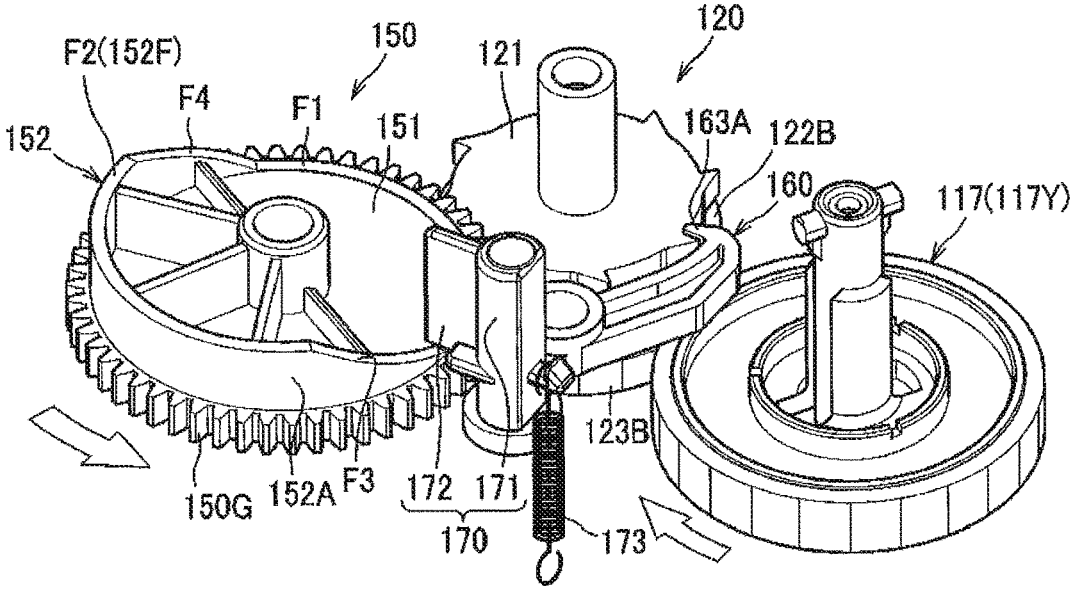
FIG. 13B is a perspective view illustrating the separation mechanism, the lever, the clutch, and the coupling gear in the state where the cam rotates from the state of FIG. 12A and the developing roller corresponding to the color of yellow is at the contact position to perform image formation.

As illustrated in FIGS. 13A and 13B, in accordance with further rotation of the cam 150 from the state illustrated in FIGS. 12A, and 12B, the contact portion 172 of the cam follower 170 slidingly moves over the first holding surface F1 of the cam 150 and approaches the first guide surface F3. Among the four cams 150, in particular, in a case where the rotation of the Y cam 150Y is to be stopped while the developing roller 61 is at the contact position, the rotation of the Y cam 150Y is stopped when the contact portion 172 is at such a position in contact with the first guide surface F3, as illustrated in FIG. 13B.

Figure 14A:
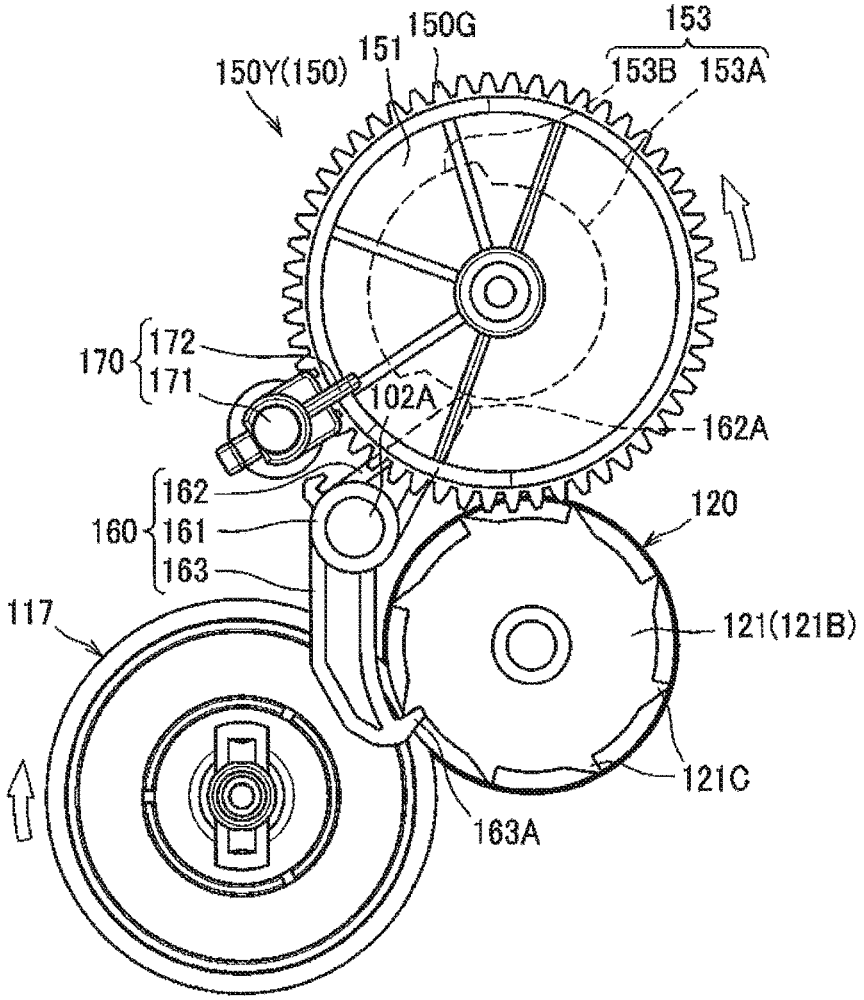
FIG. 14A is a view illustrating the separation mechanism, the lever, the clutch, and the coupling gear in a state where the cam further rotates from the state of FIG. 13A and the developing roller is at a separated position thereof and the clutch is at the transmission state as viewed in the axial direction.
Figure 14B:
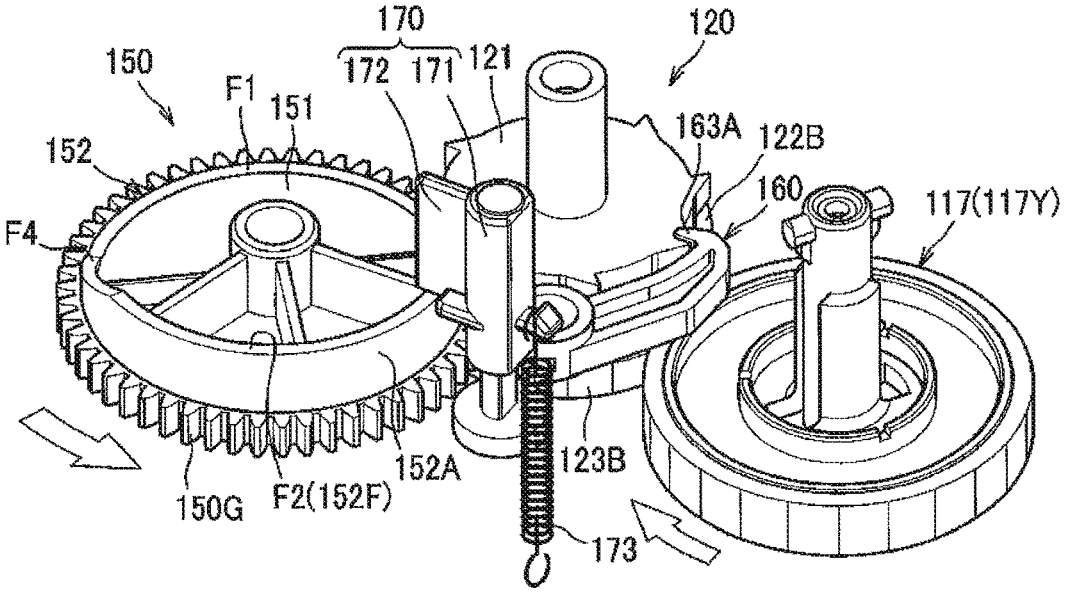
FIG. 14B is a perspective view illustrating the separation mechanism, the lever, the clutch, and the coupling gear in the state where the cam further rotates from the state of FIG. 13A and the developing roller is at the separated position and the clutch is at the transmission state.

In order to separate the developing roller 61 away from the photosensitive drum 50, the Y cam 150Y is further rotated, so that the contact portion 172 of the cam follower 170 slidingly moves over the first guide surface F3 and is brought into contact with the second holding surface F2, as illustrated in FIGS. 14A and 14B. Hence, the slide shaft portion 171 of the cam follower 170 pushes the slide member 64 of the corresponding developing cartridge 60 in the axial direction (rightward), so that the developing cartridge 60 is pushed frontward by the reaction force from the counterpart abutment portions 94 provided on the support member 90 (see FIG. 4B).

The developing roller 61 is thus separated from the photosensitive drum 50 in a state where the contact portion 172 is positioned on a region of the first guide surface F3, the region being closer to the second holding surface F2 than to the first holding surface F1. The separated position of the developing roller 61 is maintained as long as the contact portion 172 is positioned on the second holding surface F2.

Figure 15A:
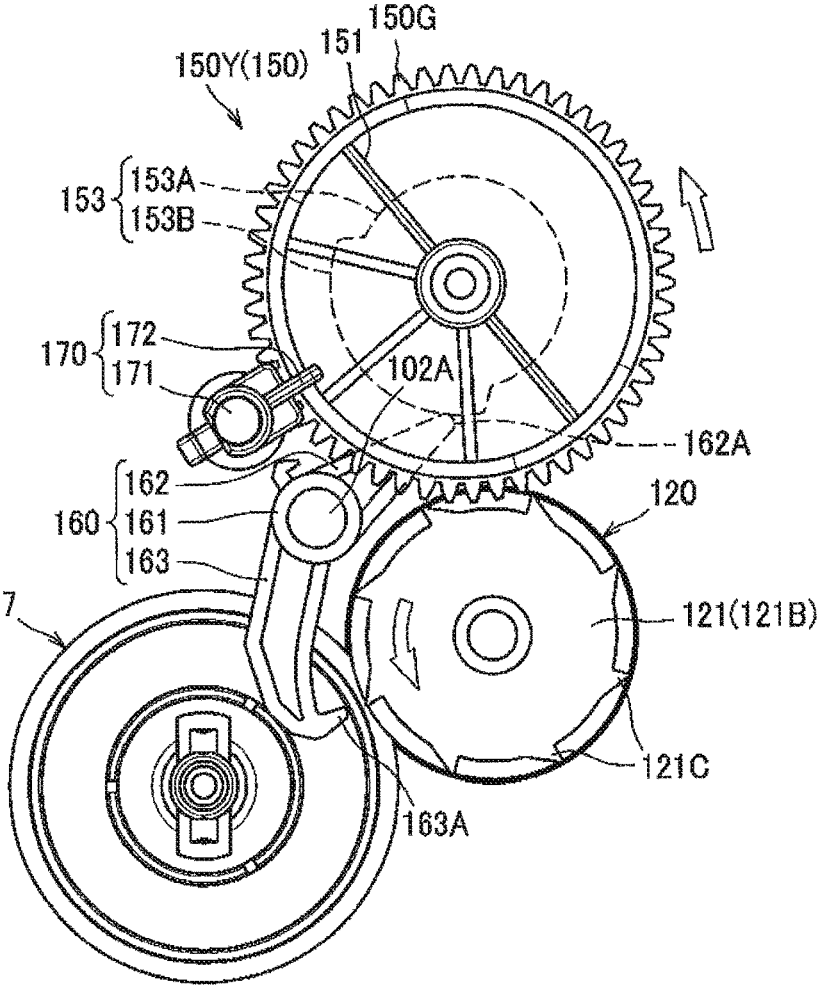
FIG. 15A is a view illustrating the separation mechanism, the lever, the clutch, and the coupling gear in a state where the cam further rotates from the state of FIG. 14A and the developing roller is at the separated position and the clutch is at a cut-off state as viewed in the axial direction.
Figure 15B:
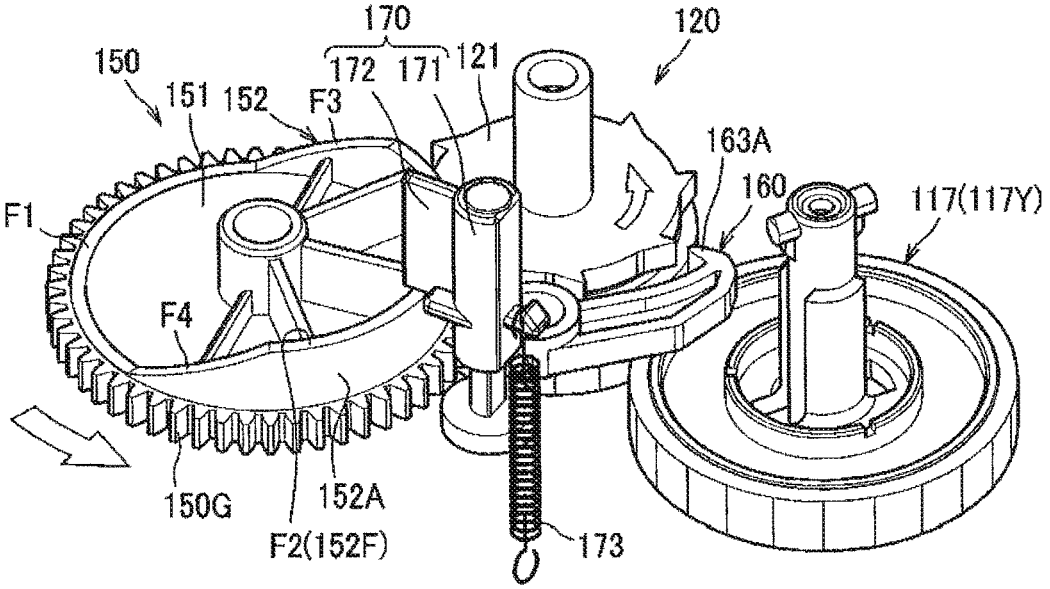
FIG. 15B is a perspective view illustrating the separation mechanism, the lever, the clutch, and the coupling gear in the state where the cam further rotates from the state of FIG. 14A and the developing roller is at the separated position and the clutch is at the cut-off state.

As illustrated in FIGS. 15A and 15B, the cam 150 further rotates after the developing roller 61 is positioned at the separated position, so that the tip end portion 162A of the first arm 162 of the lever 160 is brought into contact with the second cam portion 153B. The lever 160 is pivotally moved by the first arm 162 being pushed by the second cam portion 153B. Hence, the hook 163A is disengaged from the pawl 121C of the sun gear 121, thereby providing the disengagement position of the lever 160.

Since the lever 160 no longer stops rotation of the sun gear 121 of the clutch 120 at this time, the clutch 120 is switched to the cut-off state where the output gear 123B does not perform power transmission during the rotation of the input gear 122B. Accordingly, the driving force of the developing motor 3D cannot be transmitted to the developing roller 61. That is, the rotation of the developing motor 3D does not cause rotation of the developing roller 61, but only causes idle rotation of the sun gear 121.

Figure 16A:
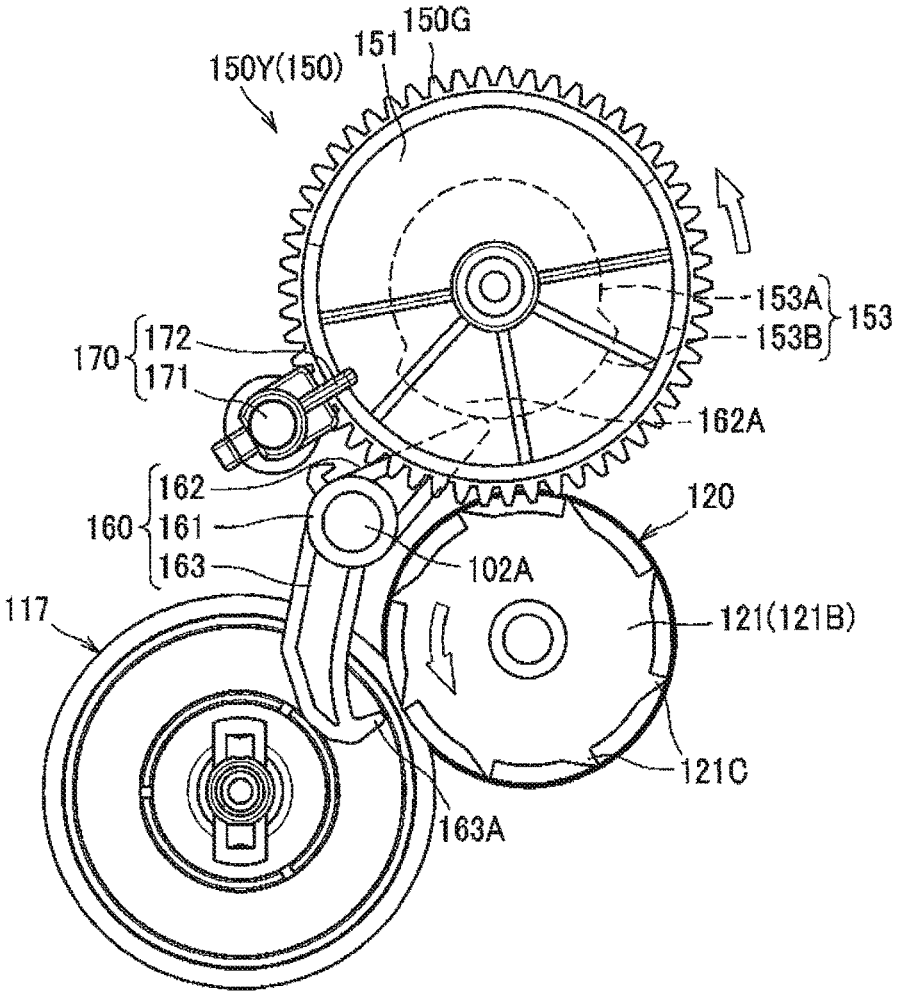
FIG. 16A is a view illustrating the separation mechanism, the lever, the clutch, and the coupling gear in a state where the cam further rotates from the state of FIG. 15A and the developing roller corresponding to the color of yellow temporarily stops rotating immediately before starting to move to the contact position as viewed in the axial direction.
Figure 16B:
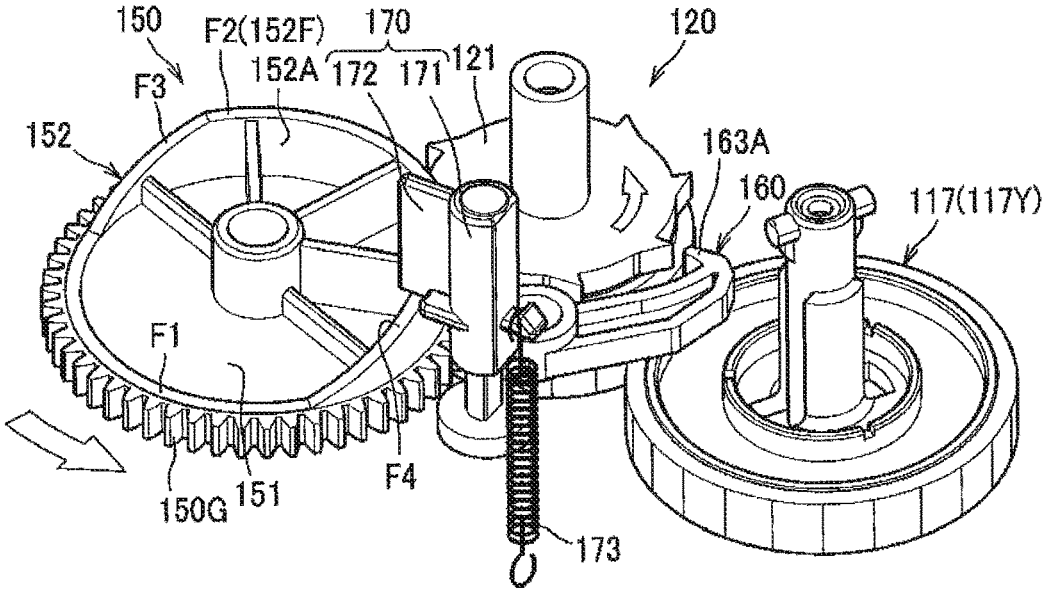
FIG. 16B is a perspective view illustrating the separation mechanism, the lever, the clutch, and the coupling gear in the state where the cam further rotates from the state of FIG. 15A and the developing roller corresponding to the color of yellow temporarily stops rotating immediately before starting to move to the contact position.

In order to maintain the separated position of the developing roller 61, the rotation of the cam 150 is halted while the lever 160 is at the disengagement position illustrated in FIGS. 15A and 15B. For temporarily stopping the rotation of the Y cam 150Y while the developing roller 61Y is at the separated position, the Y cam 150Y is further rotated from the state illustrated in FIGS. 15A and 15B. Then, as illustrated in FIGS. 16A and 16B, the rotation of the Y cam 150Y is stopped when the contact portion 172 reaches an end of the second holding surface F2, the end being immediately upstream of the second guide surface F4. That is, the contact portion 172 is stopped immediately before moving onto the second guide surface F4 (before coming into contact with the second guide surface F4).

In order to move the developing roller 61 from the separated position to the contact position, the cam 150 is further rotated from the state illustrated in FIGS. 15A and 15B or FIGS. 16A and 16B. As a result, the contact portion 172 slidingly moves over the second guide surface F4 and comes to the position in contact with the first holding surface F1 by the urging force of the spring 173, as illustrated in FIGS. 12A and 12B.

Accordingly, the cam follower 170 is moved in the axial direction away from the slide member 64, so that the slide member 64 is moved leftward in FIG. 4A by the urging force of the spring 184. Thus, the developing cartridge 60 is returned to the state depicted in FIG. 4A, i.e., to the contact position indicated by the solid line in FIG. 1 where the developing roller 61 is in contact with the photosensitive drum 50. The developing roller 61 is brought into contact with the photosensitive drum 50 when the contact portion 172 moves past a region of the second guide surface F4, the region being adjacent to the second holding surface F2 (see FIG. 16B). As described above, the clutch 120 becomes transmission state when the lever 160 faces the circular base portion 153A and is brought to the engagement position in engagement with the sun gear 121.

In the image-forming apparatus 1, in a case of performing color printing on the sheet S using the four developing rollers 61Y, 61M, 61C and 61K, these developing rollers 61 are successively moved from the separated position to the contact position in accordance with the movement of the sheet S, and these developing rollers 61 are then moved in sequence to the separated position from the contact position after termination of transfer of the toner image to the sheet S.

To this effect, the cams 150Y, 150M and 150C are assembled so that the phases (angular positions) of the respective first cam portions 152A are displaced from one another by a predetermined angle (see FIG. 9). Specifically, the cams 150M and 150C have the same structure as each other. Further, the length of the first cam portion 152A of the Y cam 150Y in the rotational direction is greater than the length of each of the cams 150M and 150C in the rotational direction thereof.

Further, as illustrated in FIG. 9, the phase or the angular position of an upstream end, in the rotational direction, of the first cam portion 152A is coincident with each other with respect to the Y cam 150Y and the M cam 150M. Further, the phase or the angular position of an upstream end of the first cam portion 152A of the C cam 150C is displaced from the upstream end of the first cam portion 152A of each of the Y cam 150Y and the M cam 150M by a predetermined angle. Still further, the phases or angular positions of downstream ends of the respective first cam portions 152A are displaced from one another by a predetermined angle with respect to the Y cam 150Y, the M can 150M, and the C cam 150C.

The structure of the K cam 150K is identical to the structure of the cams 150M and 150C. The K cam 150K is controlled by the controller 2 such that the K cam 150K is configured to be operated at a timing (retardation in phase) later than a timing at which the C cam 150C is operated by a predetermined angle.

With such a phase differential, the cams 150Y, 150M and 150C are configured to rotate simultaneously upon transmission of the driving force from the developing motor 3D, so that: the Y developing roller 61Y moves from the separated position to the contact position by the Y cam 150Y; the M developing roller 61M moves from the separated position to the contact position by the M cam 150M on or after movement of the Y developing roller 61Y and prior to movement of the C developing roller 61C; and the C developing roller 61C moves from the separated position to the contact position by the C cam 150C after the movements of the Y developing roller 61Y and the M developing roller 61M.

Specifically, in the present embodiment, the M developing roller 61M is configured to be moved from the separated position to the contact position by the M cam 150M substantially concurrently with the movement of the Y developing roller 61Y; and the C developing roller 61C is configured to be moved from the separated position to the contact position by the C cam 150C after the movement of the M developing roller 61M. Further, the K developing roller 61K is configured to be moved from the separated position to the contact position by the K cam 150K after the movement of the C developing roller 61C.

Further, the cams 150Y, 150M and 150C are configured to rotate simultaneously upon transmission of the driving force from the developing motor 3D, so that: the Y developing roller 61Y moves from the contact position to the separated position by the Y cam 150Y; the M developing roller 61M moves from the contact position to the separated position by the M cam 150M on or after movement of the Y developing roller 61Y and prior to movement of the C developing roller 61C; and the C developing roller 61C moves from the contact position to the separated position by the C cam 150C after the movements of the Y developing roller 61Y and the M developing roller 61M.

Specifically, in the present embodiment, the M developing roller 61M is configured to be moved from the contact position to the separated position by the M cam 150M after the movement of the Y developing roller 61Y; and the C developing roller 61C is configured to be moved from the contact position to the separated position by the C cam 150C after the movement of the M developing roller 61M. Further, the K developing roller 61K is configured to be moved from the contact position to the separated position by the K cam 150K after the movement of the C developing roller 61C.

<Operations of the Controller 2>

The controller 2 is configured to control overall operations performed in the image-forming apparatus 1. The controller 2 includes a CPU, a ROM, a RAM, and an input/output portion, and etc., and is configured to perform various processing by executing programs preliminarily stored. In the present embodiment, the controller 2 is configured to control the YMC clutch 140A and the K clutch 140K in response to signals transmitted from the sheet feed sensor 28A, the front sensor 28B, the back sensor 28C, and separation sensors 4K and 4C, thereby controlling contact/separation of the developing rollers 61 relative to the photosensitive drums 50.

The controller 2 permits each of the developing rollers 61M, 61C and 61K to be positioned at the contact position prior to starting exposure to the photosensitive drum 50 positioned immediately upstream of the each of the developing rollers 61M, 61C and 61K in the sheet conveying direction, since as described above, each of the developing cartridges 60M, 60C and 60K is positioned to overlap with the path of light beam to be irradiated on the photosensitive drum 50 positioned immediately upstream of each developing cartridge 60 when each of the developing rollers 61M, 61C and 61K is at the separated position.

That is, the developing rollers 61M and 61C are configured to be moved to the respective contact positions prior to start of the exposure to the upstream side photosensitive drums 50Y and 50M by setting the difference in length of the first cam portions 152A among the cams 150Y, 150M and 150C and by the mechanical setting as to displacement of the phases of the cams 150Y, 150M and 150C.

Specifically, in order to move the M developing roller 61M to the contact position prior to the exposure to the photosensitive drum 50Y, the cams 150Y and 150M are configured such that the M developing roller 61M contacts the M photosensitive drum 50M at a timing concurrent with or prior to the timing of contact of the Y developing roller 61Y with the Y photosensitive drum 60Y.

For performing color printing, the controller 2 controls the K cam 150K to be delayed by the predetermined angle against the C cam 150C in association with the moving timing of the C developing roller 61C. That is, for performing color printing, the controller 2 controls the K developing roller 61K to move to the contact position prior to exposure to the C photosensitive drum 50C.

Figure 17A:
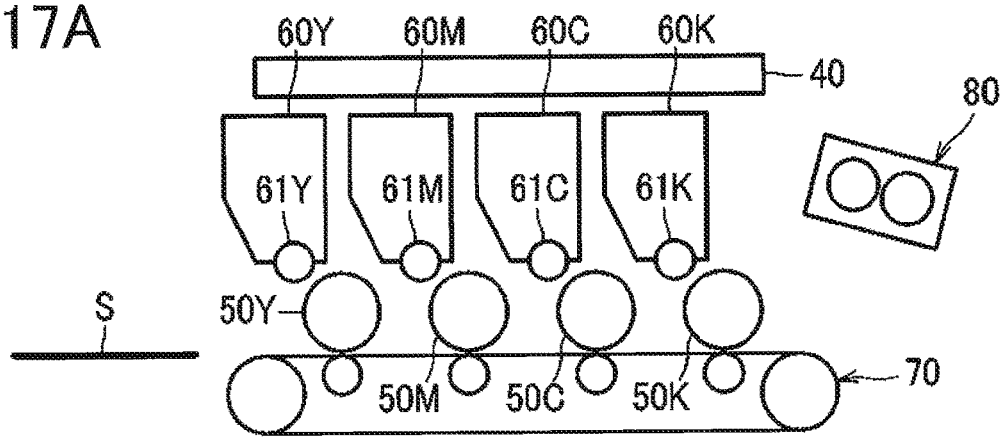
FIGS. 17A through 17D are views for description of contacting/separating operations of the developing rollers in the image-forming apparatus according to the embodiment.
Figure 17B:
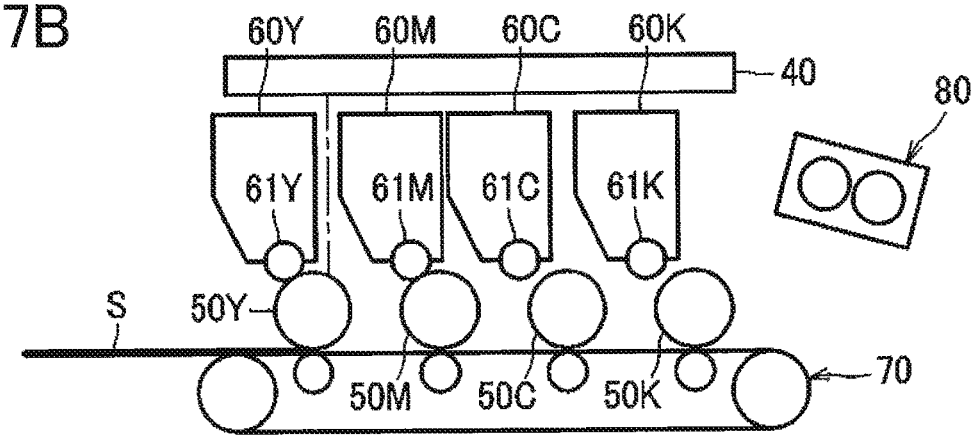

Specifically, as illustrated in FIG. 17A, the controller 2 permits all the developing rollers 61Y, 61M, 61C and 61K to be positioned at the respective separated positions prior to starting a printing operation. Then, as illustrated in FIG. 17B, when the sheet S is about to arrive at the Y photosensitive drum 50Y, the controller 2 controls the Y developing cartridge 60Y and the M developing cartridge 60M to simultaneously move for moving the developing rollers 61Y and 61M to the respective contact positions prior to start exposing the Y photosensitive drum 50Y to the light beam. Specifically, the shapes and phases of the cams 150Y and 150M are designed to realize such movements of the developing rollers 61Y and 61M. Hence, development of the toner image on the Y photosensitive drum 50Y by the Y developing roller 61Y can be performed, and the toner image can be transferred to the sheet S.

Figure 17C:
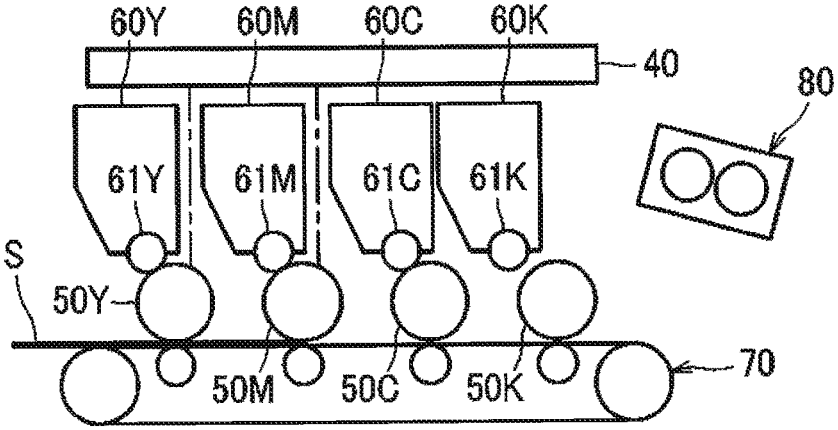

Then, as illustrated in FIG. 17C, when the sheet S is about to arrive at the M photosensitive drum 50M, the C developing cartridge 60C is then moved for moving the C developing roller 61C to the contact position prior to start exposing the M photosensitive drum 50M to the light beam. Specifically, the shape and phase of the C cam 150C is designed to realize such movement of the developing roller 61C. Therefore, development of the toner image on the M photosensitive drum 50M by the M developing roller 61M can be performed, and the toner image can be transferred to the sheet S.

Figure 17D:
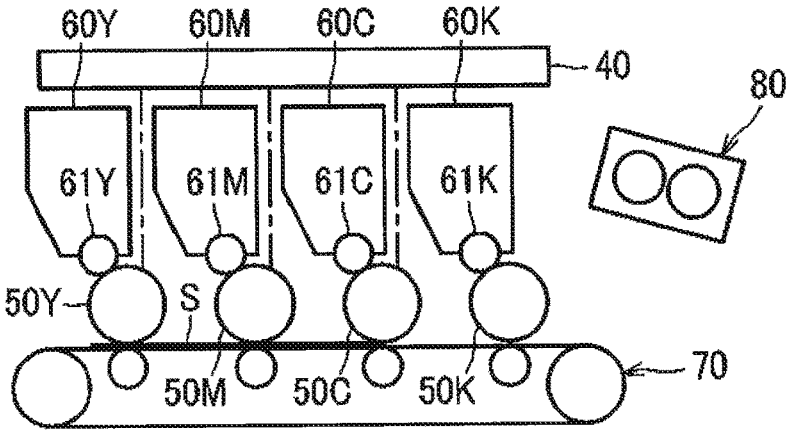

Then, as illustrated in FIG. 17D, when the sheet S is about to arrive at the C photosensitive drum 50C, the K developing cartridge 60K is moved for moving the K developing roller 61K to the contact position prior to start exposing the C photosensitive drum 50C to the light beam. Therefore, development of the toner image on the C photosensitive drum 50C by the C developing roller 61C can be performed, and the toner image can be transferred to the sheet S. Further, the development of the toner image on the K photosensitive drum 50K by the K developing roller 61K can be performed, since the K developing roller 61K is at the contact position.

Figure 18A:
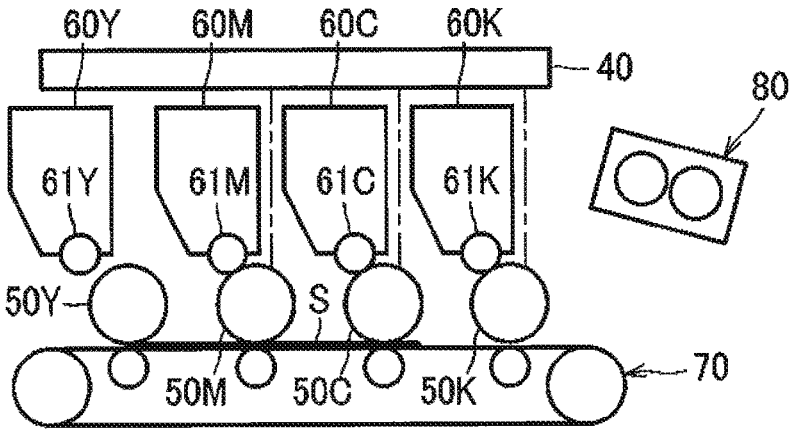
FIGS. 18A through 18D are views for description of the contacting/separating operations of the developing rollers in the image-forming apparatus according to the embodiment after the states of FIGS. 17A through 17D.

Then, as illustrated in FIG. 18A, the controller 2 controls the Y developing cartridge 60Y to move for moving the Y developing roller 61Y to the separated position, after termination of the development on the Y photosensitive drum 50Y by the Y developing roller 61Y and prior to termination of the development on the M photosensitive drum 50M by the M developing roller 61M.

Figure 18B:
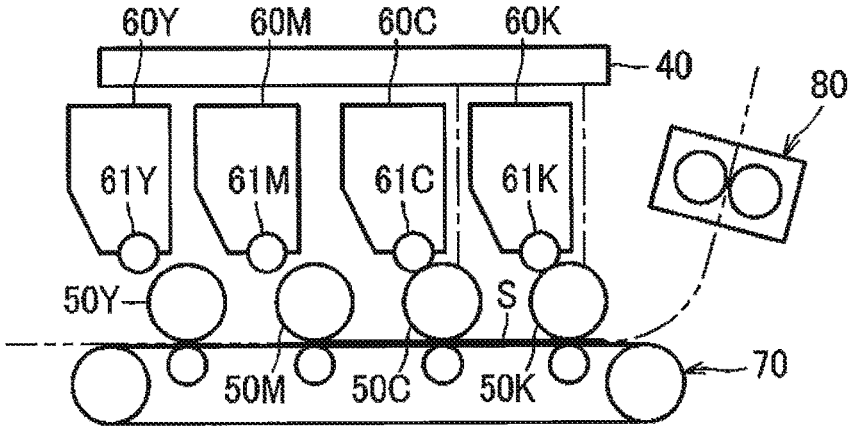

Then, as illustrated in FIG. 18B, the M developing cartridge 60M is moved for moving the M developing roller 61M to the separated position, after termination of the development on the M photosensitive drum 50M by the M developing roller 61M and prior to termination of the development on the C photosensitive drum 50C by the C developing roller 61C.

Figure 18C:
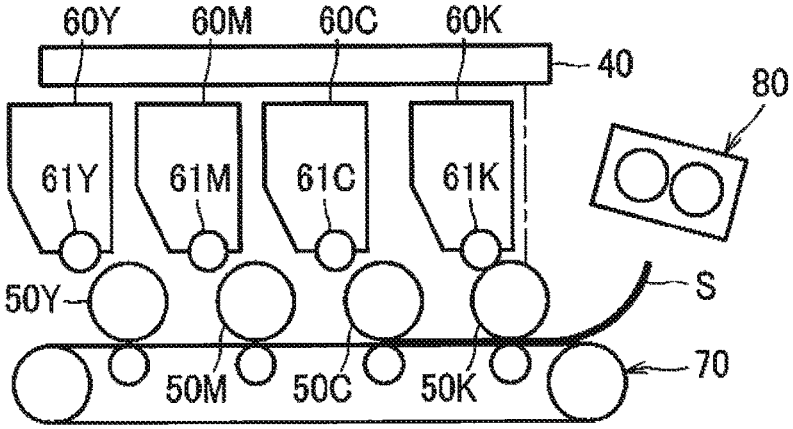

Then, as illustrated in FIG. 18C, the C developing cartridge 60C is moved for moving the C developing roller 61C to the separated position, after termination of the development on the C photosensitive drum 50C by the C developing roller 61C and prior to termination of the development on the K photosensitive drum 50K by the K developing roller 61K.

Figure 18D:
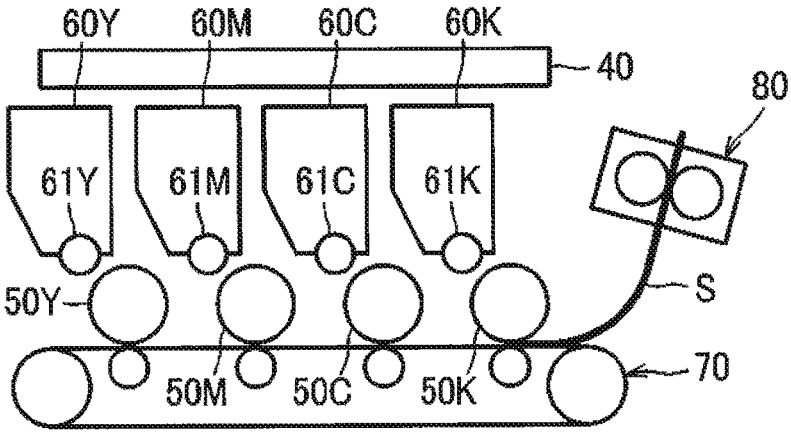

Then, as illustrated in FIG. 18D, the controller 2 controls the K developing cartridge 60K to move for moving the K developing roller 61K to the separated position, after termination of the development on the K photosensitive drum 50K by the K developing roller 61K.

On the other hand, for performing a monochromatic printing employing only the K developing roller 61K, the controller 2 controls the K developing cartridge 60K to move for moving the K developing roller 61K to the contact position prior to start of exposure to the K photosensitive drum 50K, while maintaining the separated positions of the developing roller 61Y, 61M and 61K. Then, the controller 2 controls the K developing cartridge 60K to move for moving the K developing roller 61K to the separated position after termination of the development on the K photosensitive drum 50K by the K developing roller 61K.

Further, the controller 2 controls contacting timing of the Y developing roller 61Y and the K developing roller 61K with the Y photosensitive drum 50Y and the K photosensitive drum 50K, respectively, in timed relation to conveying timing of the sheet S. That is, the controller 2 controls the cams 150Y, 150M, 150C and 150K to rotate upon receipt of a print job.

Further, the controller 2 controls the YMC clutch 140A to stop rotations of the cams 150Y, 150M and 150C at a temporary stop timing upon elapse of a first time period TC1 from a timing at which the ON signal is not transmitted from the separation sensor 4C (the timing at which the OFF signal is transmitted) and at which the Y developing roller 61Y is out of contact with the Y photosensitive drum 50Y.

Then, the controller 2 controls the YMC clutch 140A to rotate the cams 150Y, 150M and 150C to bring the Y developing roller 61Y into contact with the Y photosensitive drum 50Y for performing image development thereon at a restart timing upon elapse of a second time period TC2 from the timing at which the leading edge of the sheet S is detected by the front sensor 28B.

Further, the controller 2 controls the K clutch 140K to stop rotation of the K cam 150K at the temporary stop timing upon elapse of a first time period TK1 from the timing at which the ON signal is no longer acquired from the separation sensor 4K (at which the separation sensor 4K outputs the OFF signal) and at which the K developing roller 61K is out of contact with the K photosensitive drum 50K. Further, the controller 2 controls the K clutch 140K to start rotation of the K cam 150K at the restart timing upon elapse of a second time period TK2 from the timing at which the back sensor 28C detects the leading edge of the sheet S, so that the K developing roller 61K contacts the K photosensitive drum 50K for performing image development thereon.

Still further, in the image-forming apparatus 1, the controller 2 is configured to switch a rotation speed of the developing motor 3D in order to switch a rotation speed of the developing rollers 61. Specifically, the controller 2 is configured to provide a first mode and a second mode. In the first mode, the developing motor 3D rotates at a first rotation speed, the process motor 3P rotates at a second rotation speed, and the fixing motor 3F rotates at a fourth rotation speed. In the present embodiment, the first mode is referred to as a "normal mode".

On the other hand, in the second mode, the developing motor 3D rotates at a third rotation speed different from the first rotation speed, the process motor 3P rotates at the second rotation speed as in the normal mode, and the fixing motor 3F rotates at the fourth rotation speed as in the normal mode. In the present embodiment, the second mode includes a low speed mode and a high speed mode. In the low speed mode, the third rotation speed is lower than the first rotation speed, while in the high speed mode, the third rotation speed is higher than the first rotation speed.

In this way, the controller 2 can provide: the normal mode in which the developing motor 3D rotates at the first rotation speed; the low speed mode in which the developing motor 3D rotates at the rotation speed lower than the first rotation speed; and the high speed mode in which the developing motor 3D rotates at the rotation speed higher than the first rotation speed.

Incidentally, as described above, the controller 2 only changes the rotation speed of the developing motor 3D, and does not change the rotation speeds of the process motor 3P and the fixing motor 3F. That is, the controller 2 does not change the conveying speed of the sheet S in switching of the modes.

In other words, a ratio of the rotation speed of the process motor 3P to the rotation speed of the developing motor 3D in the normal mode (i.e., the ratio of the second rotation speed to the first rotation speed in the first mode) is different from a ratio of the rotation speed of the process motor 3P to the rotation speed of the developing motor 3D in the low speed mode (i.e., the ratio of the second rotation speed to the third rotation speed slower than the first rotation speed in the low speed mode of the second mode). Further, the ratio of the rotation speed of the process motor 3P to the rotation speed of the developing motor 3D in the normal mode is also different from a ratio of the rotation speed of the process motor 3P to the rotation speed of the developing motor 3D in the high speed mode (i.e., the ratio of the second rotation speed to the third rotation speed higher than the first rotation speed in the high speed mode of the second mode).

The image-forming apparatus 1 further includes a temperature sensor 6 (FIG. 1) configured to detect a temperature in the housing 10. In a case where the temperature detected by the temperature sensor 6 is higher than a predetermined temperature, the controller 2 performs the normal mode, and in a case where the temperature in the housing 10 is equal to or lower than the predetermined temperature, the controller 2 performs the low speed mode.

Further, the controller 2 performs the low speed mode in a case of printing, for example, in a toner save mode in which the amount of toner supplied from the developing roller 61 to the corresponding photosensitive drum 50 per a unit of time is to be smaller than that in the normal mode. Further, the controller 2 performs the high speed mode in a case of printing with the amount of toner supplied from the developing roller 61 to the corresponding photosensitive drum 50 per unit of time being greater than that in the normal mode in order to heighten density of the image to be formed on the sheet S.

Incidentally, in the image-forming apparatus 1, the driving force of the developing motor 3D is transmitted not only to each of the developing rollers 61 but also to each of the cams 150 which moves the corresponding developing roller 61 between the contact position and the separated position. Therefore, in the low speed mode, not only the rotation speed of each developing roller 61 but also the rotation speed of each cam 150 are lower than those in the normal mode, which means that the moving speed of each developing roller 61 between the contact position and the separated position is also lower in the low speed mode than in the normal mode. Likewise, in the high speed mode, not only the rotation speed of the developing roller 61 but also the rotation speed of the cam 150 are higher than those in the normal mode, which means that the moving speed of each developing roller 61 between the contact position and the separated position is also higher in the high speed mode than in the normal mode.

In the present embodiment, in order to move the developing rollers 61Y, 61M and 61C from the respective separated positions to the contact positions, the controller 2 controls the YCM clutch 140A to be in the transmission state such that the timing at which the C developing roller 61C contacts the C photosensitive drum 50C in the low speed mode is coincident with or earlier than the timing at which the C developing roller 61C contacts the C photosensitive drum 50C in the normal mode. In the depicted embodiment, the controller 2 controls the YCM clutch 140A to turn ON such that the timing at which the C developing roller 61C contacts the C photosensitive drum 50C in the low speed mode is coincident with the timing at which the C developing roller 61C contacts the C photosensitive drum 50C in the normal mode.

Figure 22:
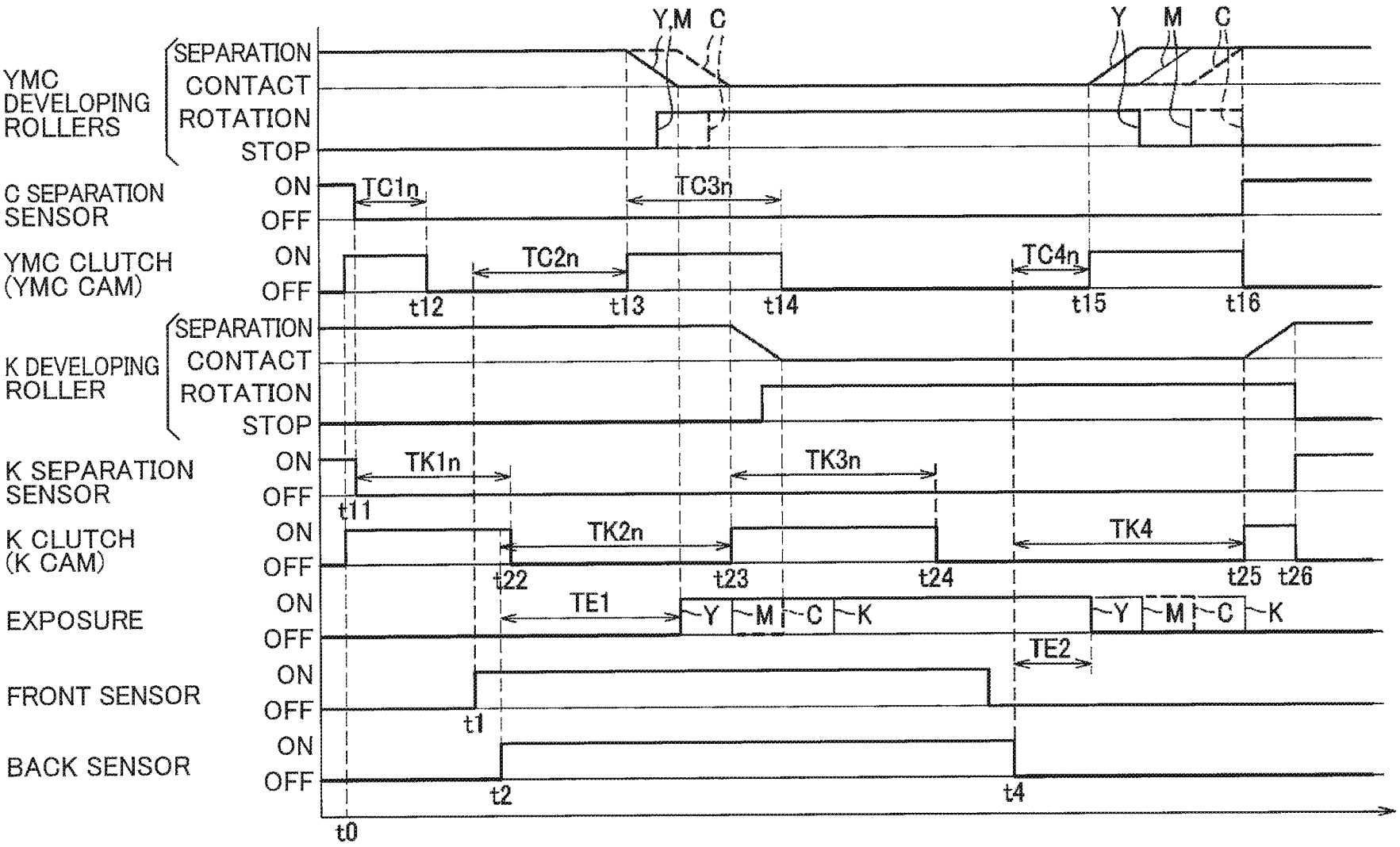
FIG. 22 is a timing chart for description of operations of the developing rollers and control to the YMC clutch and K clutch in response to output from each sensor for performing color printing in a normal mode in the image-forming apparatus according to the embodiment.

Specifically, in the normal mode illustrated in FIG. 22, the controller 2 permits the YMC clutch 140A to turn ON to start rotations of the cams 150Y, 150M and 150C to thus start moving the developing rollers 61Y, 61M and 61C from the respective separated positions toward the contact positions upon elapse of a second time period TC2*n* from a timing t1 at which the front sensor 28B detects the leading edge of the sheet S (i.e., at a timing t13).

Figure 23:
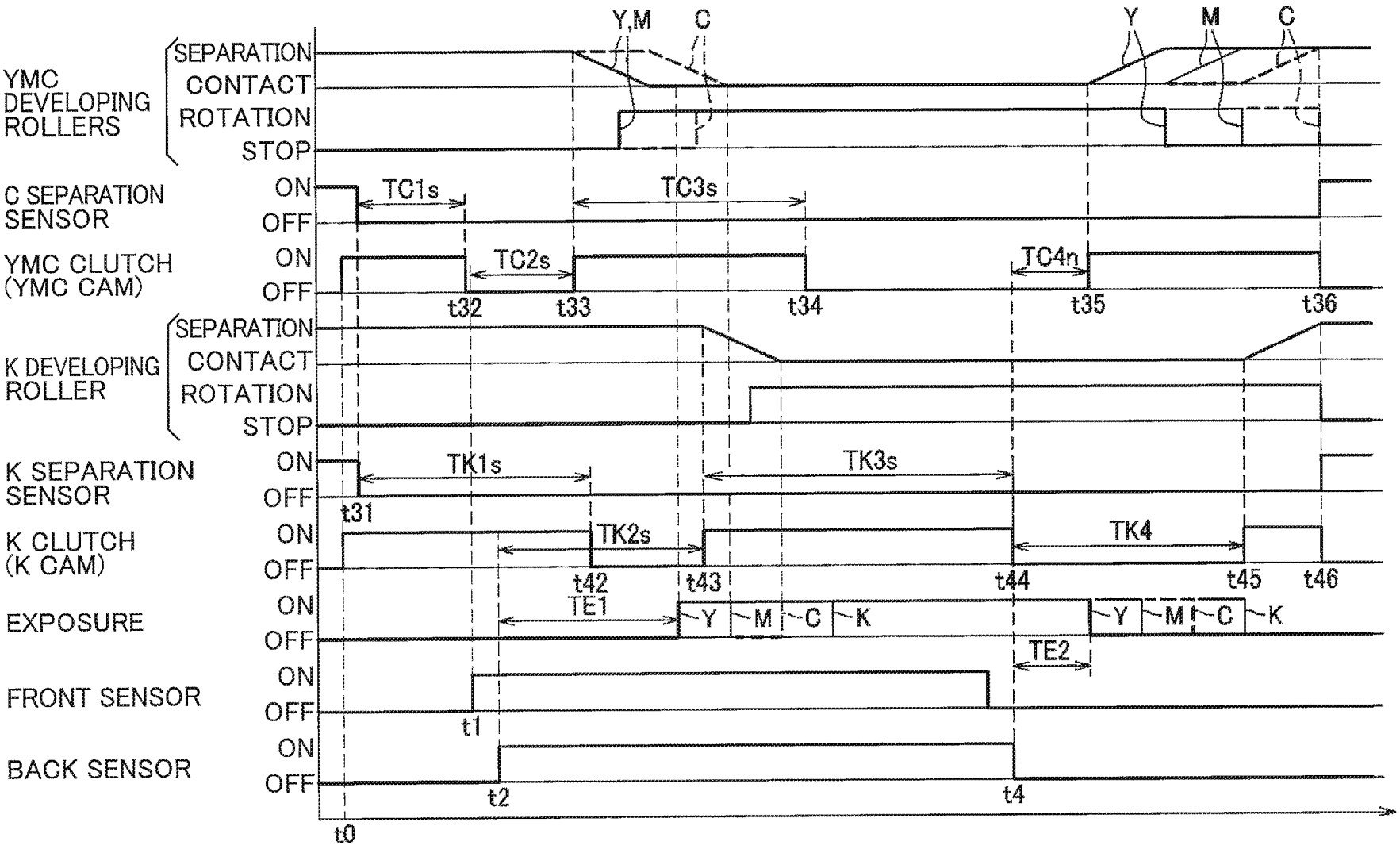
FIG. 23 is a timing chart for description of operations of the developing rollers and control to the YMC clutch and K clutch in response to output from each sensor for performing color printing in a low speed mode in the image-forming apparatus according to the embodiment.

In contrast, in the low speed mode illustrated in FIG. 23, the controller 2 permits the YMC clutch 140A to turn ON to start rotations of the cams 150Y, 150M and 150C to start moving the developing rollers 61Y, 61M and 61C from the respective separated positions to the contact positions at a timing t33 which is earlier than the rotation start timing t13 in the normal mode, the timing t33 being upon elapse of a second time period TC2*s* from the timing t1 at which the front sensor 28B detects the leading edge of the sheet S. The second time period TC2*s* in the low speed mode is shorter than the second time period TC2*n* in the normal mode. The second time period TC2*s* in the low speed mode is set so that the timing at which the C developing roller 61C contacts the C photosensitive drum 50C in the low speed mode is coincident with the contacting timing in the normal mode.

Further, when the developing roller 61K is to be moved from the separated position to the contact position, the controller 2 controls the K clutch 140K to be rendered ON such that the timing at which the K developing roller 61K contacts the K photosensitive drum 50K in the low speed mode is coincident with the timing at which the K developing roller 61K contacts the K photosensitive drum 50K in the normal mode.

Specifically, in the normal mode illustrated in FIG. 22, the controller 2 permits the K clutch 140A to turn ON to start rotation of the K cam 150K to thus start moving the developing roller 61K from the separated position toward the contact position upon elapse of a second time period TK2*n* from a timing t2 at which the back sensor 28C detects the leading edge of the sheet S.

In contrast, in the low speed mode illustrated in FIG. 23, the controller 2 permits the K clutch 140K to turn ON to start rotation of the K cam 150K at a timing earlier than the rotation start timing in the normal mode to start moving the developing roller 61K from the separated position toward the contact position upon elapse of a second time period TK2*s* from the timing t2 at which the back sensor 28C detects the leading edge of the sheet S. The second time period TK2*s* in the low speed mode is shorter than the second time period TK2*n* in the normal mode. The second time period TK2*s* in the low speed mode is set so that the timing at which the K developing roller 61K contacts the K photosensitive drum 50K in the low speed mode is coincident with the contacting timing in the normal mode.

Further, when the developing rollers 61Y, 61M and 61C are to be moved from the respective contacts position to the separated positions, the controller 2 controls the YCM clutch 140A to be in the transmission state such that the timing at which the Y developing roller 61Y starts separation from the Y photosensitive drum 50Y in the low speed mode is coincident with or later than the timing at which the Y developing roller 61Y starts separation from the Y photosensitive drum 50Y in the normal mode. In the present embodiment, the controller 2 controls the YMC clutch 140A to turn ON such that the timing at which the Y developing roller 61Y starts separation from the Y photosensitive drum 50Y in the low speed mode is coincident with the timing at which the Y developing roller 61Y starts separation from the Y photosensitive drum 50Y in the normal mode.

Specifically, not only in the normal mode illustrated in FIG. 22 but also in the low speed mode illustrated in FIG. 23, the controller 2 permits the YMC clutch 140A to turn ON to start rotations of the respective cams 150Y, 150M and 150C to thus start moving the developing rollers 61Y, 61M and 61C from the respective contact positions toward the separated positions upon elapse of a fourth time period TC4*n* from a timing t4 at which the back sensor 28C detects the trailing edge of the sheet S.

Further, when the K developing roller 61K is to be moved from the contact position to the separated position, the controller 2 permits the K clutch 140K to be rendered ON such that the timing at which the K developing roller 61K starts separation from the K photosensitive drum 50K in the low speed mode is coincident with the timing at which the K developing roller 61K starts separation from the K photosensitive drum 50K in the normal mode.

Specifically, not only in the normal mode but also in the low speed mode, the controller 2 permits the K clutch 140K to turn ON to start rotation of the K cam 150K to thus start moving the K developing roller 61K from the contact position toward the separated position upon elapse of a fourth time period TK4 from the timing t4 at which the back sensor 28C detects the trailing edge of the sheet S.

Further, in a case where the developing rollers 61Y, 61M and 61C are to be moved from the separated positions to the contact positions, respectively, the controller 2 controls the YCM clutch 140A to be at the transmission state such that the timing at which the Y developing roller 61Y contacts the Y photosensitive drum 50Y in the high speed mode is coincident with or earlier than the timing at which the Y developing roller 61Y contacts the Y photosensitive drum 50Y in the normal mode. In the present embodiment, the controller 2 controls the YCM clutch 140A to turn ON such that the timing at which the Y developing roller 61Y contacts the Y photosensitive drum 50Y in the high speed mode is coincident with the timing at which the Y developing roller 61Y contacts the Y photosensitive drum 50Y in the normal mode.

Figure 24:
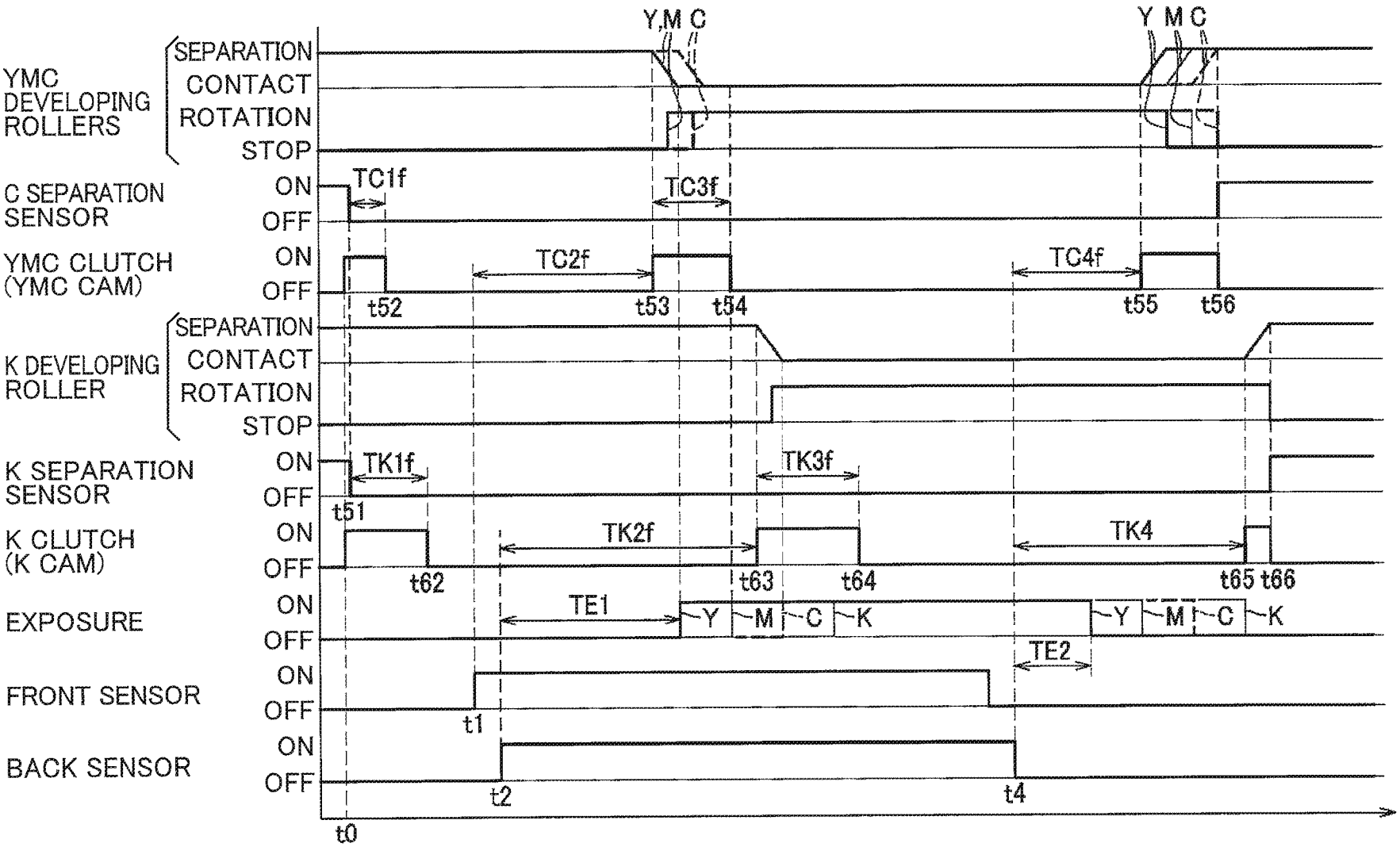
FIG. 24 is a timing chart for description of operations of the developing rollers and control to the YMC clutch and K clutch in response to output from each sensor for performing color printing in a high speed mode in the image-forming apparatus according to the embodiment.

Specifically, in the high speed mode illustrated in FIG. 24, the controller 2 permits the YMC clutch 140A to turn ON to start rotations of the respective cams 150Y, 150M and 150C to thus start moving the developing rollers 61Y, 61M and 61C respectively from the separated positions toward the contact positions upon elapse of a second time period TC2*f* from the timing t1 at which the front sensor 28B detects the leading edge of the sheet S. The second time period TC2*f* in the high speed mode is longer than the second time period TC2*n* in the normal mode. The second time period TC2*f* is set so that the timing at which the Y developing roller 61 contacts the Y photosensitive drum 50Y in the high speed mode is coincident with the timing at which contacting timing in the normal mode.

Further, in the present embodiment, when the K developing roller 61K is to be moved from the separated position to the contact position, the controller 2 controls the K clutch 140K to be rendered ON such that the timing at which the K developing roller 61K contacts the K photosensitive drum 50K in the high speed mode is coincident with the timing at which the K developing roller 61K contacts the K photosensitive drum 50K in the normal mode.

Specifically, in the high speed mode illustrated in FIG. 24, the controller 2 permits the K clutch 140K to turn ON to start rotating the K cam 150K at a timing later than the rotation start timing in the normal mode, to thus start moving the developing roller 61K from the separated position toward the contact position upon elapse of a second time period TK2*f* from the timing t2 at which the back sensor 28C detects the leading edge of the sheet S. The second time period TK2*f* is longer than the second time period TK2*n* in the normal mode. The second time period TK2*f* is set so that the timing at which the K developing roller 61K contacts the K photosensitive drum 50K in the high speed mode is coincident with the contacting timing in the normal mode.

Further, when the developing rollers 61Y, 61M and 61C are to be moved respectively from the contact positions to the separated positions, the controller 2 controls the YCM clutch 140A to be in the transmission state such that the timing at which the C developing roller 61C starts separation from the C photosensitive drum 50C in the high speed mode is coincident with or later than the timing at which the C developing roller 61C starts separation from the C photosensitive drum 50C in the normal mode. In the present embodiment, the controller 2 controls the YMC clutch 140A to turn ON such that the timing at which the C developing roller 61C starts separation from the C photosensitive drum 50C in the highspeed mode is coincident with the timing at which the C developing roller 61C starts separation from the C photosensitive drum 50C in the normal mode.

Specifically, in the high speed mode, the controller 2 permits the YMC clutch 140A to turn ON to start rotations of the cams 150Y, 150M and 150C at a timing later than the rotation start timing in the normal mode, to thus start movement of the developing rollers 61Y, 61M and 61C respectively from the contact positions toward the separated positions upon elapse of a fourth time period TC4*f* from the timing t4 at which the back sensor 28C detects the trailing edge of the sheet S. The fourth time period TC4*f* is longer than the fourth time period TC4*n* in the normal mode, and is set so that the timing at which the C developing roller 61C starts separation from the C photosensitive drum 50C in the high speed mode is coincident with the separation start timing in the normal mode.

Further, when the K developing roller 61K is to be moved from the contact position to the separated position, the controller 2 controls the K clutch 140K to be rendered ON such that the timing at which the K developing roller 61K starts separation from the K photosensitive drum 50K in the high speed mode is coincident with the timing at which the K developing roller 61K starts separation from the K photosensitive drum 50K in the normal mode.

Specifically, not only in the high mode but also in the normal mode (and in the low speed mode), the controller 2 permits the K clutch 140K to turn ON to start rotation of the K cam 150K to thus start moving the K developing roller 61K from the contact position toward the separated position upon elapse of the fourth time period TK4 (which is also set in the normal mode) from the timing t4 at which the back sensor 28C detects the trailing edge of the sheet S.

Next, an example of processing to be executed by the controller 2 will be described with reference to FIGS. 19 through 24.

Figure 19:
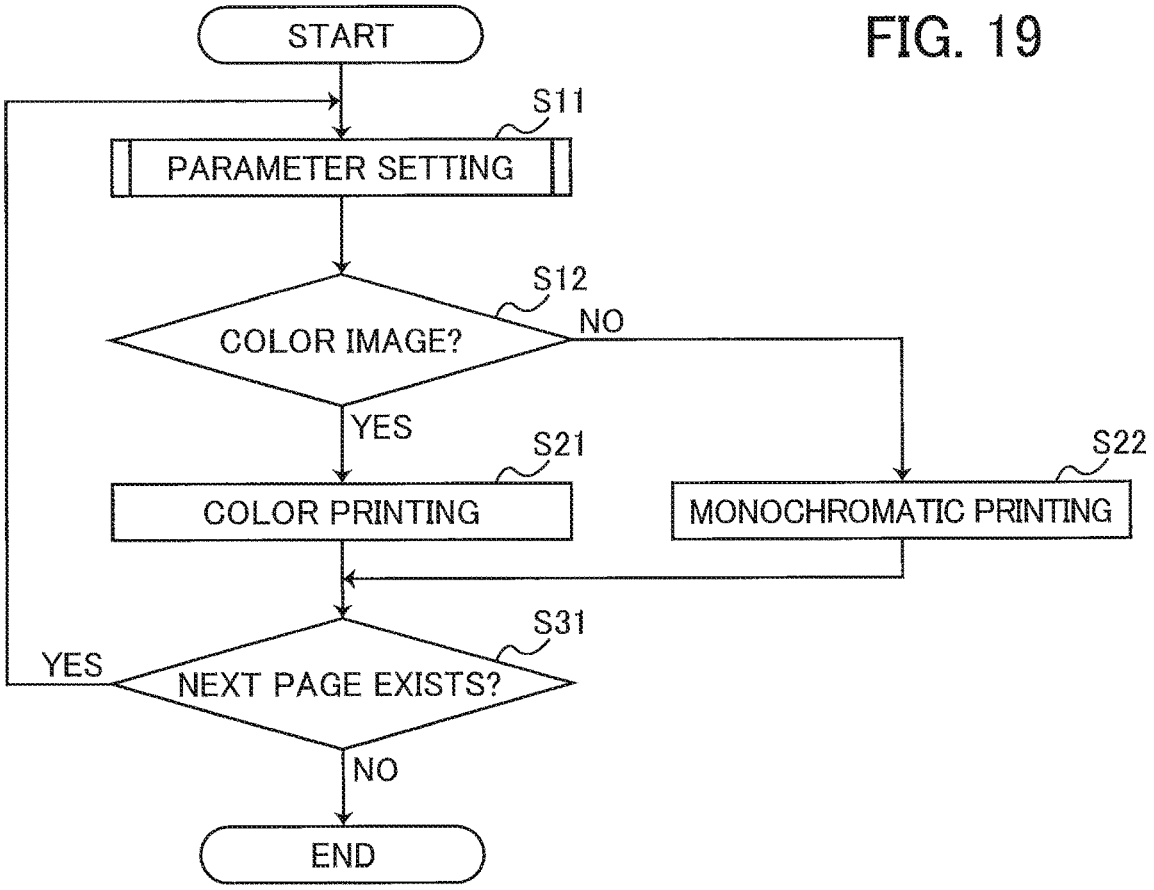
FIG. 19 is a flowchart illustrating an example of processing to be initiated upon receipt of a print job in the image-forming apparatus according to the embodiment.

FIG. 19 illustrates an example of process configured to be executed by the controller 2 upon receipt of a print job. Upon receipt of a print job, the controller 2 first determines in which mode image formation should be performed on a first page contained in the print job, and sets various parameters according to the mode (in S11). The controller 2 then determines whether or not color image is to be printed on the first page (in S12).

In a case where the color image is to be formed (S12: YES), the routine proceeds to S21 to execute color printing process. On the other hand, in a case where a monochromatic image is to be printed (S12: No), the routine proceeds to S22 to execute a monochromatic printing process. Upon completion of image formation on the first page in the steps S21 or S22, the controller 2 determines whether the print job contains data of a subsequent page (S31). In a case where printing on the next page is required (S31: YES), the routine returns back to S11, whereas in a case where the print job does not contain data of the next page (S31: NO), the processing is terminated.

Figure 20:
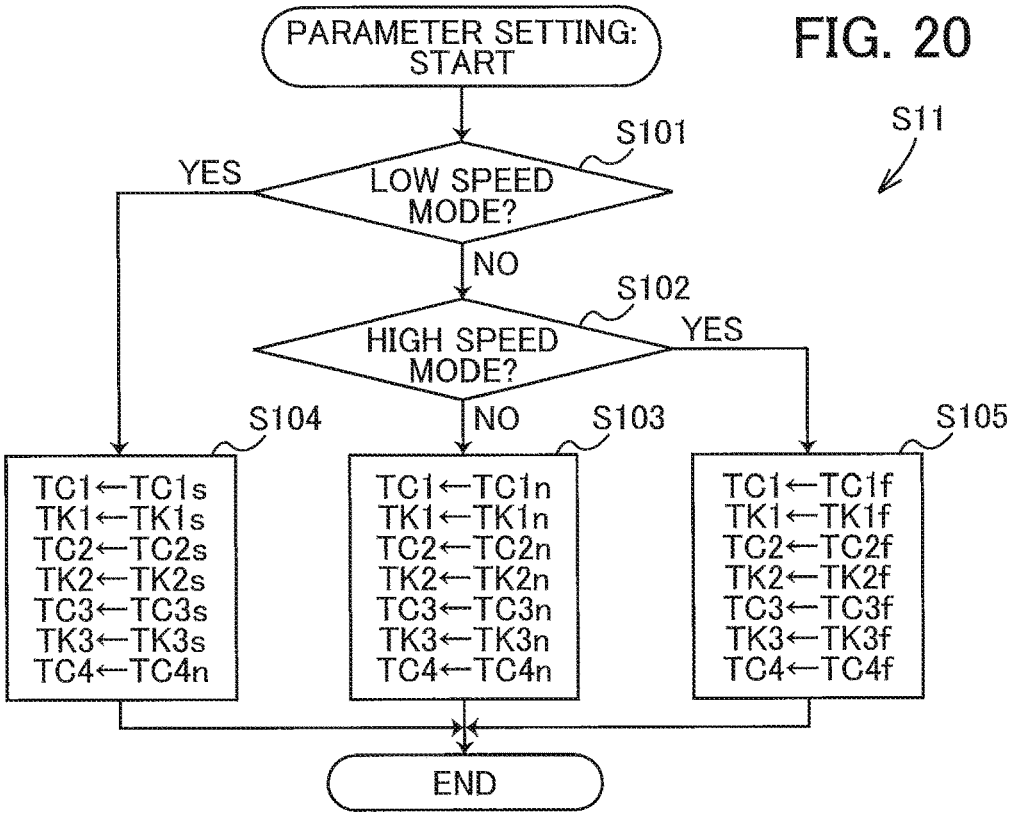
FIG. 20 is a flowchart illustrating an example of processing to set parameters in the image-forming apparatus according to the embodiment.

FIG. 20 illustrates details on the parameter setting step of S11 in FIG. 19.

In a case where the mode for image formation is determined to be the normal mode (S101: NO and S102: NO), the routine proceeds to S103 where: TC1*n* is set as the first time period TC1; TK1*n* is set as the first time period TK1; TC2*n* is set as the second time period TC2; TK2*n* is set as the second time period TK2; TC3*n* is set as the third time period TC3; TK3*n* is set as the third time period TK3; and TC4*n* is set as the fourth time period TC4. Incidentally, in the present embodiment, the fourth time period TK4 is a fixed value.

In a case where the mode for image formation is determined to be the low speed mode (S101: YES), the routine proceeds to S104 where: the first time period TC1 is set to TC1*s*; the first time period TK1 is set to TK1*s*; the second time period TC2 is set to TC2*s*; the second time period TK2 is set to TK2*s*; the third time period TC3 is set to TC3*s*; the third time period TK3 is set to TK3*s*; and the fourth time period TC4 is set to the TC4*n* which is equal to the fourth time period in the normal mode.

In a case where the mode for image formation is determined to be the high speed mode, (S101: NO and S102: YES), the routine proceeds to S105 where: the first time period TC1 is set to TC1*f*; the first time period TK1 is set to TK1*f*; the second time period TC2 is set to TC2*f*; the second time period TK2 is set to TK2*f*; the third time period TC3 is set to TC3*f*; the third time period TK3 is set to TK3*f*; and the fourth time period TC4 is set to the TC4*f*.

Color Printing in the Normal Mode

Next, color printing process under the normal mode (the steps S11, S12: YES, and S21 in FIG. 19) will be described with reference to flowcharts illustrated in FIGS. 21A and 21B and a timing chart of FIG. 22.

Figure 21A:
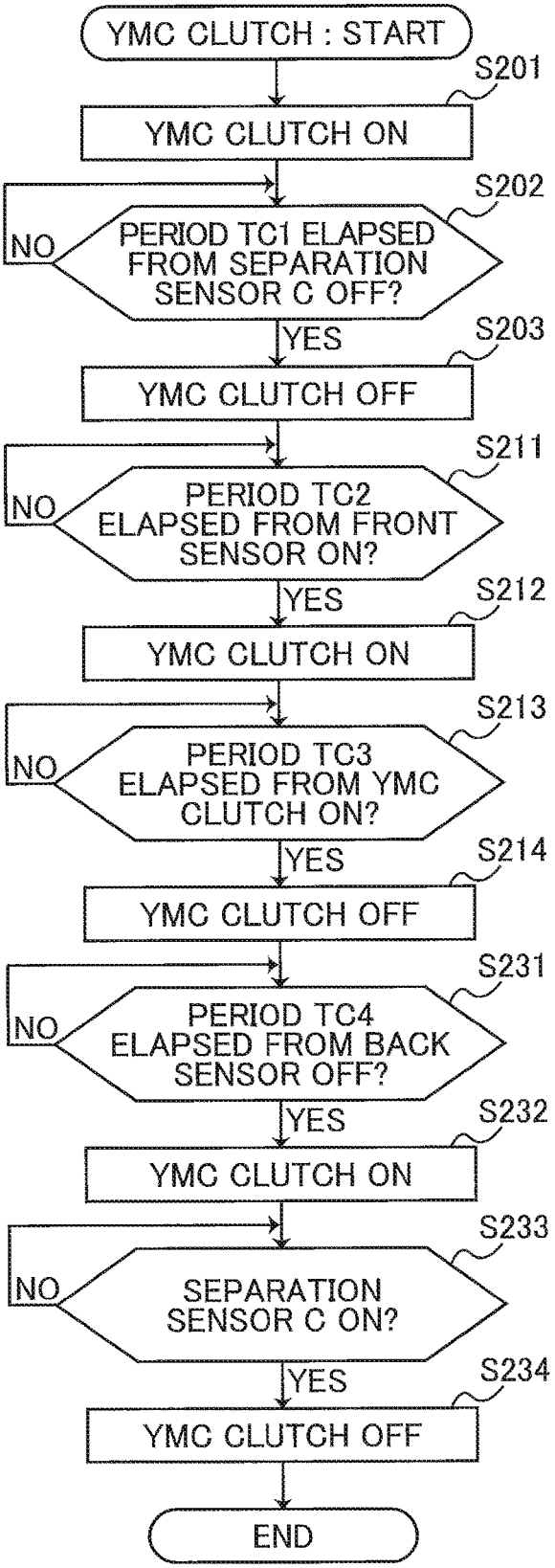
FIG. 21A is a flowchart illustrating an example of processing to control a YMC clutch in the image-forming apparatus according to the embodiment.
Figure 21B:
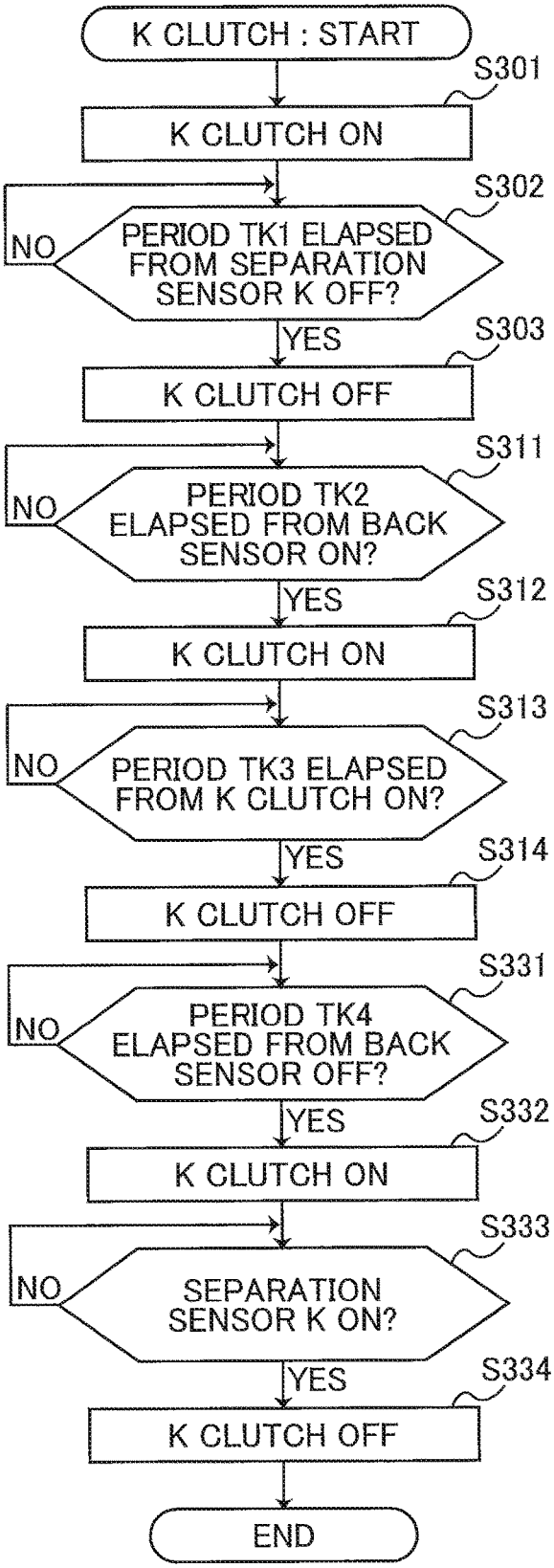
FIG. 21B is a flowchart illustrating an example of processing to control a K clutch in the image-forming apparatus according to the embodiment.

Incidentally, FIGS. 21A through 22 and FIGS. 23 and 24 later mentioned illustrate processing performed for printing on a single sheet. Further, FIG. 21A illustrates control to the YMC clutch 140A, and FIG. 21B illustrates control to the K clutch 140K. Further, in the upper section of each of the timing charts in FIG. 22 through 24, operation timing of the Y developing roller 61Y is indicated by a bold line, and operation timings of the developing rollers 61M and 61C are respectively indicated by a normal line and a broken line those being partly overlapped with the bold line.

In case of color printing, all the developing rollers 61 are at the respective separated positions prior to an image forming operation. Referring to FIGS. 21A, 21B and 22, the controller 2 permits the YMC clutch 140A to turn ON (S201, timing t0) and permits the K clutch 140K to turn ON (S301, timing t0) in order to successively move the developing rollers 61 to the respective contact positions. As a result, the cams 150Y, 150M, 150C and 150K start rotating, and immediately thereafter, the separation sensors 4C and 4K are turned OFF (timing t11).

Then, the controller 2 determines whether the first time period TC1(TC1*n*) has elapsed from the timing t1 at which the separation sensor 4C for the color of cyan is turned OFF during a period after starting conveying the sheet S and prior to arrival of the sheet S at the Y photosensitive drum 50Y (S202). In a case where the first time period TC1(TC1*n*) is determined to elapse (S202: YES), the controller 2 permits the YMC clutch 140A to turn OFF (S203, timing t12) to stop rotation of the cams 150Y, 150M and 150C at the temporary stop timing.

The first time period TC1 is so set that, at the temporary stop timing, the contact portion 172 of the cam follower 170 for the color of yellow is positioned on a region of the second holding surface F2 of the Y cam 150Y, the region being closest to the second guide surface F4. Hence, immediately after the restart of rotation of the cams 150Y, 150M and 150C, the cam follower 170 for the color of yellow is promptly moved to the second guide surface F4, so that the Y developing roller 61Y starts moving to the contact position.

The controller 2 also determines whether the first time period TK1(TK1*n*) has elapsed from the timing t11 at which the separation sensor 4K for the color of black is turned OFF prior to arrival of the sheet S at the K photosensitive drum 50K (S302 in FIG. 21B). In a case where the first time period TK1(TK1*n*) is determined to elapse (S302: YES), the controller 2 turns OFF the K clutch 140K (S303, timing t22) to stop the rotation of the K cam 150K at the temporary stop timing.

The first time period TK1 is so set that, at the temporary stop timing, the contact portion 172 of the cam follower 170 for the color of black is positioned on a region of the second holding surface F2 of the K cam 150K, the region being closest to the second guide surface F4. Hence, after the restart of the rotation of the K cam 150K, the cam follower 170 for the color of black is promptly moved onto the second guide surface F4, so that the K developing roller 61K starts moving to the contact position. Incidentally, the first time period TK1 is different from the first time period TC1.

Then, the controller 2 determines in S211 whether the second time period TC2(TC2*n*) has elapsed from the timing t1 at which the front sensor 28B is turned ON (at which the leading edge of the sheet S moves past the front sensor 28B). In a case where the second time period TC2(TC2*n*) has elapsed (S211: YES), the controller 2 turns on the YMC clutch 140A in S212 to restart the rotations of the cams 150Y, 150M and 150C at the restart timing (timing t13). The second time period TC2 is set so that the toner development on the Y photosensitive drum 50Y by the Y developing roller 61Y can be completed by the time the toner image is transferred from the photosensitive drum 50Y to the conveyed sheet S.

Then, the controller 2 determines in S311 whether the second time period TK2(TK2*n*) has elapsed from the timing t2 at which the back sensor 28C is turned ON (at which the leading edge of the sheet S moves past the back sensor 28C). In a case where the second time period TK2 has elapsed (S311: YES), the controller 2 permits the K clutch 140K to turn ON (S312, timing t23) to restart the rotation of the K cam 150K. The second time period TK2 is set so that the toner development on the K photosensitive drum 50K by the K developing roller 61K can be completed by the time the toner image is transferred from the K photosensitive drum 50K to the conveyed sheet S.

Then, the controller 2 determines in S213 whether the third time period TC3(TC3*n*) has elapsed from the timing 13 at which the YMC clutch 140A is turned ON. In a case where the third time period TC3 is determined to have elapsed (S213: YES), the controller 2 permits the YMC clutch 140A to turn OFF (S214, timing t14) to stop the rotations of the cams 150Y, 150M and 150C.

The third time period TC3 is set so that the contact portion 172 of the cam follower 170 for the color of yellow is positioned on a region of the first holding surface F1 of the Y cam 150Y at a time after the developing rollers 61Y, 61M and 61C are all positioned at the respective contact positions, the region being closest to the first guide surface F3. Hence, after the restart of the rotation of the cams 150Y, 150M and 150C, the cam follower 170 for the color of yellow is promptly moved to the first guide surface F3, so that the Y developing roller 61Y starts moving to the separated position promptly.

Then, the controller 2 determines in S313 whether the third time period TK3(TK3*n*) has elapsed from the timing 23 at which the K clutch 140K is turned ON. In a case where the third time period TK3 is determined to have elapsed (S313: YES), the K clutch 140K is turned OFF (S314, timing t24) to stop rotating the K cam 150K.

The third time period TK3 is set so that the contact portion 172 of the cam follower 170 for the color of black is positioned on a region of the first holding surface F1, the region being closest to the first guide surface F3, at a time after the K developing roller 61K is positioned at the contact position. Hence, after the restart of the rotation of the K cam 150K, the cam follower 170 for the color of black is promptly moved to the first guide surface F3, so that the K developing roller 61K starts moving toward the separated position.

Incidentally, upon elapse of a predetermined time period TE1 from the timing t2 at which the back sensor 28C is turned ON, the controller 2 permits the exposure unit 40 to successively emit light beams to successively start exposure to the respective photosensitive drums 50Y, 50M, 50C and 50K. In the normal mode, the Y developing roller 61Y and the M developing roller 61M move to their contact positions approximately concurrently with the start of the exposure to the Y photosensitive drum 50Y; the C developing roller 61C moves to the contact position approximately concurrently with the start of the exposure to the M photosensitive drum 50M; and the K developing roller 61K moves to the contact position approximately concurrently with the start of the exposure to the C photosensitive drum 50C.

Then, the controller 2 determines in S231 whether the fourth time period TC4(TC4*n*) has elapsed from the timing t4 at which the back sensor 28C is turned OFF as a result of the detection of the trailing edge of the sheet S. In a case where the fourth time period TC4 has elapsed (S231: YES), the controller 2 permits the YMC clutch 140A to turn ON (S232, timing t15) to rotate the cams 150Y, 150M and 150C to thus successively start separating the Y developing roller 61Y, the M developing roller 61M, and the C developing roller 61C from the corresponding photosensitive drums 50.

The fourth time period TC4 is so set within which the Y developing roller 61Y starts moving to the separated position after the completion of development on the Y photosensitive drum 50Y by the Y developing roller 61Y and immediately after the completion of image transfer from the Y photosensitive drum 50Y to the sheet S.

Then, the controller 2 determines in S233 whether the separation sensor 4C for the color of cyan outputs the ON signal (separation signal). In a case the ON signal is outputted (S233: YES), the controller 2 permits the YMC clutch 140A to turn OFF (S234, timing t16) to stop rotations of the cams 150Y, 150M and 150C.

The controller 2 further determines in S331 whether the fourth time period TK4 has elapsed from the timing t4 at which the back sensor 28C is turned OFF. In a case where the fourth time period TK4 has elapsed (S331: YES), the controller 2 permits the K clutch 140K to turn ON (S332, timing t25) to rotate the K cam 150K. The fourth time period TK4 is so set within which the K developing roller 61K starts moving to the separated position after completion of development on the K photosensitive drum 50K by the K developing roller 61K and immediately after the completion of image transfer from the K photosensitive drum 50K to the sheet S.

Then, the controller 2 determines whether the separation sensor 4K for the color of black outputs the ON signal in S333. If the ON signal is outputted (S333: YES), the controller 2 permits the K clutch 140K to turn OFF (S334, timing t26) to stop the rotation of the K cam 150K.

Incidentally, the controller 2 also controls the exposure unit 40 to terminate light irradiation to successively terminate the exposure to the respective photosensitive drums 50Y, 50M, 50C and 50K sequentially upon elapse of a predetermined time period TE2 from the timing t4 at which the back sensor 28C is turned OFF. In the normal mode, the Y developing roller 61Y starts moving toward the separated position approximately concurrently with the completion of the exposure to the Y photosensitive drum 50Y; the M developing roller 61M starts moving toward the separated position approximately concurrently with the completion of the exposure to the M photosensitive drum 50M; the C developing roller 61Y starts moving toward the separated position approximately concurrently with the completion of the exposure to the C photosensitive drum 50C; and the K developing roller 61K starts moving toward the separated position approximately concurrently with the completion of the exposure to the K photosensitive drum 50K.

Color Printing in the Low Speed Mode

Next, color printing process under the low speed mode (the steps S11, S12: YES, and S21 in FIG. 19.) will be described with reference to a timing chart illustrated in FIG. 23.

As described above, in the case of the low speed mode, in the parameter setting step in S11 of FIG. 19, the parameters (TC1, TK1, TC2, TK2, TC3, TK3 and TC4) are set to those for the low speed mode in S104 (TC1*s*, TK1*s*, TC2*s*, TK2*s*, TC3*s*, TK3*s* and TC4*n*), as the routine process to S104 as a result of the YES determination in S101 in FIG. 20.

Then, referring to FIG. 23, the controller 2 permits the YMC clutch 140A and the K clutch 140K to turn ON at the timing t0. Hence, the respective cams 150 rotate to render the separation sensors 4C and 4K OFF at a timing t31. Then, the controller 2 turns OFF the YMC clutch 140A at a timing t32 upon elapse of the first time period TC1*s* from the turning OFF timing (t31) of the separation sensor 4C for the color of cyan to stop rotations of the cams 150Y, 150M and 150C. The first time period TC1*s* for the low speed mode (where the rotation speed of each cam 150 is lowered) is set longer than the first time period TC1*n* for the normal mode.

Then, the controller 2 controls the YMC clutch 140A to turn ON at a timing t33 to restart rotations of the cams 150Y, 150M and 150C upon elapse of the second time period TC2*s* from the timing t1 at which the front sensor 28B turns ON.

Further, the controller 2 permits the K clutch 140K to turn OFF at a timing t42 upon elapse of the first time period TK1*s* from the turning OFF timing (t31) of the separation sensor 4K for the color of black to stop the rotation of the K cam 150K. The first time period TK1*s* for the low speed mode is set longer than the first time period TK1*n* for the normal mode.

Then, the controller 2 permits the K clutch 140K to turn ON at a timing t43 to start rotating the K cam 150K upon elapse of the second time period TK2*s* from the timing t2 at which the back sensor 28C turns ON.

Then, the controller 2 turns OFF the YMC clutch 140A at a timing t34 upon elapse of the third time period TC3*s* from the turning ON timing (t33) of the YMC clutch 140A to stop rotations of the cams 150Y, 150M and 150C. The third time period TC3*s* for the low speed mode (where the moving speed of the developing roller from the separated position to the contact position is lowered) is set longer than the third time period TC3*n* for the normal mode.

Then, the controller 2 permits the K clutch 140K to turn OFF at a timing t44 to stop the rotation of the K cam 150K upon elapse of the third time period TK3*s* from the timing t43 at which the K clutch 140K is turned ON. The third time period TK3*s* in the low speed mode is longer than the third time period TK3*n* in the normal mode.

In the low speed mode, the Y developing roller 61Y and the M developing roller 61M are brought to the respective contact positions prior to the start of the exposure to the Y photosensitive drum 50Y; the C developing roller 61C is brought to the contact position approximately concurrently with the start of the exposure to the M photosensitive drum 50M; and the K developing roller 61K is brought to the contact position approximately concurrently with the start of the exposure to the C photosensitive drum 50M.

Then, upon elapse of the fourth time period TC4*n* from the timing t4 at which the back sensor 28C is turned OFF, the controller 2 turns ON the YMC clutch 140A at a timing t35 to rotate the cams 150Y, 150M and 150C to thus successively start separation of the Y developing roller 61Y, the M developing roller 61M and the C developing roller 61C from the corresponding photosensitive drums 50. Then, the controller 2 permits the YMC clutch 140A to turn OFF at a timing t36 to stop the rotations of the cams 150Y, 150M and 150C upon turning ON of the separation sensor 4C for the color of cyan.

Further, upon elapse of the fourth time period TK4 from the timing t4 at which the back sensor 28C is turned OFF, the controller 2 permits the K clutch 140K to turn ON at a timing t45 to rotate the K cam 150K to thus start separation of the K developing roller 61K from the photosensitive drum 50K.

The controller 2 turns OFF the K clutch 140K at a timing t46 to stop the rotation of the K cam 150K upon turning ON of the separation sensor 4K for the color of black.

In the low speed mode, the Y developing roller 61Y starts moving toward the separated position approximately concurrently with the termination of the exposure to the Y photosensitive drum 50Y; the M developing roller 61M starts moving toward the separated position after the termination of the exposure to the M photosensitive drum 50M; the C developing roller 61C starts moving toward the separated position after the termination of the exposure to the C photosensitive drum 50C; and the K developing roller 61K starts moving toward the separated position approximately concurrently with the termination of the exposure to the K photosensitive drum 50K.

Color Printing in the High Speed Mode

Next, color printing process under the high speed mode (the steps S11, S12: YES, and S21 in FIG. 19) will be described with reference to a timing chart illustrated in FIG. 24.

As described above, in the case of the high speed mode, in the parameter setting step in S11 of FIG. 19, the parameters (TC1, TK1, TC2, TK2, TC3, TK3 and TC4) are set to those for the highspeed mode (TC1*f*, TK1*f*, TC2*f*, TK2*f*, TC3*f*, TK3*f* and TC4*f*) in S105, as the routine process to S105 as a result of the NO determination in S101 and the YES determination in S102 in FIG. 20.

Thereafter, referring to FIG. 24, the controller 2 permits the YMC clutch 140A and the K clutch 140K to turn ON at the timing t0. Hence, the respective cams 150 rotate to render the separation sensors 4C and 4K OFF at a timing t51. Then, the controller 2 permits the YMC clutch 140A to turn OFF at a timing t52 upon elapse of the first time period TC1*f* from the turning OFF timing (t51) of the separation sensor 4C for the color of cyan to stop rotation of the cams 150Y, 150M and 150C. The first time period TC1*f* for the high speed mode (where the rotation speed of the cam 150 is higher) is set shorter than the first time period TC1*n* in the normal mode.

Further, the controller 2 permits the K clutch 140K to turn OFF at a timing t62 upon elapse of the first time period TK1*f* from the turning OFF timing (t51) of the separation sensor 4K for the color of black to stop the rotation of the K cam 150K. The first time period TK1*f* in the high speed mode is set shorter than the first time period TK1*n* in the normal mode.

Then, the controller 2 permits the YMC clutch 140A to turn ON at a timing t53 to restart rotations of the cams 150Y, 150M and 150C upon elapse of the second time period TC2*f* from the timing t1 at which the front sensor 28B turns ON. Then, the controller 2 permits the YMC clutch 140A to turn OFF (t54) to stop rotation of the cams 150Y, 150M, 150C upon elapse of the third time period TC3*f* from the turning ON timing (t53) of the YMC clutch 140A. The third time period TC3*f* in the high speed mode (where the moving speed of the developing roller 61 from the separated position to the contact position is higher) is set shorter than the third time period TC3*n* in the normal mode.

Then, the controller 2 permits the K clutch 140K to turn ON at a timing t63 to start rotation of the K cam 150K upon elapse of the second time period TK2*f* from the timing t2 at which the back sensor 28C turns ON. Then, the controller 2 permits the K clutch 140K to turn OFF at a timing t64 to stop rotation of the K cam 150K upon elapse of the third time period TK3*f* from the turning ON timing (t63) of the K clutch 140K. The third time period TK3*f* in the high speed mode is set shorter than the third time period TK3*n* in the normal mode.

In the high speed mode, the Y developing roller 61Y and the M developing roller 61M are brought to the respective contact positions approximately concurrently with the start of the exposure to the Y photosensitive drum 50Y; the C developing roller 61C is brought to the contact position prior to the start of the exposure to the M photosensitive drum 50M; and the K developing roller 61K is brought to the contact position approximately concurrently with the start of the exposure to the C photosensitive drum 50C.

Then, the controller 2 permits the YMC clutch 140A to turn ON at a timing t55 to rotate the cams 150Y, 150M and 150C to thus successively start separation of the Y developing roller 61Y, the M developing roller 61M and the C developing roller 61C from the corresponding photosensitive drums 50 upon elapse of the fourth time period TC4*f* from the timing t4 at which the back sensor 28C is turned OFF. Then, the controller 2 permits the YMC clutch 140A to turn OFF at a timing t56 to stop the rotations of the cams 150Y, 150M and 150C upon turning ON of the separation sensor 4C for the color of cyan.

The controller 2 further permits the K clutch 140K to turn ON at a timing t65 to rotate the K cam 150K to start separation of the K developing roller 61K from the K photosensitive drum 50K upon elapse of the fourth time period TK4 from the timing t4 at which the back sensor 28C is turned OFF. Then, the controller 2 permits the K clutch 140K to turn OFF at a timing t66 to stop the rotation of the K cam 150K upon turning ON of the separation sensor 4K for the color of black.

In the high speed mode, the Y developing roller 61Y starts moving to the separated position after the termination of the exposure to the Y photosensitive drum 50Y; the M developing roller 61M starts moving to the separated position after the termination of the exposure to the M photosensitive drum 50M; the C developing roller 61C starts moving to the separated position approximately concurrently with the termination of the exposure to the C photosensitive drum 50C; and the K developing roller 61K starts moving to the separated position approximately concurrently with the termination of the exposure to the K photosensitive drum 50K.

Incidentally, the monochromatic printing process (to be performed in S22 as a result of the NO determination in S12 in FIG. 19) is the same as the color printing process (in S21 in FIG. 19) except that the YMC clutch 140A is never operated to keep the developing rollers 61Y, 61M and 61C respectively in the separated positions (that is, the processing illustrated in FIG. 21A is not performed). Hence, description for the monochromatic printing process will be omitted here.

Operational and Technical Advantages of the Embodiment

Advantageous functions and effects attained in the image-forming apparatus 1 of the depicted embodiment will be described.

In the image-forming apparatus 1, as illustrated in FIG. 6, the components for performing conveyance of the sheet S such as the photosensitive drums 50 are configured to be driven by the process motor 3P, whereas the developing rollers 61 and the cams 150 are configured to be driven by the developing motor 3D. Hence, in a structure capable of performing contact and separation between a developing roller and a photosensitive drum, the image-forming apparatus 1 according to the above-described embodiment can alter a rotation speed ratio between the photosensitive drums 50 and the developing rollers 61 with a reduced number of motors, in comparison with a structure in which each motor is exclusively used for each of the photosensitive drums, the developing rollers, and the cams.

Figures 25A, 25B, 25C:
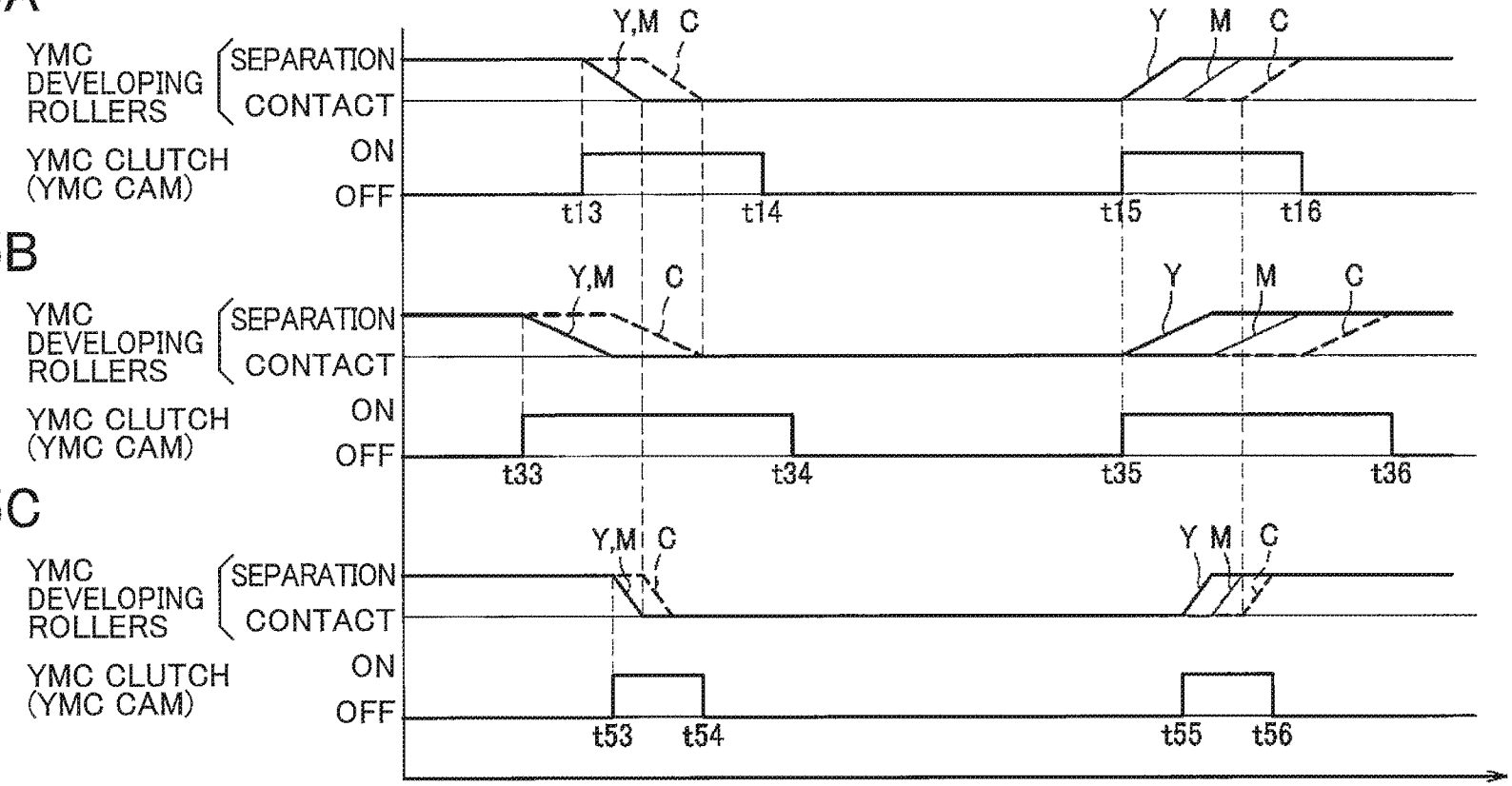
FIG. 25A is a timing chart for description of operations of the YMC clutch (YMC cam) and the developing rollers for the colors of yellow, magenta and cyan for performing color printing in the normal mode in the image-forming apparatus according to the embodiment.
FIG. 25B is a timing chart for description of operations of the YMC clutch (YMC cam) and the developing rollers for the colors of yellow, magenta and cyan for performing color printing in the low speed mode in the image-forming apparatus according to the embodiment.
FIG. 25C is a timing chart for description of operations of the YMC clutch (YMC cam) and the developing rollers for the colors of yellow, magenta and cyan for performing color printing in the high speed mode in the image-forming apparatus according to the embodiment.

Further, FIGS. 25A-25C are timing charts in the normal mode, low speed mode and high speed mode, respectively, to compare various timings for moving the developing roller 61 from the separated position to the contact position in the image-forming apparatus 1 according to the above-described embodiment. In the low speed mode depicted in FIG. 25B, the YMC clutch 140A is turned ON at the timing t33 which is earlier than the timing t13 at which the YMC clutch 140A is turned ON in the normal mode to start rotating the cams 150Y, 150M and 150C in order to move the developing rollers 61Y, 61M and 61C toward the respective contact positions. This timing differential is set so that the timing at which the C developing roller 61C is brought to the contact position in the low speed mode (as illustrated in FIG. 25B) can be on or before the timing at which the C developing roller 61C is brought to the contact position in the normal mode (as illustrated in FIG. 25A). Hence, irrespective of the modes for image formation, the developing rollers 61Y, 61M and 61C can be brought into contact with the corresponding photosensitive drums 50Y, 50M and 50C in time for development on the photosensitive drums 50Y, 50M and 50C in timed relation to the conveyance of the sheet S.

In this way, the image-forming apparatus 1 can establish not only the alteration of the rotation speed ratio between the photosensitive drum 50 and the developing roller 61, but also the contact of the developing roller 61 with the photosensitive drum 50 just in time for development of a toner image on the photosensitive drum 50 in synchronism with the conveyance of the sheet S.

Further, in the image-forming apparatus 1 according to the above-described embodiment, the timing at which the C developing roller 61C is brought to the contact position in the low speed mode (illustrated in FIG. 25B) is coincident with the timing in the normal mode (illustrated in FIG. 25A). Therefore, in the low speed mode, prolongation in contacting time period between the C developing roller 61C and the C photosensitive drum 50C can be obviated, and prolongation in contacting time period between the developing rollers 61Y and 61M and the corresponding photosensitive drums 50Y and 50M can be minimized. This is in high contrast to a configuration where the timing at which the C developing roller 61C is brought to the contact position in the low speed mode is earlier than the timing at which the C developing roller 61C is brought to the contact position in the normal mode.

Further, in the image-forming apparatus 1 according to the above-described embodiment, the timing at which the Y developing roller 61Y starts separation from the photosensitive drum 50Y in the low speed mode illustrated in FIG. 25B is coincident with the timing in the normal mode illustrated in FIG. 25A. Therefore, in the low speed mode, prolongation in contacting time period between the Y developing roller 61Y and the Y photosensitive drum 50Y can be obviated, and prolongation in contacting time period between the developing rollers 61M and 61C and the corresponding photosensitive drums 50M and 50C can be minimized. This is in high contrast to a configuration where the timing at which the Y developing roller 61Y starts separation from the Y photosensitive drum 50Y in the low speed mode is later than the timing in the normal mode.

Further, in the image-forming apparatus 1 according to the above-described embodiment, in a case of moving the developing roller 61 from the separated position to the contact position, the timing at which the YMC clutch 140A is turned ON in the high speed mode (timing t53) is later than the timing at which the YMC clutch 140A is turned ON in the normal mode (timing t13) to start rotating the cams 150Y, 150M and 150C to move the developing rollers 61Y, 61M and 61C toward the respective contact positions. This timing differential is set in order to make the timing at which the Y developing roller 61Y is brought to the contact position in the high speed mode (see FIG. 25C) on or before the timing at which the Y developing roller 61Y is brought to the contact position in the normal mode (see FIG. 25A). Hence, irrespective of the modes for image formation, the developing rollers 61Y, 61M and 61C can be brought into contact with the corresponding photosensitive drums 50Y, 50M and 50C in time for development on the photosensitive drums 50Y, 50M and 50C in timed relation to the conveyance of the sheet S.

Further, the above-described configuration in the high speed mode can restrain prolongation of the contacting time period between the developing roller 61 and the photosensitive drum 50, in comparison with a configuration where the timing to turn on the YMC clutch 140A in the high speed mode for rotating the cams 150Y, 150M and 150C is set earlier than the turning ON timing of the YMC clutch 140A in the normal mode.

Further, in the image-forming apparatus 1 according to the above-described embodiment, the timing at which the Y developing roller 61Y is brought to the contact position in the normal mode (FIG. 25A) is coincident with the timing in the high speed mode (FIG. 25C). Therefore, in the high speed mode, prolongation in contacting time period between the Y developing roller 61Y and the Y photosensitive drum 50Y can be obviated, and prolongation in contacting time period between the developing rollers 61M and 61C and the corresponding photosensitive drums 50M and 50C can be minimized. This is in high contrast to a configuration where the timing at which the Y developing roller 61Y is brought to the contact position in the high speed mode is earlier than the timing at which the Y developing roller 61Y is brought to the contact position in the normal mode.

Further, in the image-forming apparatus 1 according to the above-described embodiment, the timing at which the YMC clutch 140A is turned ON in the high speed mode (timing t55) is later than the timing at which the YMC clutch 140A is turned ON in the normal mode (timing t15) in order to start rotating the cams 150Y, 150M and 150C to start moving the developing rollers 61Y, 61M and 61C toward the respective separated positions. This timing differential is set in order to set the timing at which the C developing roller 61C starts moving toward the separated position in the high speed mode to be on or after the timing at which the C developing roller 61C starts moving toward the separated position in the normal mode. Hence, separation of the C developing roller 61C from the C photosensitive drum 50C during development on the C photosensitive drum 50C can be avoided in the high speed mode.

Further, in the image-forming apparatus 1 according to the above-described embodiment, the timing at which the C developing roller 61Y starts moving toward the separated position in the high speed mode is coincident with the timing in the normal mode. Therefore, in the high speed mode, prolongation in contacting time period between the C developing roller 61C and the C photosensitive drum 50C can be obviated, and prolongation in contacting time period between the developing rollers 61Y, 61M and the corresponding photosensitive drums 50Y, 50M can be minimized. This is in high contrast to a configuration where the timing at which the C developing roller 61C starts moving toward the separated position in the high speed mode is later than the timing at which the C developing roller 61C starts moving toward the separated position in the normal mode.

Further, in the image-forming apparatus 1 according to the above-described embodiment, the developing cartridges 60M, 60C and 60K are at locations overlapping with the paths of light beams to be irradiated on the photosensitive drums 50Y, 50M and 50C positioned immediately upstream of the respective cartridges 60M, 60C and 60K in the sheet conveying direction, when the developing rollers 61M, 61C and 61K are respectively at the separated positions. Here, since the developing cartridges 60M, 60C and 60K are moved for moving the developing rollers 61M, 61C and 61K to the contact positions prior to exposure to the photosensitive drums 50Y, 50M and 50C, size of each developing cartridge 60 can be increased to increase a toner accommodating capacity thereof, in comparison with a configuration where developing cartridges are arranged not to interfere with paths of light beams regardless of the positions of the respective developing cartridges.

Various modifications are conceivable.

For example, in the above-described embodiment, the timing at which the C developing roller 61C is brought to the contact position is the same between the normal mode and the low speed mode (see FIGS. 25A and 25B). However, the timing at which the C developing roller 61C is brought to the contact position in the low speed mode may be earlier than the timing in the normal mode.

Further, in the above-described embodiment, the timing at which the Y developing roller 61Y starts moving toward the separated position is the same between the normal mode and the low speed mode (see FIGS. 25A and 25B). However, the timing at which the Y developing roller 61Y starts moving toward the separated position in the low speed mode may be later than the timing in the normal mode.

Further, in the above-described embodiment, the timing at which the Y developing roller 61Y is brought to the contact position is the same between the normal mode and the high speed mode (see FIGS. 25A and 25C). However, the timing at which the Y developing roller 61Y is brought to the contact position in the high speed mode may be earlier than the timing in the normal mode.

Further, in the above-described embodiment, the timing at which the C developing roller 61C starts moving toward the separated position is the same between the normal mode and the high speed mode (see FIGS. 25A and 25C). However, the timing at which the C developing roller 61C starts moving toward the separated position in the high speed mode may be later than the timing in the normal mode.

Further, in the above-described embodiment, the normal mode, the low speed mode and the high speed mode are performable in the image-forming apparatus 1. However, only the normal mode and the low speed mode may be performable, and, alternatively, only the normal mode and the high speed mode may be performable. Further, conditions for performing the low speed mode and the high speed mode may not be limited to the conditions described above.

Further, in the above-described embodiment, the developing cartridges 60M, 60C and 60K are positioned to overlap with the paths of light beams to be irradiated to the photosensitive drums 50Y, 50M and 50C those positioned immediately upstream of the developing cartridges 60M, 60C and 60K when the developing rollers 61M, 61C and 61K are respectively positioned at the separated positions. However, the developing cartridges 60M, 60C and 60K may be configured not to overlap with the paths of light beams regardless of the positions of the developing rollers 61M, 61C and 61K.

Further, the image-forming apparatus 1 according to the above-described embodiment is a color printer using toners of four colors. However, the image-forming apparatus of the disclosure may be exemplified as a color printer employing toners of three colors or five colors for forming color images. Still alternatively, a multifunction device and a copying machine are also available as the image-forming apparatus of the disclosure.

The elements described in the depicted embodiment and variations may be combined with one another as appropriate.

While the description has been made in detail with reference to the embodiments, it would be apparent to those skilled in the art that many modifications and variations may be made thereto.

REMARKS

The image-forming apparatus 1 is an example of an image-forming apparatus. The process motor 3P is an example of a process motor. The developing motor 3D is an example of a developing motor. The sheet feed mechanism 22 is an example of a sheet conveying device. The Y photosensitive drum 50Y is an example of a first photosensitive drum. The Y developing roller 61Y is an example of a first developing roller. The cam 150Y is an example of a first cam. The C photosensitive drum 50C is an example of a second photosensitive drum. The C developing roller 61C is an example of a second developing roller. The cam 150C is an example of a second cam. The M photosensitive drum 50M is an example of a third photosensitive drum. The M developing roller 61M is an example of a third developing roller. The cam 150M is an example of a third cam. The YMC clutch 140A is an example of a switching mechanism. The controller 2 is an example of a controller. The Y developing cartridge 60Y is an example of a first developing cartridge. The C developing cartridge 60C is an example of a second developing cartridge. The C developing cartridge 60C is an example of a second developing cartridge. The M developing cartridge 60M is an example of a third developing cartridge. The exposure device 40 is an example of an exposure device. The temperature sensor 6 is an example of a temperature sensor.

What is claimed is:

1. An image-forming apparatus comprising:

a process motor;

a sheet conveying device configured to convey a sheet in a sheet conveying direction upon receipt of a driving force from the process motor;

a first photosensitive drum rotatable upon receipt of the driving force from the process motor;

a second photosensitive drum rotatable upon receipt of the driving force from the process motor and positioned downstream of the first photosensitive drum in the sheet conveying direction;

a sensor configured to detect a leading end of the sheet;

a developing motor;

a first developing roller rotatable upon receipt of a driving force from the developing motor, the first developing roller being movable between a contact position in contact with the first photosensitive drum and a separated position away from the first photosensitive drum;

a second developing roller rotatable upon receipt of the driving force from the developing motor, the second developing roller being movable between a contact position in contact with the second photosensitive drum and a separated position away from the second photosensitive drum;

a first cam rotatable in a prescribed rotational direction upon receipt of the driving force from the developing motor, rotations of the first cam causing the first developing roller to move between the contact position and the separated position relative to the first photosensitive drum;

a second cam rotatable in the prescribed rotational direction upon receipt of the driving force from the developing motor, rotations of the second cam causing the second developing roller to move:

from the contact position to the separated position after movement of the first developing roller from the contact position to the separated position; and from the separated position to the contact position after movement of the first developing roller from the separated position to the contact position;

a switching mechanism switchable between a transmission state and a cut-off state to control transmission of the driving force from the developing motor to the first cam and the second cam, the transmission state allowing the transmission of the driving force from the developing motor to the first cam and the second cam, the cut-off state interrupting the transmission of the driving force from the developing motor to the first cam and the second cam; and a controller configured to provide control to the developing motor, the process motor and the switching mechanism to execute a normal mode and a low speed mode, the controller being configured to rotate the developing motor at a first rotation speed and rotate the process motor at a second rotation speed in the normal mode, and the controller being configured to rotate the developing motor at a rotation speed slower than the first rotation speed and rotate the process motor at the second rotation speed in the low speed mode, the controller being configured to control the switching mechanism, for moving each of the first developing roller and the second developing roller from the separated position to the contact position, such that a time period from a timing at which the sensor detects the leading end of the sheet to a timing at which the switching mechanism is switched to the transmission state in the low speed mode is shorter than a time period from the timing at which the sensor detects the leading end of the sheet to a timing at which the switching mechanism is switched to the transmission state in the normal mode.

2. The image-forming apparatus according to claim 1, wherein, for moving each of the first developing roller and the second developing roller from the separated position to the contact position, the controller is configured to control the switching mechanism to be in the transmission state such that the timing at which the second developing roller comes in contact with the second photosensitive drum in the low speed mode is coincident with the timing at which the second developing roller comes in contact with the second photosensitive drum in the normal mode.

3. The image-forming apparatus according to claim 1, wherein, for moving each of the first developing roller and the second developing roller from the contact position to the separated position, the controller is configured to control the switching mechanism to be in the transmission state such that a timing at which the first developing roller starts separating from the first photosensitive drum in the low speed mode is coincident with or later than a timing at which the first developing roller starts separating from the first photosensitive drum in the normal mode.

4. The image-forming apparatus according to claim 1, wherein the controller is further configured to execute a high speed mode in which the controller rotates the developing motor at a rotation speed higher than the first rotation speed and rotate the process motor at the second rotation speed, and wherein, for moving each of the first developing roller and the second developing roller from the separated position to the contact position, the controller is configured to control the switching mechanism to be in the transmission state such that a timing at which the first developing roller comes in contact with the first photosensitive drum in the high speed mode is coincident with or earlier than a timing at which the first developing roller comes in contact with the first photosensitive drum in the normal mode.

5. The image-forming apparatus according to claim 4, wherein, for moving each of the first developing roller and the second developing roller from the contact position to the separated position, the controller is configured to control the switching mechanism to be in the transmission state such that a timing at which the second developing roller starts separating from the second photosensitive drum in the high speed mode is coincident with or later than a timing at which the second developing roller starts separating from the second photosensitive drum in the normal mode.

6. The image-forming apparatus according to claim 1, further comprising:

a third photosensitive drum rotatable upon receipt of the driving force from the process motor and positioned between the first photosensitive drum and the second photosensitive drum in the sheet conveying direction;

a third developing roller rotatable upon receipt of the driving force from the developing motor, the third developing roller being movable between a contact position in contact with the third photosensitive drum and a separated position away from the third photosensitive drum; and a third cam rotatable in the prescribed rotational direction upon receipt of the driving force from the developing motor, rotation of the third cam causing the third developing roller to move:

from the separated position to the contact position at a timing after movement of the first developing roller from the separated position to the contact position and before movement of the second developing roller from the separated position to the contact position; and from the contact position to the separated position at a timing after movement of the first developing roller from the contact position to the separated position and before movement of the second developing roller from the contact position to the separated position, wherein, in the transmission state, the switching mechanism is configured to transmit the driving force from the developing motor to the first cam, the second cam and the third cam, and wherein, in the cut-off state, the switching mechanism is configured to interrupt transmission of the driving force from the developing motor to the first cam, the second cam and the third cam.

7. The image-forming apparatus according to claim 6, further comprising:

an exposure device configured to emit laser beams toward the first photosensitive drum, the second photosensitive drum and the third photosensitive drum for exposure;

a first developing cartridge including the first developing roller;

a second developing cartridge including the second developing roller, the second developing cartridge being positioned to overlap with the laser beam toward the third photosensitive drum while the second developing roller is at the separated position; and a third developing cartridge including the third developing roller, the third developing cartridge being positioned to overlap with the laser beam toward the first photosensitive drum while the third developing roller is at the separated position, wherein the controller is configured to:

move the third developing roller to the contact position before starting exposure to the first photosensitive drum; and move the second developing roller to the contact position before starting exposure to the third photosensitive drum.

8. The image-forming apparatus according to claim 1, further comprising:

a housing; and a temperature sensor configured to detect a temperature of the housing, wherein the controller is configured to execute the low speed mode in a case where the temperature of the housing detected by the temperature sensor is equal to or lower than a predetermined temperature.

9. The image-forming apparatus according to claim 1, wherein the controller is configured to execute the low speed mode in a case where an amount of toner to be supplied from the first developing roller to the first photosensitive drum and from the second developing roller to the second photosensitive drum is to be smaller than in the normal mode.

10. The image-forming apparatus according to claim 1, wherein the switching mechanism comprises, between the developing motor and both the first cam and the second cam, a small diameter gear and a large diameter gear, and wherein a number of gear teeth of the small diameter gear is smaller than a number of gear teeth of the large diameter gear.

11. An image-forming apparatus comprising:

a process motor;

a sheet conveying device configured to convey a sheet in a sheet conveying direction;

a first photosensitive drum rotatable upon receipt of a process driving force from the process motor;

a second photosensitive drum rotatable upon receipt of the process driving force from the process motor and positioned downstream of the first photosensitive drum in the sheet conveying direction;

a first developing roller rotatable upon receipt of a developing driving force, the first developing roller being movable between a contact position in contact with the first photosensitive drum and a separated position away from the first photosensitive drum;

a second developing roller rotatable upon receipt of the developing driving force, the second developing roller being movable between a contact position in contact with the second photosensitive drum and a separated position away from the second photosensitive drum;

a first cam rotatable in a prescribed rotational direction upon receipt of the developing driving force, rotations of the first cam causing the first developing roller to move between the contact position and the separated position;

a second cam rotatable in the prescribed rotational direction upon receipt of the developing driving, rotations of the second cam causing the second developing roller to move:

from the separated position to the contact position after movement of the first developing roller from the separated position to the contact position; and from the contact position to the separated position after movement of the first developing roller from the contact position to the separated position;

a developing motor configured to supply the developing driving force to the first developing roller, the second developing roller, the first cam and the second cam;

a switching mechanism switchable between a transmission state and a cut-off state to control transmission of the developing driving force from the developing motor to the first cam and the second cam, the transmission state allowing the transmission of the developing driving force from the developing motor to the first cam and the second cam, the cut-off state preventing the transmission of the developing driving force from the developing motor to the first cam and the second cam; and a controller configured to control rotations of the developing motor and the process motor to execute a first mode and a second mode, the controller being configured to rotate the developing motor at a first rotation speed and rotate the process motor at a second rotation speed in the first mode, and the controller being configured to rotate the developing motor at a third rotation speed different from the first rotation speed and rotate the process motor at the second rotation speed in the second mode.

12. The image-forming apparatus according to claim 11, wherein the third rotation speed is slower than the first rotation speed.

13. The image-forming apparatus according to claim 12, wherein the sheet conveying device is configured to convey the sheet upon receipt of the process driving force from the process motor, and wherein, for moving each of the first developing roller and the second developing roller from the separated position to the contact position, the controller is configured to control the switching mechanism to be in the transmission state such that a timing at which the second developing roller comes in contact with the second photosensitive drum in the second mode is coincident with or earlier than a timing at which the second developing roller comes in contact with the second photosensitive drum in the first mode.

14. The image-forming apparatus according to claim 12, further comprising a sensor configured to detect a leading end of the sheet, wherein the controller is configured to control the switching mechanism, for moving each of the first developing roller and the second developing roller from the separated position to the contact position, such that a time period from a timing at which the sensor detects the leading end of the sheet to a timing at which the switching mechanism is switched to the transmission state in the second mode is shorter than a time period from the timing at which the sensor detects the leading end of the sheet to a timing at which the switching mechanism is switched to the transmission state in the first mode.

15. The image-forming apparatus according to claim 11, wherein the third rotation speed is higher than the first rotation speed.

16. The image-forming apparatus according to claim 15, wherein the sheet conveying device is configured to convey the sheet upon receipt of the process driving force from the process motor, and wherein, for moving each of the first developing roller and the second developing roller from the separated position to the contact position, the controller is configured to control the switching mechanism to be in the transmission state such that a timing at which the first developing roller comes in contact with the first photosensitive drum in the second mode is coincident with or earlier than a timing at which the first developing roller comes in contact with the first photosensitive drum in the first mode.

17. The image-forming apparatus according to claim 11, wherein the switching mechanism comprises, between the developing motor and both the first cam and the second cam, a small diameter gear and a large diameter gear, and wherein a number of gear teeth of the small diameter gear is smaller than a number of gear teeth of the large diameter gear.

18. An image-forming apparatus comprising:

a first photosensitive drum;

a first developing roller movable between a first contact position where the first developing roller is in contact with the first photosensitive drum and a first separated position where the first developing roller is separated from the first photosensitive drum;

a first cam for moving the first developing roller between the first contact position and the first separated position;

a second photosensitive drum;

a second developing roller movable between a second contact position where the second developing roller is in contact with the second photosensitive drum and a second separated position where the second developing roller is separated from the second photosensitive drum;

a second cam for moving the second developing roller between the second contact position and the second separated position;

a process motor for driving the first photosensitive drum and the second photosensitive drum;

a developing motor for driving the first developing roller, the first cam, the second developing roller, and the second cam; and a controller configured to control the developing motor, the process motor, the first cam and the second cam, the controller being configured to control the developing motor and the process motor in:

a first mode in which the process motor rotates at a first process speed and the developing motor rotates at a first developing speed; and a second mode in which the process motor rotates at a second process speed and the developing motor rotates at a second developing speed slower than the first developing speed, a ratio of the first process speed to the first developing speed in the first mode being different from a ratio of the second process speed to the second developing speed in the second mode.

19. The image-forming apparatus according to claim 18, further comprising:

a sheet conveying device configured to convey a sheet in a sheet conveying direction and to be driven by the process motor;

a sensor configured to detect a leading end of the sheet; and a switching mechanism switchable between a transmission state and a cut-off state to control movements of the first cam and the second cam, the transmission state allowing the developing motor to drive the first cam and the second cam, the cut-off state preventing the developing motor from moving the first cam and the second cam, wherein the controller is configured to control the developing motor and the process motor, for moving each of the first developing roller and the second developing roller from the separated position to the contact position, such that a time period from a timing at which the sensor detects the leading end of the sheet to a timing at which the transmission mechanism is switched to the transmission state in the second mode is shorter than a time period from the timing at which the sensor detects the leading end of the sheet to a timing at which the switching mechanism is switched to the transmission state in the first mode.

20. The image-forming apparatus according to claim 18, further comprising:

a small diameter gear; and a large diameter gear, a number of gear teeth of the small diameter gear being smaller than a number of gear teeth of the large diameter gear, wherein the small diameter gear and the large diameter gear are between the developing motor and both the first cam and the second cam.

* * * * *